US006179678B1

(12) United States Patent
Kishi et al.

(10) Patent No.: US 6,179,678 B1
(45) Date of Patent: Jan. 30, 2001

(54) METHOD OF MANUFACTURING ELECTRON-EMITTING DEVICE ELECTRON SOURCE AND IMAGE-FORMING APPARATUS

(75) Inventors: Fumio Kishi, Kanagawa-ken; Masato Yamanobe, Machida; Takeo Tsukamoto, Atsugi; Toshikazu Ohnishi, Sagamihara; Keisuke Yamamoto, Yamoto; Sotomitsu Ikeda, Atsugi; Yasuhiro Hamamoto, Machida; Kazuya Miyazaki, Atsugi, all of (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/244,164

(22) Filed: Feb. 4, 1999

Related U.S. Application Data

(62) Division of application No. 08/508,931, filed on Jul. 28, 1995.

(30) Foreign Application Priority Data

| | | |
|---|---|---|
| Aug. 29, 1994 | (JP) | 6-226115 |
| Dec. 26, 1994 | (JP) | 6-336626 |
| Dec. 26, 1994 | (JP) | 6-336712 |
| Dec. 26, 1994 | (JP) | 6-336713 |
| Mar. 22, 1995 | (JP) | 7-87759 |
| Jun. 26, 1995 | (JP) | 7-182049 |

(51) Int. Cl.[7] ..... H01J 9/02
(52) U.S. Cl. ..... 445/24
(58) Field of Search ..... 445/6, 24, 50

(56) References Cited

U.S. PATENT DOCUMENTS

| | | | |
|---|---|---|---|
| 4,954,744 | 9/1990 | Suzuki et al. | 313/336 |
| 5,290,610 | 3/1994 | Kane | 427/577 |
| 5,591,061 * | 1/1997 | Ikeda et al. | 445/6 |
| 5,623,634 | 4/1997 | Liu | 395/478 |
| 5,674,100 | 10/1997 | Ono et al. | 445/24 |

FOREIGN PATENT DOCUMENTS

| | | |
|---|---|---|
| 0609532 A1 | 8/1994 | (EP) . |
| 0660357 A1 | 6/1995 | (EP) . |
| 0031332 | 2/1989 | (JP) . |
| 0279542 | 11/1989 | (JP) . |
| 0283749 | 11/1989 | (JP) . |
| 13092242 | 12/1989 | (JP) . |

OTHER PUBLICATIONS

"Metal Influence on Switching MIM Diodes", H. Pagnia et al., phys. stat. sol. (a) 111,387 (1989).

"Thin Film Handbook", Committee 131 of Japanese Society for the Promotion of Art and Science (1983), and English–language translation.

Patent Abstracts of Japan, vol. 815, No. 167 (C–0827) Apr. 24, 1991.

M. Hartwell et al., "Strong Electron Emission From Patterned Tin–Indium Oxide Thin Films," Int. Electron Devices Meeting, 1975, --.519–521.

(List continued on next page.)

* cited by examiner

*Primary Examiner*—Kenneth J. Ramsey
(74) *Attorney, Agent, or Firm*—Fitzpatrick, Cella, Harper & Scinto

(57) ABSTRACT

An electron-emitting device comprises a pair of electrodes and an electroconductive film arranged between the electrodes and including an electron-emitting region carrying a graphite film. The graphite film shows, in a Raman spectroscopic analysis using a laser light source with a wavelength of 514.5 nm and a spot diameter of 1$\mu$m, peaks of scattered light, of which 1) a peak (P2) located in the vicinity of 1,580 $cm^{-1}$ is greater than a peak (P1) located in the vicinity of 1,335 $cm^{-1}$ or 2) the half-width of a peak (P1) located in the vicinity of 1,335 $cm^{-1}$ is not greater than 150 $cm^{-1}$.

15 Claims, 27 Drawing Sheets

OTHER PUBLICATIONS

M. Elinson, et al., "The Emission of Hot Electrons and The field Emission of Electrons from Tin Oxide," Radio Engineering and Electronic Physics, 1965, pp. 1290–96.

H. Araki, et a., "Electroforming and Electron Emission f Carbon Thin Films," J. Vac. Soc. Japan, vol. 26, 1983, pp. 22–29.

G. Dittmer, "Electrical Conduction and Electron Emission of Discontinuous Thin Films," Thin Solid Films, 9 (1972) pp. 317–328.

C.A. Spindt, et al., "Physical Properties of Thin–Film Field Emission Cathodes with Molybdenum Cones," J. Appl. Phys., vol. 47 (1976), pp. 5248–5263.

C.A. Mead, "Operation of Tunnel–Emission Devices," J. Appl. Phys., 32, pp. 646–652, 1961.

Dyke and Dolan, "Field Emission," Advances in Electronics and Electron Physics, vol. VIII, (1956), pp. 90–185.

"Scanning Tunnelling Microscopic Investigations of Electroformed Planar Metal–insulator–metal Diodes," H. Pagnia, N. Sotnik and W. Wirth, Int. J. Electronics, vol. 69, No. 1, 25–32 (1990).

"Energy Distribution of Emitted Electrons from Electroformed MIM Structures: The Carbon Island Model," M. Bischoff, H. Pagnia and J. Trickl, Int. J. Electronics, vol. 73, No. 5, 1009–1010 (1992).

"Thin Film Handbook," Committee 131 of Japanese Society of the Promotion of Art and Science (1983).

"On the Electron Emission from Evaporated Thin Au Films," M. Bischoff, R. Holzer and H. Pagnia, Physics Letters, vol. 62A, No. 7 (Oct. 3, 1977).

"The Electroforming Process in MIM Diodes," vol. 85, R. Blessing, H. Pagnia and N. Sotnik, Thin Solid Films, 119–128 (1981).

"Evidence for the Contribution of an Adsorbate to the Voltage–Controlled Negative Resistance of Gold Island Film Diodes," R. Blessing, H. Pagnia and R. Schmitt, Thin Solid Films, vol. 78, 397–401 (1981).

"Water–Influenced Switching in Discontinuous Au Film Diodes," R. Muller and H. Pagnia, Materials Letters, vol. 2, No. 4A, 283–285 (Mar. 1984).

"Influence of Organic Molecules on the Current–Voltage Characteristics of Planar MIM Diodes," H. Pagnia, N. sotnik and H. Strauss, Phy. Stat. Sol., vol. 90, 771–778 (1985).

"Influence of Gas Composition on Regeneration in Metal/Insulator/Metal Diodes," M. Borbonus, H. Pagina and N. Sotnik, Thin Solid Films, vol. 151, 333–342 (1987.

"Prospectus for Metal/non–Metal Microsystems: Sensors, Sources and Switches," H. Pagnia, Int. J. Electronics, vol. 73, No. 5, 319–825 (1992).

"Carbon–nanoslit Model for The Electroforming Process in MIM Structures," M. Bischoff, Int. J. Electronics, vol. 70, No. 3, 491–498 (1991).

METHOD OF MANUFACTURING ELECTRON-EMITTING DEVICE ELECTRON SOURCE AND IMAGE-FORMING APPARATUS

This application is a division of application Ser. No. 08/508,931 filed Jul. 28, 1995.

BACKGROUND OF THE INVENTION

1. Field of the Invention

This invention relates to an electron-emitting device that is free from degradation due to long use and the undesired phenomenon of electric discharge under a voltage applied thereto and can emit electrons stably and efficiently for a long time. It also relates to an electron source and an image forming apparatus such as a display apparatus or an exposure apparatus comprising such devices as well as a method of manufacturing the same.

2. Related Background Art

There have been known two types of electron-emitting device; the thermionic cathode type and the cold cathode type. Of these, the cold cathode emission type refers to devices including field emission type (hereinafter referred to as the FE type) devices, metal/insulation layer/metal type (hereinafter referred to as the MIM type) electron-emitting devices and surface conduction electron-emitting devices. Examples of FE type device include those proposed by W. P. Dyke & W. W. Dolan, "Field emission", Advance in Electron Physics, 8, 89 (1956) and C. A. Spindt, "PHYSICAL Properties of thin-film field emission cathodes with molybdenum cones", J. Appl. Phys., 47, 5284 (1976).

Examples of MIM devices are disclosed in papers including C. A. Mead, "The tunnel-emission amplifier", J. Appl. Phys., 32, 646 (1961).

Examples of surface conduction electron-emitting devices include one proposed by M. I. Elinson, Radio Eng. Electron Phys., 10 (1965).

A surface conduction electron-emitting device is realized by utilizing the phenomenon that electrons are emitted out of a small thin film formed on a substrate when an electric current is forced to flow in parallel with the film surface. While Elinson proposes the use of an $SnO_2$ thin film for a device of this type, the use of an Au thin film is proposed in G. Dittmer: "Thin Solid Films", 9, 317 (1972) whereas the use of $In_2O_3/SnO_2$ and of carbon thin film is discussed respectively in [M. Hartwell and C. G. Fonstad: "IEEE Trans. ED Conf.", 519 (1975)] and [H. Araki et al.: "Vacuum", Vol. 26, No. 1, p. 22 1983.

FIG. 33 of the accompanying drawings schematically illustrates a typical surface conduction electron-emitting device proposed by M. Hartwell. In FIG. 33, reference numeral 1 denotes a substrate. Reference numeral 4 denotes an electroconductive thin film normally prepared by producing an H-shaped thin metal oxide film by means of sputtering, part of which eventually makes an electron-emitting region 5 when it is subjected to an electrically energizing process referred to as "energization forming" as described hereinafter. In FIG. 33, the thin horizontal area of the metal oxide film separating a pair of device electrodes has a length L of 0.5 to 1 mm and a width W of 0.1 mm.

Conventionally, an electron emitting region 5 is produced in a surface conduction electron-emitting device by subjecting the electroconductive thin film 4 of the device to an electrically energizing preliminary process, which is referred to as "energization forming". In the energization forming process, a constant DC voltage or a slowly rising DC voltage that rises typically at a rate of 1V/min. is applied to given opposite ends of the electroconductive thin film 4 to partly destroy, deform or transform the film and produce an electron-emitting region 5 which is electrically highly resistive. Thus, the electron-emitting region 5 is part of the electroconductive thin film 4 that typically contains a gap or gaps therein so that electrons may be emitted from the gap.

After the energization forming process, the electron-emitting device is subjected to an "activation" process, where a film (carbon film) of carbon and/or one or more than one carbon compounds is formed in the vicinity of the gap of the electron source in order to improve the electron-emitting performance of the device. The process is normally carried out by applying a pulse voltage to the device in an atmosphere that contains one or more than one organic substances so that carbon and/or one or more than one carbon compounds may be deposited in the vicinity of the electron-emitting region. Note that a deposited carbon film is found mainly on the anode side of the electroconductive thin film and only poorly, if any, on the cathode side. In some cases, a "stabilization" process may be carried out on the electron-emitting device in order to prevent carbon and/or one or more than one carbon compounds from being excessively deposited and the device may show a stabilized performance in the operation of electron emission. In the stabilization process, any organic substances that have been adsorbed in the peripheral areas of the device and those that are remaining in the atmosphere are removed.

For a surface conduction electron-emitting device to operate satisfactorily in practical applications, it has to meet a number of requirements including that it needs to show a large emission current Ie and a high electron emission efficiency $\eta$ (=Ie/If, where If is the current that flows between the two device electrodes, which is referred to as device current), that it must operate stably for electron emission after a long use and that no electric discharge phenomenon should be observed on it if a voltage is applied to the device (between the two device electrodes and between the device and an anode).

While the performance of an electron-emitting device is affected by a number of factors, the inventors of the present invention has discovered that the performance is strongly correlated with the shape and the distribution of the carbon film formed on the electron-emitting gap and its vicinity in the activation process as well as the conditions under which the activation process is carried out.

SUMMARY OF THE INVENTION

It is, therefore, the object of the present invention to provide an electron-emitting device that performs well for electron emission by selecting optimal conditions for the carbon film in terms of its distribution, its properties and the conditions under which it is treated before producing the device as a finished product.

According to the invention, the above object is achieved by providing an electron-emitting device comprising a carbon film which is made of graphite and formed inside the gap of the electron-emitting region as shown in FIGS. 1A and 1B of the accompanying drawings. While the device of FIGS. 1A and 1B does not practically carry any carbon film outside the gap, a carbon film may also be formed outside the gap. Although graphite is a crystalline substance containing only carbon atoms, its crystallinity may be accompanied, to certain extent, by "distortions" of various types. For the purpose of the invention, however, a carbon film of highly crystalline graphite is formed in the inside of the gap of the electron-emitting region.

According to an aspect of the invention, there is provided an electron-emitting device comprising a pair of electrodes and an electroconductive film arranged between the electrodes and including an electron-emitting region, characterized in that said electron-emitting region carries a graphite film that shows, in a Raman spectroscopic analysis using a laser light source with a wavelength of 514.5 nm and a spot diameter of 1 $\mu$m, peaks of scattered light, of which 1) a peak (P2) located in the vicinity of 1,580 $cm^{-1}$ is greater than a peak (P1) located in the vicinity of 1,335 $cm^{-1}$ or 2) the half-width of a peak (P1) located in the vicinity of 1,335 $cm^{-1}$ is not greater than 150 $cm^{-1}$.

According to another aspect of the invention, there is provided a method of manufacturing an electron-emitting device comprising a pair of electrodes and an electroconductive film arranged between the electrodes and including an electron-emitting region, characterized in that it comprises a step of applying a voltage to the electroconductive film containing a gap therein and said voltage is a bipolar pulse voltage.

According to a still another aspect of the invention, there is provided a method of manufacturing an electron-emitting device comprising a pair of electrodes and an electroconductive film arranged between the electrodes and including an electron-emitting region, characterized in that it comprises a steps of applying a voltage to the electroconductive film containing a gap therein in an atmosphere containing one or more than one organic substances and applying a voltage to the electroconductive film in an atmosphere containing a gas having a composition expressed by XY (where X and Y respectively represent a hydrogen atom and a halogen atom).

According to a still another aspect of the invention, there is provided a method of manufacturing an electron-emitting device comprising a pair of electrodes and an electroconductive film arranged between the electrodes and including an electron-emitting region, characterized in that it comprises steps of forming a graphite film on the electroconductive film including a gap and removing any deposits other than said graphite.

DETAILED DESCRIPTION OF THE PREFERRED EMBODIMENTS

Figure 1A:
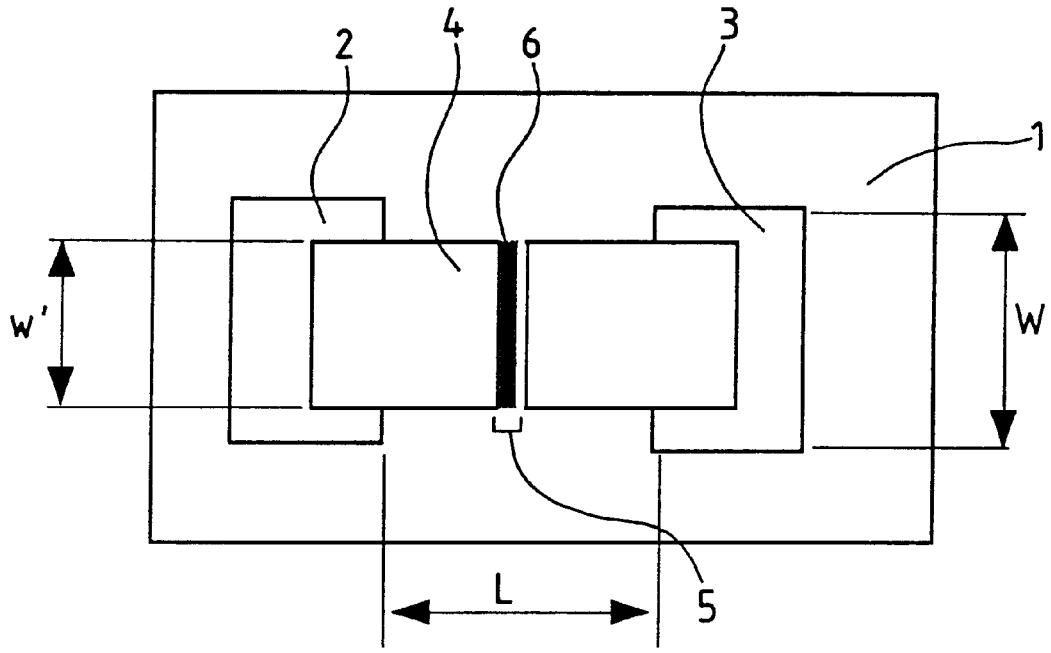
FIGS. 1A and 1B are schematic views showing a plane type surface conduction electron-emitting device according to the invention.

For the purpose of the invention, the crystallinity of graphite is qualitatively and quantitatively determined by observing the crystal lattice of the specimen by means of a transmission electron microscope and Raman spectrometric analysis. In the examples as will be described hereinafter, a Laser Raman Spectrometer provided with a laser source of Ar laser having a wavelength of 514.5 nm and designed to produce a laser spot having a diameter of about 1 $\mu$m on the specimen was used. When the laser spot was located near the electron-emitting region of the electron-emitting device being tested and the scattered light was observed, a spectrum having peaks in the vicinity of 1,335 $cm^{-1}$ (P1) and in the vicinity of 1,580 $cm^{-1}$ (P2) was obtained to prove the existence of a carbon film. The obtained spectrum was artificially well reproduced by assuming a Gauss type peak profile and the existence of a third peak in the vicinity of 1,490 $cm^{-1}$. The particle size of the graphite of each specimen can be estimated by comparing the intensity of light at the peaks and the estimations in the examples agreed fairly well with the results obtained through TEM observation.

The P2 peak is attributable to the phenomenon of electron transition that takes place in the graphite structure, whereas a PI peak is given rise to by distortions in the crystallinity of graphite. Thus, although only the P2 peak is supposed to be observable in an ideal graphite single crystal, a P1 peak appears and becomes observable when the crystalline particles of graphite are very small and/or the crystal lattice of graphite is defective. The P1 peak grows as the crystallinity of graphite is reduced and the half widths of the peaks increase if the periodicity of the graphite crystal structure is disturbed.

Since a graphite film used for the purpose of the present invention is not necessarily made of ideal single crystal graphite, a P1 peak is typically observed there and the half width of the peak can effectively be used to quantitatively estimate the crystallinity of the graphite. As will be described in detail hereinafter, a value of about 150 $cm^{-1}$ seems to provide a limit for the stability of the electron-emitting performance of an electron-emitting device according to the invention. For an electron-emitting device according to the invention to operate properly, either the half width has to show a value smaller than 150 $cm^{-1}$ or the P1 peak has to be sufficiently low.

An electron-emitting device that meets the above requirements has the following effects.

Degradation of an electron-emitting device with time in terms of its electron-emitting performance is attributable, among others, to an unnecessarily growing or, conversely, decreasing deposit of carbon film.

Such an unnecessary growth of the deposit can be effectively suppressed by eliminating any carbon compounds from the atmosphere in which the device is driven to operate. A "stabilization process" as referred to earlier is carried out mainly for the purpose of realizing an atmosphere that is free from carbon compounds.

While many reasons may be conceivable for a possible decrease of the carbon deposit, a specific cause may be that the carbon film is gradually etched away by $O_2$ and/or $H_2O$ remaining in the atmosphere surrounding the device. Thus, it is also necessary to remove such gasses out of the atmosphere.

The electron-emitting performance of an electron-emitting device may also be affected by a phenomenon that the opposite ends of the electroconductive thin film defining the gap of the electron-emitting region gradually retreat from each other to widen the gap. It has been discovered that such a phenomenon can be suppressed to a certain extent if a carbon film is formed on each of said ends of the electroconductive thin film and that the effect of suppressing the widening of the gap is particularly remarkable if the carbon film is made of highly crystalline graphite.

The above effect can also be achieved by forming a graphite film on each of the anode and cathode side ends of the gap of the electron-emitting region. Note that the graphite has to show the above defined degree of crystallinity. It should also be noted that, if an electron-emitting device is subjected to an ordinary stabilization process, a carbon film is formed only on the anode side end of the gap and not on the cathode side end. Consequently, the end of the electroconductive thin film shows a gradually retraction at the cathode side end of the gap and a widened gap over a long period of time of electron-emitting operation, that cannot be suppressed completely unless a graphite film is formed on each end of the gap. As for the electric performance of the device, the leak current and hence the device current If of the device can be reduced and, at the same time, the electron emission current Ie of the device can be raised by applying a relatively high voltage for an activation process so that consequently a high electron emission efficiency $\eta$=Ie/If may be achieved.

Now, an electric discharge phenomenon appears as a voltage is applied between the device electrodes and/or the device and an anode and can damage the electron-emitting device. Therefore, such a phenomenon should be thoroughly suppressed. Although electric discharge can occur when gas molecules surrounding the electron-emitting device are ionized, the pressure of the gas surrounding the device is normally too low for electric discharge to take place. So, if electric discharge occurs while the electron-emitting device is being driven to operate, it implies that gas has been generated somewhere around the device for some reason or other. Of possible gas sources, the most important one is the carbon film deposited on the device for activation. Of course, since the carbon film located in the gap of the electron-emitting region of the device is constantly exposed to Joule's heat and electrons that can collide with it, no gas can normally remain around the film to become ionized.

On the other hand, the carbon film outside the gap of the electron-emitting region of the device can contain hydrogen lingering in the space surrounding the crystalline particles of graphite and, if the film is made of amorphous carbon or a carbon compound, the film may contain hydrogen as a component thereof, which can eventually be released to become hydrocarbon gas. Although the electric discharge phenomenon that can take place on an electron-emitting device has not been fully accounted for to date, it can be satisfactorily suppressed by adopting reasonable counter measures, taking the above explanations into consideration.

More specifically, a surface conduction electron-emitting device according to the invention may comprise a graphite film of a desired crystallinity in the gap and does not substantially comprise a carbon film outside the gap in order to avoid the electric discharge phenomenon.

If a possible source of gas exists outside the gap of the electron-emitting region in the electroconductive thin film of a surface conduction electron-emitting device, electrons emitted from the device and directed toward an anode arranged outside the device may partly be attracted by the anode of the device and come into the gap and partly collide with molecules of the gas remaining in the gap, which by turn produce positive ions and attracted by the cathode of the device. A net result will then be that the carbon film produces gas and eventually gives rise to an electric discharge phenomenon.

Thus, if the electroconductive thin film gets rid of any carbon film outside the gap, the device can effectively suppress the generation of gas and the occurrence of electric discharge. In fact, the measures taken by the inventors of the present invention to remove any carbon film outside the gap of the electron-emitting region have been proven to be very effective as will be described in greater detail hereinafter.

A surface conduction electron-emitting device according to the invention may be configured differently to get rid of the electric discharge phenomenon. More specifically, the electric discharge phenomenon can be effectively suppressed by improving the crystallinity of the carbon film existing outside the gap of the electron-emitting region.

It should also be noted that any of the above described configurations can also improve the electron-emitting performance of a surface conduction electron-emitting device according to the invention.

Now, a method of manufacturing a surface conduction electron-emitting device according to the invention will be described.

Figure 1B:
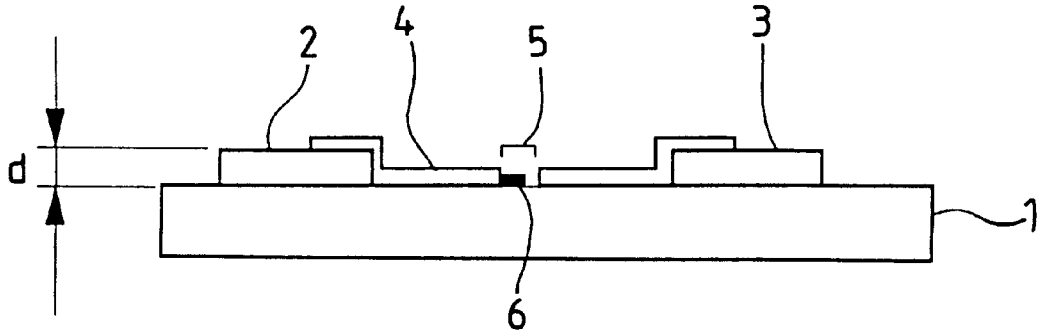

FIGS. 1A and 1B are schematic views showing a plane type surface conduction electron-emitting device according to the invention, of which FIG. 1A is a plan view and FIG. 1B is a sectional side view.

Referring to FIGS. 1A and 1B, the device comprises a substrate 1, a pair of device electrodes 2 and 3, an electroconductive thin film 4 and an electron-emitting region 5 having a gap formed therein.

Materials that can be used for the substrate 1 include quartz glass, glass containing impurities such as Na to a reduced concentration level, soda lime glass, glass substrate realized by forming an $SiO_2$ layer on soda lime glass by means of sputtering, ceramic substances such as alumina.

While the oppositely arranged device electrodes 2 and 3 may be made of any highly conducting material, preferred candidate materials include metals such as Ni, Cr, Au, Mo, W, Pt, Ti, Al, Cu and Pd and their alloys, printable conducting materials made of a metal or a metal oxide selected from Pd, Ag, $RuO_2$, Pd—Ag and glass, transparent conducting materials such as $In_2O_3$—$SnO_2$ and semiconductor materials such as polysilicon.

The distance L separating the device electrodes, the length W of the device electrodes, the contour of the electroconductive film 4 and other factors for designing a surface conduction electron-emitting device according to the invention may be determined depending on the application of the device. The distance L separating the device electrodes 2 and 3 is preferably between hundreds nanometers and hundreds micrometers and, still preferably, between several micrometers and tens of several micrometers depending on the voltage to be applied to the device electrodes and the field strength available for electron emission.

The length W of the device electrodes 2 and 3 is preferably between several micrometers and hundreds of several micrometers depending on the resistance of the electrodes and the electron-emitting characteristics of the device. The film thickness d of the device electrodes 2 and 3 is between tens of several nanometers and several micrometers.

A surface conduction electron-emitting device according to the invention may have a configuration other than the one illustrated in FIGS. 1A and 1B and, alternatively, it may be prepared by laying a thin film 4 including an electron-emitting region on a substrate 1 and then a pair of oppositely disposed device electrodes 2 and 3 on the thin film.

The electroconductive thin film 4 is preferably a fine particle film in order to provide excellent electron-emitting characteristics. The thickness of the electroconductive thin film 4 is determined as a function of the stepped coverage of the electroconductive thin film on the device electrodes 2 and 3, the electric resistance between the device electrodes 2 and 3 and the parameters for the forming operation that will be described later as well as other factors and preferably between a tenth of a nanometer and hundreds of several nanometers and more preferably between a nanometer and fifty nanometers. The electroconductive thin film 4 normally shows a resistance per unit surface area Rs between $10^2$ and $10^7 \Omega/cm^2$. Note that Rs is the resistance defined by R=Rs (l/w), where t, w and l are the thickness, the width and the length of the thin film respectively. Also note that, while the forming process is described by way of an energization forming process for the purpose of the present invention, it is not limited thereto and may be selected from a number of different physical or chemical processes, with which a gap can be formed in a thin film to produce a high resistance region there.

The electroconductive thin film 4 is made of fine particles of a material selected from metals such as Pd, Ru, Ag, Au, Ti, In, Cu, Cr, Fe, Zn, Sn, Ta, W and Pb, oxides such as PdO, $SnO_2$, $In_2O_3$, PbO and $Sb_2O_3$, borides such as $HfB_2$, $ZrB_2$. $LaB_6$, $CeB_6$, $YB_4$ and $GdB_4$, carbides such TiC, ZrC, HfC, TaC, SiC and WC, nitrides such as TiN, ZrN and HfN, semiconductors such as Si and Ge and carbon.

The term a "fine particle film" as used herein refers to a thin film constituted of a large number of fine particles that may be loosely dispersed, tightly arranged or mutually and randomly overlapping (to form an island structure under certain conditions).

The diameter of fine particles to be used for the purpose of the present invention is between a tenth of a nanometer and hundreds of several nanometers and preferably between a nanometer and twenty nanometers.

Since the term "fine particle" is frequently used herein, it will be described in greater depth below.

A small particle is referred to as a "fine particle" and a particle smaller than a fine particle is referred to as an "ultrafine particle". A particle smaller than an "ultrafine particle" and constituted of several hundred atoms is referred to as a "cluster".

However, these definitions are not rigorous and the scope of each term can vary depending on the particular aspect of the particle to be dealt with. An "ultrafine particle" may be referred to simply as a "fine particle" as in the case of this patent application.

"The Experimental Physics Course No. 14: Surface/Fine Particle" (ed., Koreo Kinoshita; Kyoritu Publication, Sep. 1, 1986) describes as follows.

"A fine particle as used herein referred to a particle having a diameter somewhere between 2 to 3 $\mu$m and 10 nm and an ultrafine particle as used herein means a particles having a diameter somewhere between 10 nm and 2 to 3 nm. However, these definitions are by no means rigorous and an ultrafine particle may also be referred to simply as a fine particle. Therefore, these definitions are a rule of thumb in any means. A particle constituted of two to several hundred atoms is called a cluster." (Ibid., p.195, 11.22–26)

Additionally, "Hayashi's Ultrafine Particle Project" of the New Technology Development Corporation defines an "ultrafine particle" as follows, employing a smaller lower limit for the particle size.

"The Ultrafine Particle Project (1981–1986) under the Creative Science and Technology Promoting Scheme defines an ultrafine particle as a particle having a diameter between about 1 and 100 nm. This means an ultrafine particle is an agglomerate of about 100 to $10^8$ atoms. From the viewpoint of atom, an ultrafine particle is a huge or ultrahuge particle." (Ultrafine Particle—Creative Science and Technology: ed., Chikara Hayashi, Ryoji Ueda, Akira Tazaki; Mita Publication, 1988, p.2, 11.1–4) "A particle smaller than an ultrafine particle or a particle comprising several to several hundred atoms is normally referred to as a cluster." (Ibid., p.2, 11.12–13)

Taking the above general definitions into consideration, the term a "fine particle" as used herein refers to an agglomerate of a large number of atoms and/or molecules having a diameter with a lower limit between 0.1 nm and 1 nm and an upper limit of several micrometers.

The electron-emitting region 5 is part of the electroconductive thin film 4 and comprises an electrically highly resistive gap, although its performance is dependent on the thickness and the material of the electroconductive thin film 4 and the energization forming process which will be described hereinafter. The gap of the electron emitting gap 5 may contain in the inside electroconductive fine particles having a diameter between several times of a tenth of a nanometer and tens of several nanometers. Such electroconductive fine particles may contain part or all of the materials that are used to prepare the thin film 4. A graphite film 6 is arranged in the gap of the electron emitting region 5.

A surface conduction type electron emitting device according to the invention and having an alternative profile, or a step type surface conduction electron-emitting device, will now be described.

Figure 3:
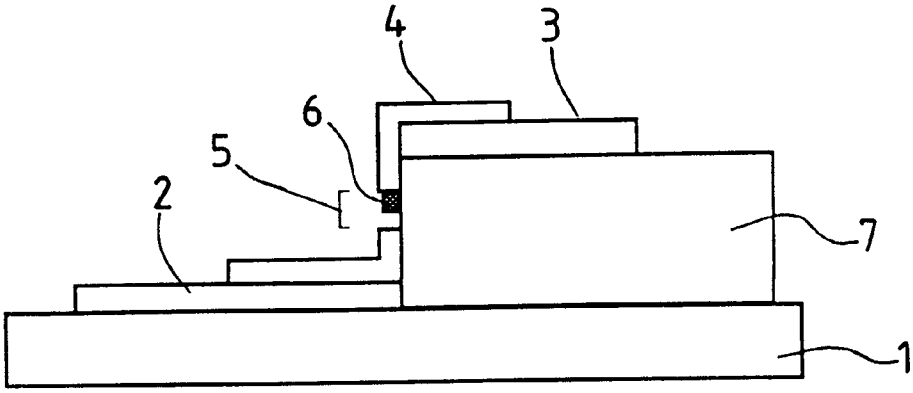
FIG. 3 is a schematic side view of a step type surface conduction electron-emitting device according to the invention.

FIG. 3 is a schematic sectional side view of a step type surface conduction electron emitting device, to which the present invention is applicable.

In FIG. 3, those components that are same or similar to those of FIGS. 1A and 1B are denoted respectively by the same reference symbols. Reference symbol 7 denotes a step-forming section. The device comprises a substrate 1, a pair of device electrodes 2 and 3 and an electroconductive thin film 4 including an electron emitting region 5 having a gap, which are made of materials same as a flat type surface conduction electron-emitting device as described above, as well as a step-forming section 7 made of an insulating material such as $SiO_2$ produced by vacuum deposition, printing or sputtering and having a film thickness corresponding to the distance L separating the device electrodes of a flat type surface conduction electron-emitting device as described above, or between several hundred nanometers and tens of several micrometers. Preferably, the film thickness of the step-forming section 21 is between tens of several nanometers and several micrometers, although it is selected as a function of the method of producing the step-forming section used there, the voltage to be applied to the device electrodes and the field strength available for electron emission.

As the electroconductive thin film 4 including the electron emitting region is formed after the device electrodes 2 and 3 and the step-forming section 21, it may preferably be laid on the device electrodes 2 and 3. While the electron-emitting region 5 is formed in the step-forming section 7 in FIG. 3, its location and contour are dependent on the conditions under which it is prepared, the energization forming conditions and other related conditions are not limited to those shown there.

While various methods may be conceivable for manufacturing a surface conduction electron-emitting device, FIGS. 4A through 4D illustrate a typical one of such methods.

Now, a method of manufacturing a flat type surface conduction electron-emitting device according to the invention will be described by referring to FIGS. 1A and 1B and 4A through 4D. In FIGS. 4A through 4D, those components that are same or similar to those of FIGS. 1A and 1B are denoted respectively by the same reference symbols.

Figure 4A:
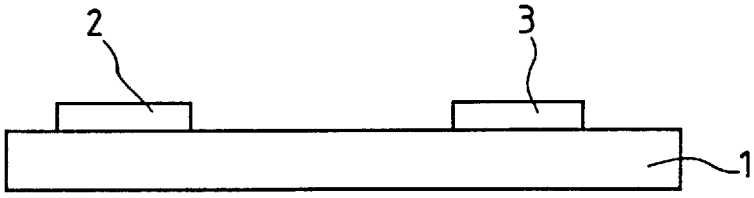
FIGS. 4A through 4D are schematic side views of a (plan type) surface conduction electron-emitting device according to the invention in different manufacturing steps.

1) After thoroughly cleansing a substrate 1 with detergent and pure water, a material is deposited on the substrate 1 by means of vacuum deposition, sputtering or some other appropriate technique for a pair of device electrodes 2 and 3, which are then produced by photolithography (FIG. 4A).

Figure 4B:
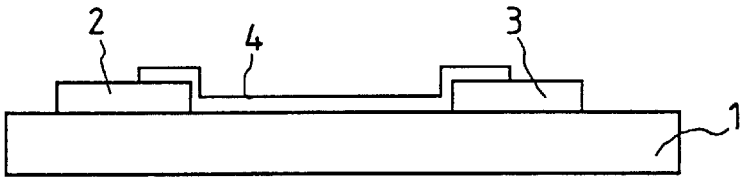

2) An organic metal thin film is formed on the substrate 1 carrying thereon the pair of device electrodes 2 and 3 by applying an organic metal solution and leaving the applied solution for a given period of time. The organic metal solution may contain as a principal ingredient any of the metals listed above for the electroconductive thin film 4. Thereafter, the organic metal thin film is heated, baked and subsequently subjected to a patterning operation, using an appropriate technique such as lift-off or etching, to produce an electroconductive thin film 4 (FIG. 4B). While an organic metal solution is used to produce a thin film in the above description, an electroconductive thin film 4 may alternatively be formed by vacuum deposition, sputtering, chemical vapor phase deposition, dispersed application, dipping, spinner or some other technique.

Figure 4C:
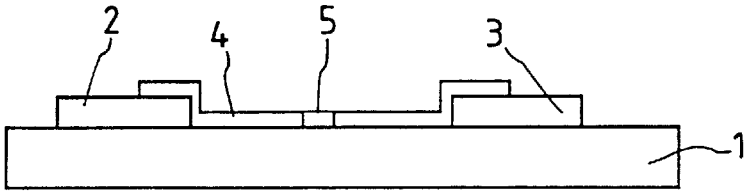
Figure 5A:
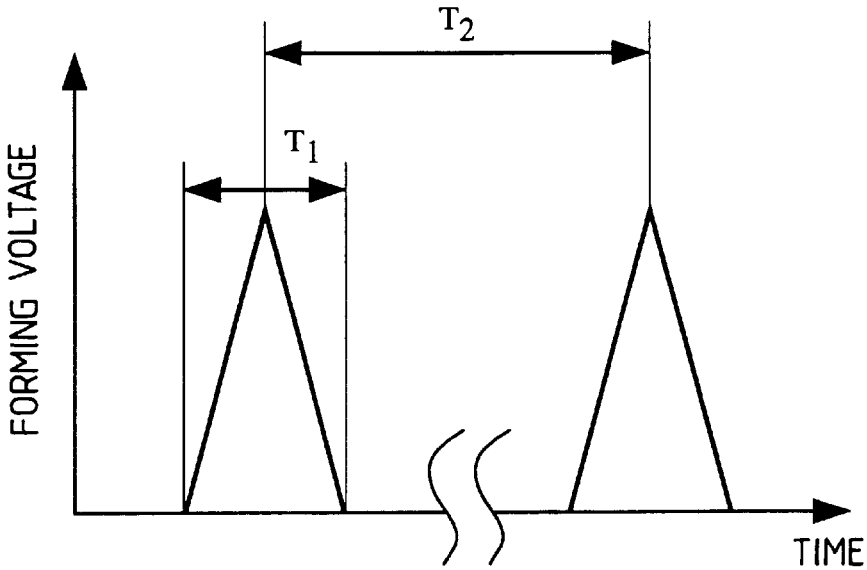
FIGS. 5A and 5B are graphs schematically showing triangular pulse voltage waveforms that can be used for the purpose of the present invention.
Figure 5B:
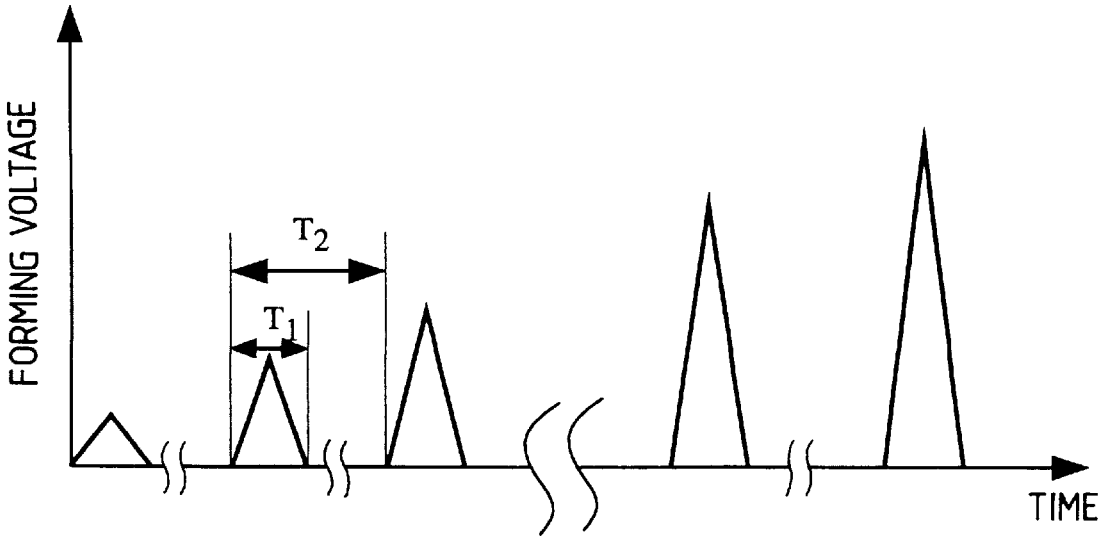

3) Thereafter, the device electrodes 2 and 3 are subjected to a process referred to as "forming". Here, an energization forming process will be described as a choice for forming. More specifically, the device electrodes 2 and 3 are electrically energized by means of a power source (not shown) until an electron emitting region 5 having a gap is produced in a given area of the electroconductive thin film 4 to show a modified structure that is different from that of the electroconductive thin film 4 (FIG. 4C). FIGS. 5A and 5B show two different pulse voltages that can be used for energization forming.

The voltage to be used for energization forming preferably has a pulse waveform. A pulse voltage having a constant height or a constant peak voltage may be applied continuously as shown in FIG. 5A or, alternatively, a pulse voltage having an increasing height or an increasing peak voltage may be applied as shown in FIG. 5B.

In FIG. 5A, the pulse voltage has a pulse width Ti and a pulse interval T2, which are typically between 1 $\mu$sec. and 10 msec. and between 10 $\mu$sec. and 100 msec. respectively. The height of the triangular wave (the peak voltage for the energization forming operation) may be appropriately selected depending on the profile of the surface conduction electron-emitting device. The voltage is typically applied for tens of several minutes. Note, however, that the pulse waveform is not limited to triangular and a rectangular or some other waveform may alternatively be used.

FIG. 5B shows a pulse voltage whose pulse height increases with time. In FIG. 6B, the pulse voltage has an width T1 and a pulse interval T2 that are substantially similar to those of FIG. 6A. The height of the triangular wave (the peak voltage for the energization forming operation) is increased at a rate The energization forming operation will be terminated by measuring the current running through the device electrodes when a voltage that is sufficiently low and cannot locally destroy or deform the electroconductive thin film 2 is applied to the device during an interval T2 of the pulse voltage. Typically the energization forming operation is terminated when a resistance greater than 1M ohms is observed for the device current running through the electroconductive thin film 4 while applying a voltage of approximately 0.1V to the device electrodes.

4) After the energization forming operation, the device is subjected to an activation process.

In an activation process, a pulse voltage may be repeatedly applied to the device in a vacuum atmosphere. In this process, carbon or a carbon compound contained in the organic substances existing in a vacuum atmosphere at a very minute concentration is deposited on the device to give rise to a remarkably change in the device current If and the emission current Ie of the device. The activation process is normally conducted, while observing the device current If and the emission current Ie, and terminated when the emission current Ie gets to a saturated level.

The atmosphere may be produced by utilizing the organic gas remaining in a vacuum chamber after evacuating the chamber by means of an oil diffusion pump and a rotary pump or by sufficiently evacuating a vacuum chamber by means of an ion pump and thereafter introducing the gas of an organic substance into the vacuum. The gas pressure of the organic substance is determined as a function of the profile of the electron-emitting device to be treated, the profile of the vacuum chamber, the type of the organic substance and other factors. Organic substances that can be suitably used for the purpose of the activation process include aliphatic hydrocarbons such as alkanes, alkenes and alkynes, aromatic hydrocarbons, alcohols, aldehydes, ketones, amines, organic acids such as, phenol, carbonic acids and sulfonic acids. Specific examples include saturated hydrocarbons expressed by general formula $C_nH_{2n+2}$ such as methane, ethane and propane, unsaturated hydrocarbons expressed by general formula $C_nH_{2n}$ such as ethylene and propylene, benzene, toluene, methanol, ethanol, formaldehyde, acetaldehyde, acetone, methylethylketone, methylamine, ethylamine, phenol, formic acid, acetic acid and propionic acid.

A rectangular pulse voltage as shown in FIG. 6B may be used as the pulse voltage applied to the device in an activation process.

There may be a number of methods that can be used to produce a graphite film out of the carbon film in the gap of the electron-emitting region.

With a first method, the device is subjected to an etching operation for removing unnecessary portions of the carbon film after the end of the activation process.

The etching operation is carried out by applying a voltage to the device in an atmosphere containing a gas that has an etching effect on carbon.

Figure 4D:
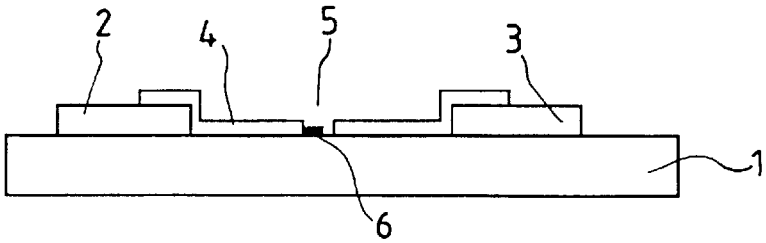

A gas having an etching effect is typically expressed by a general formula of XY (where X and Y represent H or a halogen atom). The carbon film obtained by deposition in the activation process is etched by the etching gas at a rate that is a function of the crystallinity of the carbon. Outside the gap of the electron-emitting region, the carbon film is mostly etched out since it is mainly constituted of fine graphite crystals, amorphous carbon and one or more than one carbon compounds that contain hydrogen and other atoms and, therefore, the carbon film remains only inside the gap. Even inside the gap, those portions that are poorly crystalline are etched out so that only a graphite film 6 that is highly crystalline will remain (FIG. 4D). It may be safely assumed that the etching gas produces hydrogen radicals and other radicals as electrons emitted from the electron-emitting device collide with molecules of the gas.

With a second method, an etching operation is carried out in parallel with an activation process. This may be done by introducing simultaneously or alternately an etching gas such as hydrogen gas and an organic substance into a vacuum chamber to be used for an activation process. The etching operation may be started from the very beginning of the activation process or somewhere in the middle of the activation process. The substrate may be heated during the etching process.

If a lowly crystalline carbon film is formed with this second method, it may be removed immediately so that consequently only a highly crystalline graphite film may be allowed to grow, although, unlike the first method, a graphite may also be formed outside the gap. (See FIG. 24A.)

Figure 6A:
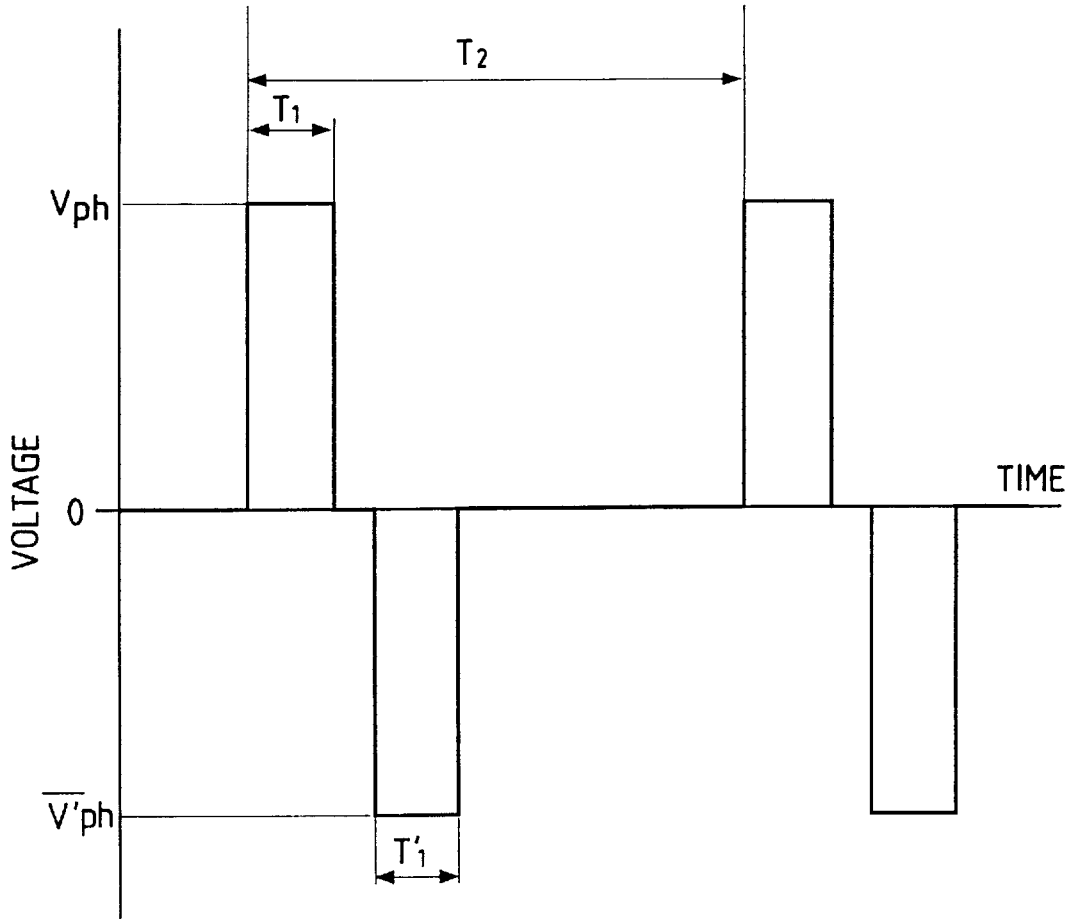
FIGS. 6A and 6B are graphs schematically showing rectangular pulse voltage waveforms that can be used for the purpose of the present invention.
Figure 6B:
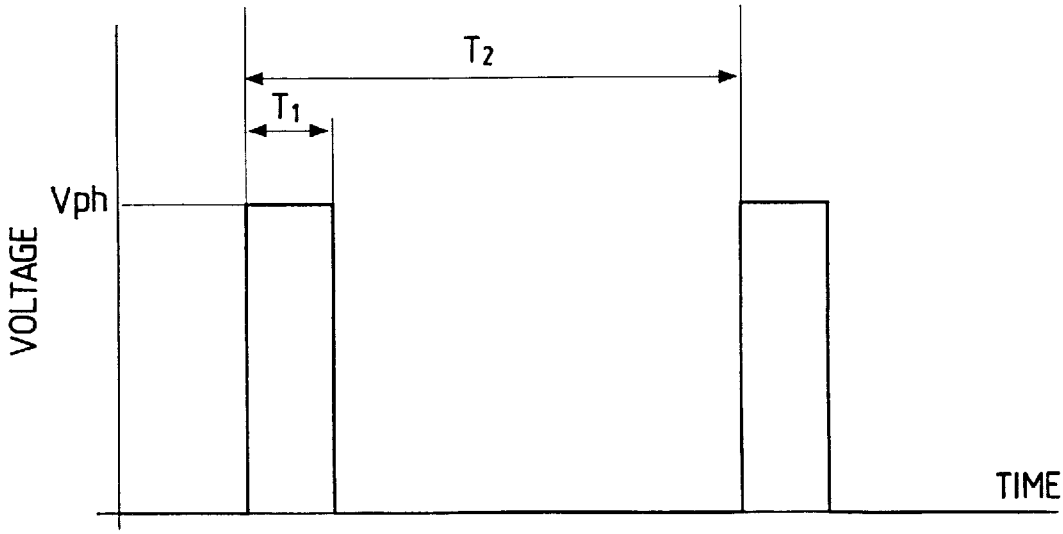

With a third method, a bipolar pulse voltage as illustrated in FIG. 6A is used as an activation pulse voltage. With this method, a carbon film is deposited on both sides of the gap of the electron-emitting region. (See FIG. 24B.) Then, without any etching operation, the carbon films in the gap will make highly crystalline graphite films. This phenomenon of a carbon film growing not simply from the anode side but from the two opposite sides of the gap may be attributable to the strong electric field generated by the voltage because such a phenomenon is not observable with either of the above two methods. Note that the substrate may be heated during the etching operation and the height and the width of the positive side may or may not be equal to those of the negative side of the pulse voltage and appropriate values may be selected for them depending on the application of the device.

The third method may be used with the first or second method.

5) An electron-emitting device that has been treated in an energization forming process and an activation process is then preferably subjected to a stabilization process. This is a process for removing any organic substances remaining in the vacuum chamber. The vacuuming and exhausting equipment to be used for this process preferably does not involve the use of oil so that it may not produce any evaporated oil that can adversely affect the performance of the treated device during the process. Thus, the use of a sorption pump and an ion pump may be a preferable choice.

If an oil diffusion pump and a rotary pump are used for the activation process and the organic gas produced by the oil is also utilized, the partial pressure of the organic gas has to be minimized by any means. The partial pressure of the organic gas in the vacuum chamber is preferably lower than $1\times10^{-6}$Pa and more preferably lower than $1\times10^{-8}$Pa if no carbon or carbon compound is additionally deposited. The vacuum chamber is preferably evacuated after heating the entire chamber so that organic molecules adsorbed by the inner walls of the vacuum chamber and the electron-emitting device(s) in the chamber may also be easily eliminated. While the vacuum chamber is preferably heated to 80 to 250° C. for more than 5 hours in most cases, other heating conditions may alternatively be selected depending on the size and the profile of the vacuum chamber and the configuration of the electron-emitting device(s) in the chamber as well as other considerations. The pressure in the vacuum chamber needs to be made as low as possible and it is preferably lower than 1 to $4\times10^{-5}$Pa and more preferably lower than $1\times10^{-6}$Pa.

After the stabilization process, the atmosphere for driving the electron-emitting device or the electron source is preferably same as the one when the stabilization process is completed, although a lower pressure may alternatively be used without damaging the stability of operation of the electron-emitting device or the electron source if the organic substances in the chamber are sufficiently removed.

By using such an atmosphere, the formation of any additional deposit of carbon or a carbon compound can be effectively suppressed to consequently stabilize the device current If and the emission current Ie.

The performance of a electron-emitting device prepared by way of the above processes, to which the present invention is applicable, will be described by referring to FIGS. 7 and 8.

Figure 7:
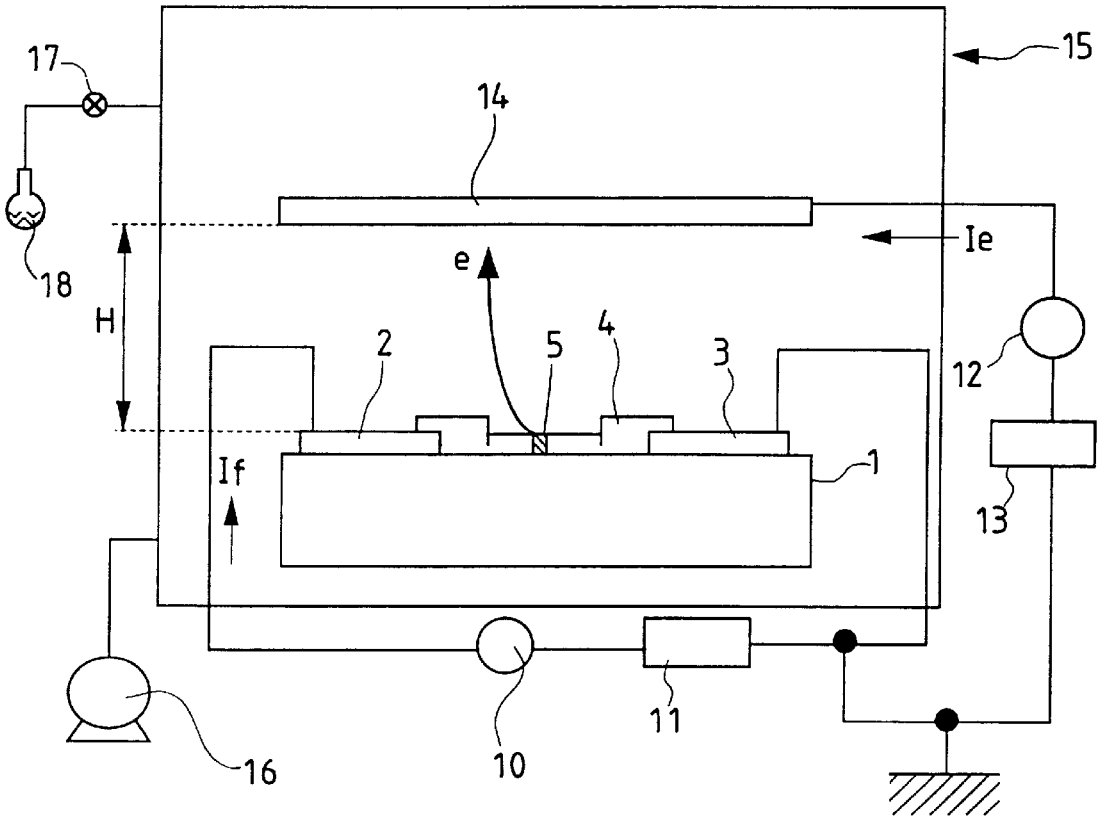
FIG. 7 is a block diagram of a gauging system for determining the electron emitting performance of a surface conduction electron-emitting device.

FIG. 7 is a schematic block diagram of an arrangement comprising a vacuum chamber that can be used for the above processes. It can also be used as a gauging system for determining the performance of an electron-emitting device of the type under consideration. Referring to FIG. 7, the gauging system includes a vacuum chamber 15 and a vacuum pump 16. An electron-emitting device is placed in the vacuum chamber 15. The device comprises a substrate 1, a pair of device electrodes 2 and 3, a thin film 4 and an electron-emitting region 5 having a gap. Otherwise, the gauging system has a power source 11 for applying a device voltage Vf to the device, an ammeter 10 for metering the device current If running through the thin film 4 between the device electrodes 2 and 3, an anode 14 for capturing the emission current Ie produced by electrons emitted from the electron-emitting region of the device, a high voltage source 13 for applying a voltage to the anode 14 of the gauging system and another ammeter 12 for metering the emission current Ie produced by electrons emitted from the electron-emitting region 5 of the device. For determining the performance of the electron-emitting device, a voltage between 1 and 10 kV may be applied to the anode, which is spaced apart from the electron-emitting device by distance H which is between 2 and 8 mm.

Instruments including a vacuum gauge and other pieces of equipment necessary for the gauging system are arranged in the vacuum chamber 15 so that the performance of the electron-emitting device or the electron source in the chamber may be properly tested. The vacuum pump 16 is provided with an ordinary high vacuum system comprising a turbo pump and a rotary pump or an oil-free high vacuum system comprising an oil-free pump such as a magnetic levitation turbo pump and a dry pump and an ultra-high vacuum system comprising an ion pump. The vacuum chamber containing an electron source therein can be heated to 250° C. by means of a heater (not shown). Thus, all the processes from the energization forming process on can be carried out with this arrangement.

Figure 8:
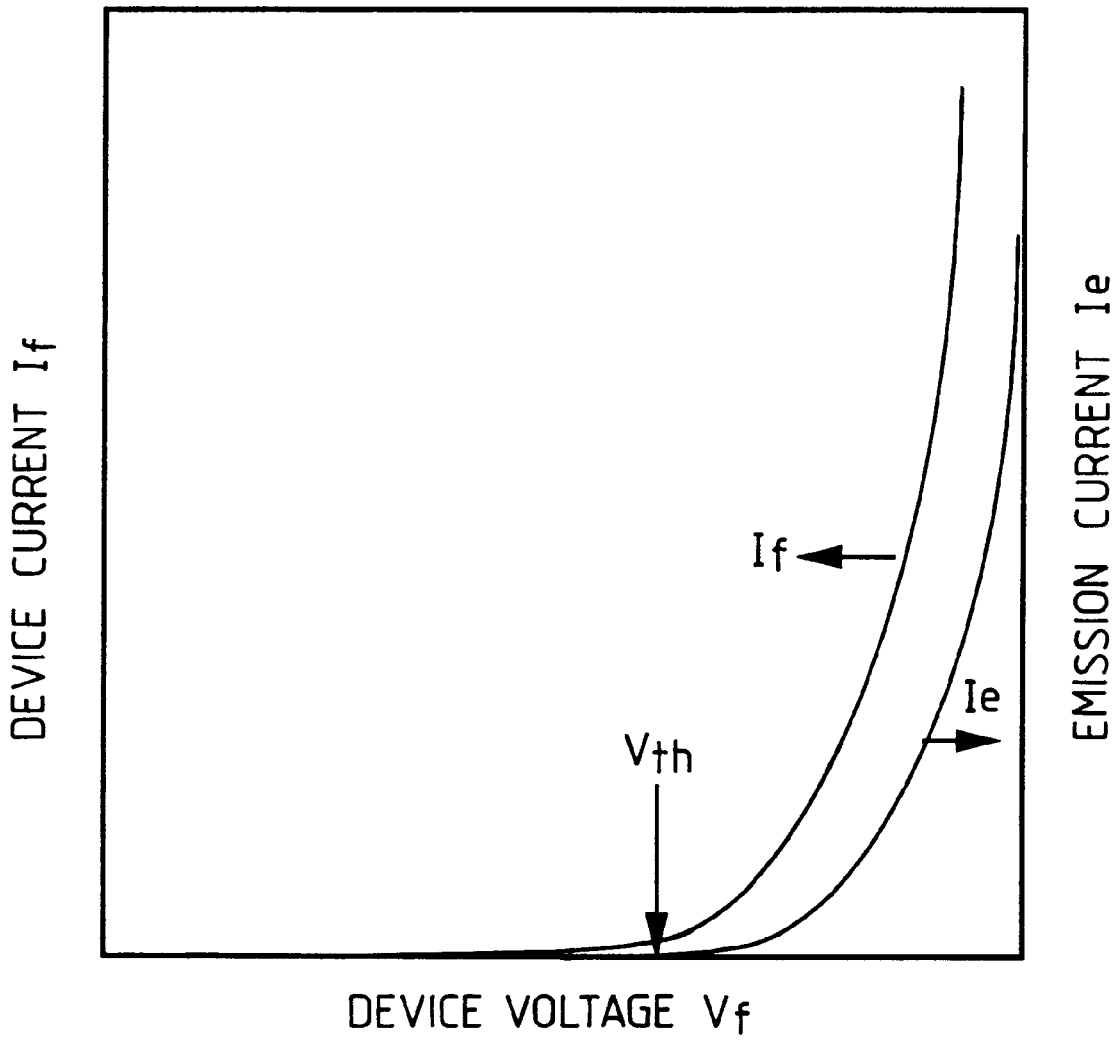
FIG. 8 is a graph showing the relationship between the device voltage and the device current as well as the relationship between the device voltage and the emission current of a surface conduction electron-emitting device or an electron source.

FIG. 8 shows a graph schematically illustrating the relationship between the device voltage Vf and the emission current Ie and the device current If typically observed by the gauging system of FIG. 7. Note that different units are arbitrarily selected for Ie and If in FIG. 8 in view of the fact that Ie has a magnitude by far smaller than that of If. Note that both the vertical and transversal axes of the graph represent a linear scale.

As seen in FIG. 8, an electron-emitting device according to the invention has three remarkable features in terms of emission current Ie, which will be described below.

(i) Firstly, an electron-emitting device according to the invention shows a sudden and sharp increase in the emission current Ie when the voltage applied thereto exceeds a certain level (which is referred to as a threshold voltage hereinafter and indicated by Vth in FIG. 8), whereas the emission current Ie is practically undetectable when the applied voltage is found lower than the threshold value Vth. Differently stated, an electron-emitting device according to the invention is a non-linear device having a clear threshold voltage Vth to the emission current Ie.

(ii) Secondly, since the emission current Ie is highly dependent on the device voltage Vf, the former can be effectively controlled by way of the latter.

(iii) Thirdly, the emitted electric charge captured by the anode 35 is a function of the duration of time of application of the device voltage Vf. In other words, the amount of electric charge captured by the anode 14 can be effectively controlled by way of the time during which the device voltage Vf is applied.

Because of the above remarkable features, it will be understood that the electron-emitting behavior of an electron source comprising a plurality of electron-emitting devices according to the invention and hence that of an image-forming apparatus incorporating such an electron source can easily be controlled in response to the input signal. Thus, such an electron source and an image-forming apparatus may find a variety of applications.

On the other hand, the device current If either monotonically increases relative to the device voltage Vf (as shown by a solid line in FIG. 8, a characteristic referred to as "MI characteristic" hereinafter) or changes to show a curve (not shown) specific to a voltage-controlled-negative-resistance characteristic (a characteristic referred to as "VCNR characteristic" hereinafter). These characteristics of the device current are dependent on a number of factors including the manufacturing method, the conditions where it is gauged and the environment for operating the device.

Now, some examples of the usage of electron-emitting devices, to which the present invention is applicable, will be described. An electron source and hence an image-forming apparatus can be realized by arranging a plurality of electron-emitting devices according to the invention on a substrate.

Electron-emitting devices may be arranged on a substrate in a number of different modes.

For instance, a number of electron-emitting devices may be arranged in parallel rows along a direction (hereinafter referred to row-direction), each device being connected by wirings at opposite ends thereof, and driven to operate by control electrodes (hereinafter referred to as grids) arranged in a space above the electron-emitting devices along a direction perpendicular to the row-direction (hereinafter referred to as column-direction) to realize a ladder-like arrangement. Alternatively, a plurality of electron-emitting devices may be arranged in rows along an X-direction and columns along an Y-direction to form a matrix, the X- and Y-directions being perpendicular to each other, and the electron-emitting devices on a same row are connected to a common X-directional wiring by way of one of the electrodes of each device while the electron-emitting devices on a same column are connected to a common Y-directional wiring by way of the other electrode of each device. The latter arrangement is referred to as a simple matrix arrangement. Now, the simple matrix arrangement will be described in detail.

In view of the above described three basic characteristic features (i) through (iii) of a surface conduction electron-emitting device, to which the invention is applicable, it can be controlled for electron emission by controlling the wave height and the wave width of the pulse voltage applied to the opposite electrodes of the device above the threshold voltage level. On the other hand, the device does not practically emit any electron below the threshold voltage level. Therefore, regardless of the number of electron-emitting devices arranged in an apparatus, desired surface conduction electron-emitting devices can be selected and controlled for electron emission in response to an input signal by applying a pulse voltage to each of the selected devices.

Figure 9:
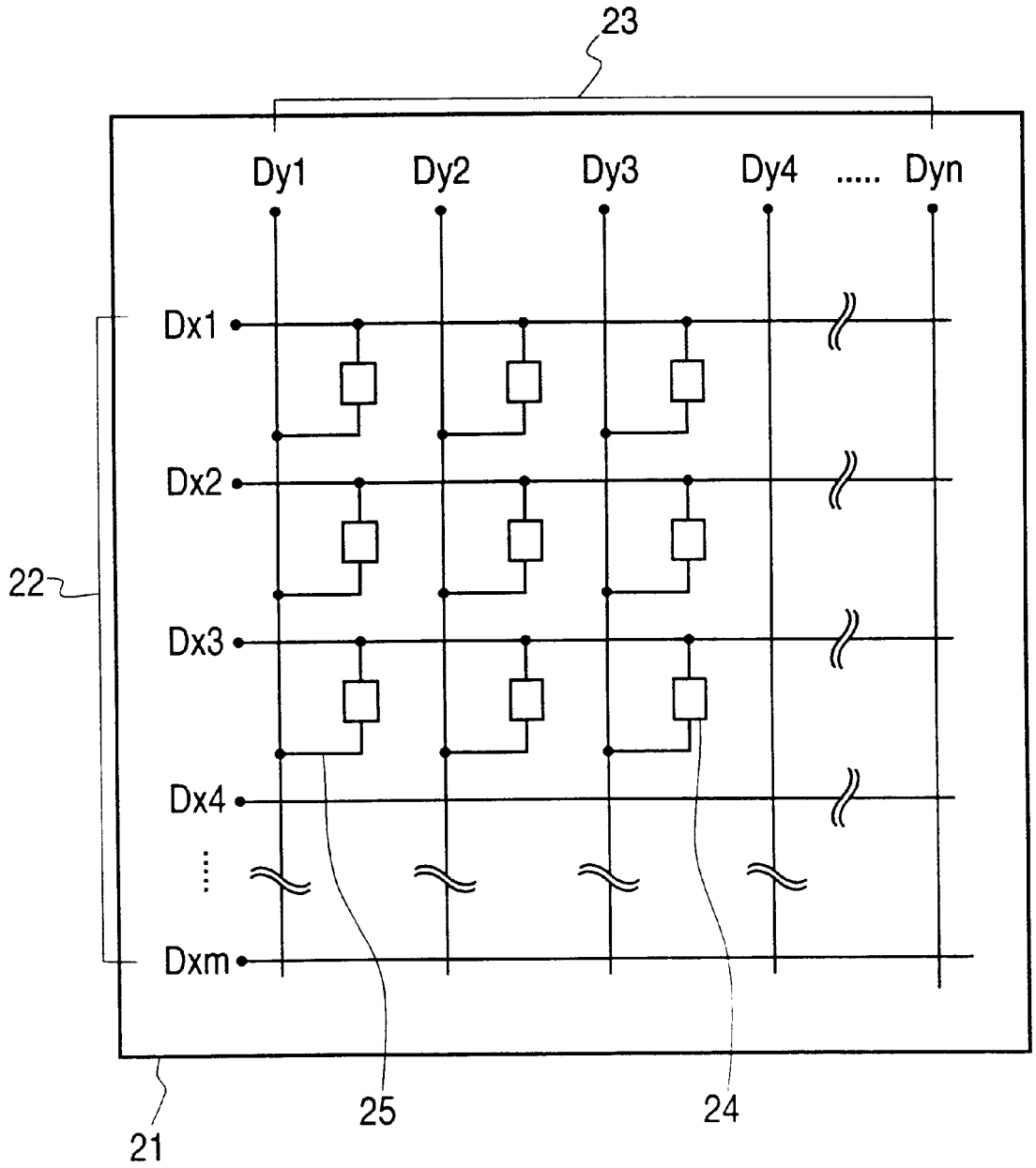
FIG. 9 is a schematic partial plan view of a matrix wiring type electron source.

FIG. 9 is a schematic plan view of the substrate of an electron source realized by arranging a plurality of electron-emitting devices, to which the present invention is applicable, in order to exploit the above characteristic features. In FIG. 9, the electron source comprises a substrate 21, X-directional wirings 22, Y-directional wirings 23, surface conduction electron-emitting devices 24 and connecting wires 25. The surface conduction electron-emitting devices may be either of the flat type or of the step type described earlier.

There are provided a total of m X-directional wirings 22, which are donated by Dx1, Dx2, . . . , Dxm and made of an electroconductive metal produced by vacuum deposition, printing or sputtering. These wirings are so designed in terms of material, thickness and width that, if necessary, a substantially equal voltage may be applied to the surface conduction electron-emitting devices. A total of n Y-directional wirings are arranged and donated by Dy1, Dy2, . . . , Dyn, which are similar to the X-directional wirings in terms of material, thickness and width. An interlayer insulation layer (not shown) is disposed between the m X-directional wirings and the n Y-directional wirings to electrically isolate them from each other. (Both m and n are integers.)

The interlayer insulation layer (not shown) is typically made of $SiO_2$ and formed on the entire surface or part of the surface of the insulating substrate 21 to show a desired contour by means of vacuum deposition, printing or sputtering. The thickness, material and manufacturing method of the interlayer insulation layer are so selected as to make it withstand the potential difference between any of the X-directional wirings 22 and any of the Y-directional wirings 23 observable at the crossing thereof. Each of the X-directional wirings 22 and the Y-directional wirings 23 is drawn out to form an external terminal.

The oppositely arranged electrodes (not shown) of each of the surface conduction electron-emitting devices 24 are connected to related one of the m X-directional wirings 22 and related one of the n Y-directional wirings 23 by respective connecting wires 25 which are made of an electroconductive metal.

The electroconductive metal material of the device electrodes and that of the connecting wires 25 extending from the m X-directional wirings 22 and the n Y-directional wirings 23 may be same or contain a common element as an ingredient. Alternatively, they may be different from each other. These materials may be appropriately selected typically from the candidate materials listed above for the device electrodes. If the device electrodes and the connecting wires are made of a same material, they may be collectively called device electrodes without discriminating the connecting wires.

The X-directional wirings 22 are electrically connected to a scan signal application means (not shown) for applying a scan signal to a selected row of surface conduction electron-emitting devices 24. On the other hand, the Y-directional wirings 23 are electrically connected to a modulation signal generation means (not shown) for applying a modulation signal to a selected column of surface conduction electron-emitting devices 24 and modulating the selected column according to an input signal. Note that the drive signal to be applied to each surface conduction electron-emitting device is expressed as the voltage difference of the scan signal and the modulation signal applied to the device.

With the above arrangement, each of the devices can be selected and driven to operate independently by means of a simple matrix wiring arrangement.

Figure 10:
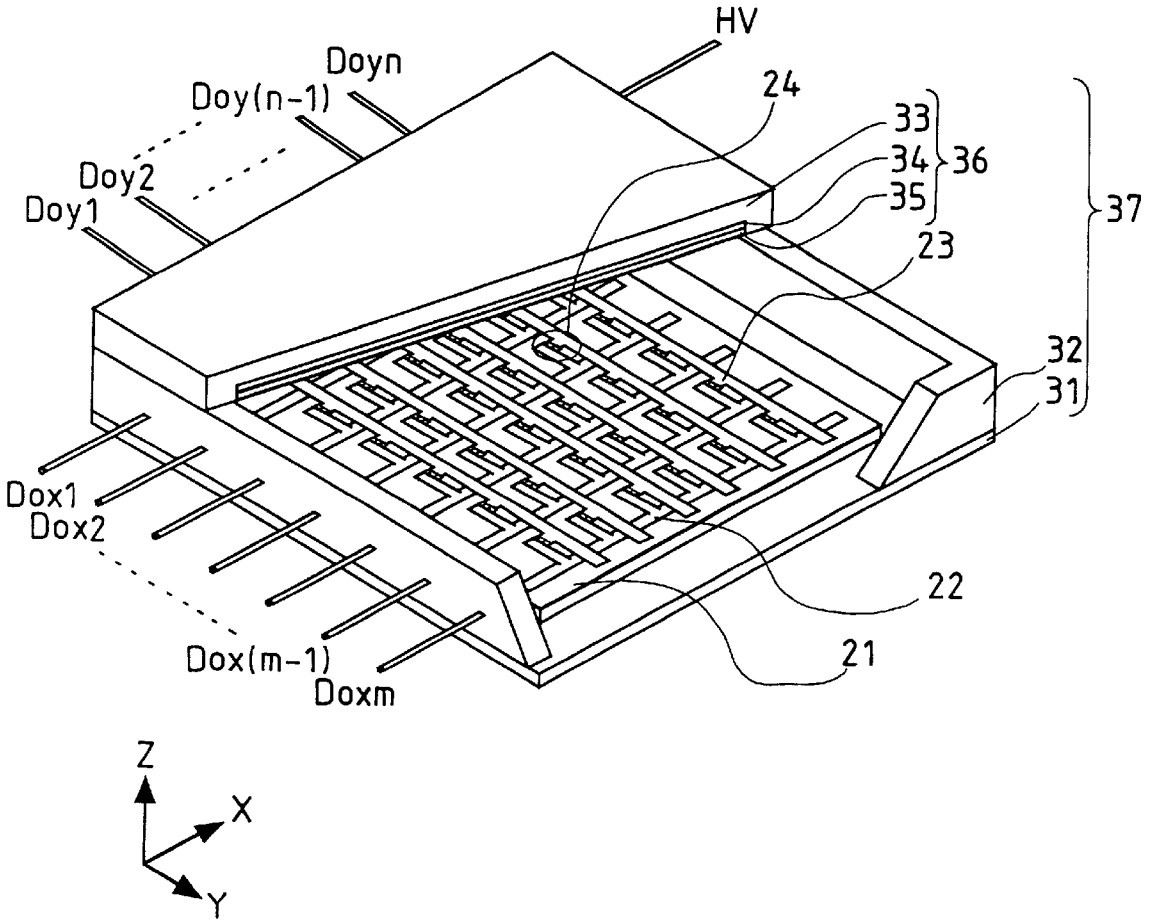
FIG. 10 is a partially cut away schematic perspective view of an image forming apparatus according to the invention and comprising a matrix wiring type electron.
Figure 11A:
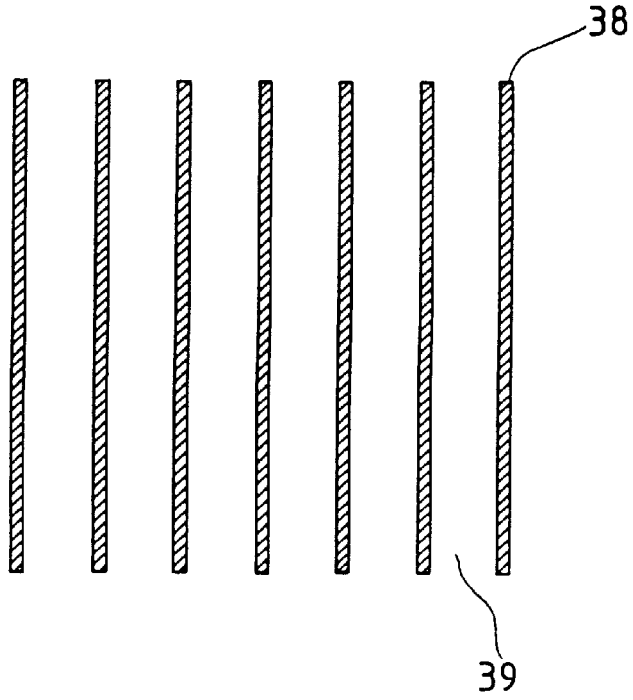
FIGS. 11A and 11B are schematic views, illustrating two possible configurations of fluorescent film of the face plate of an image forming apparatus according to the invention.
Figure 11B:
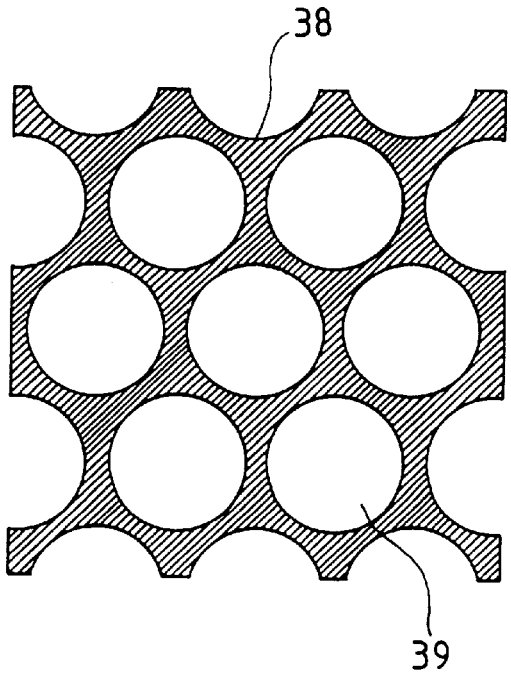
Figure 12:
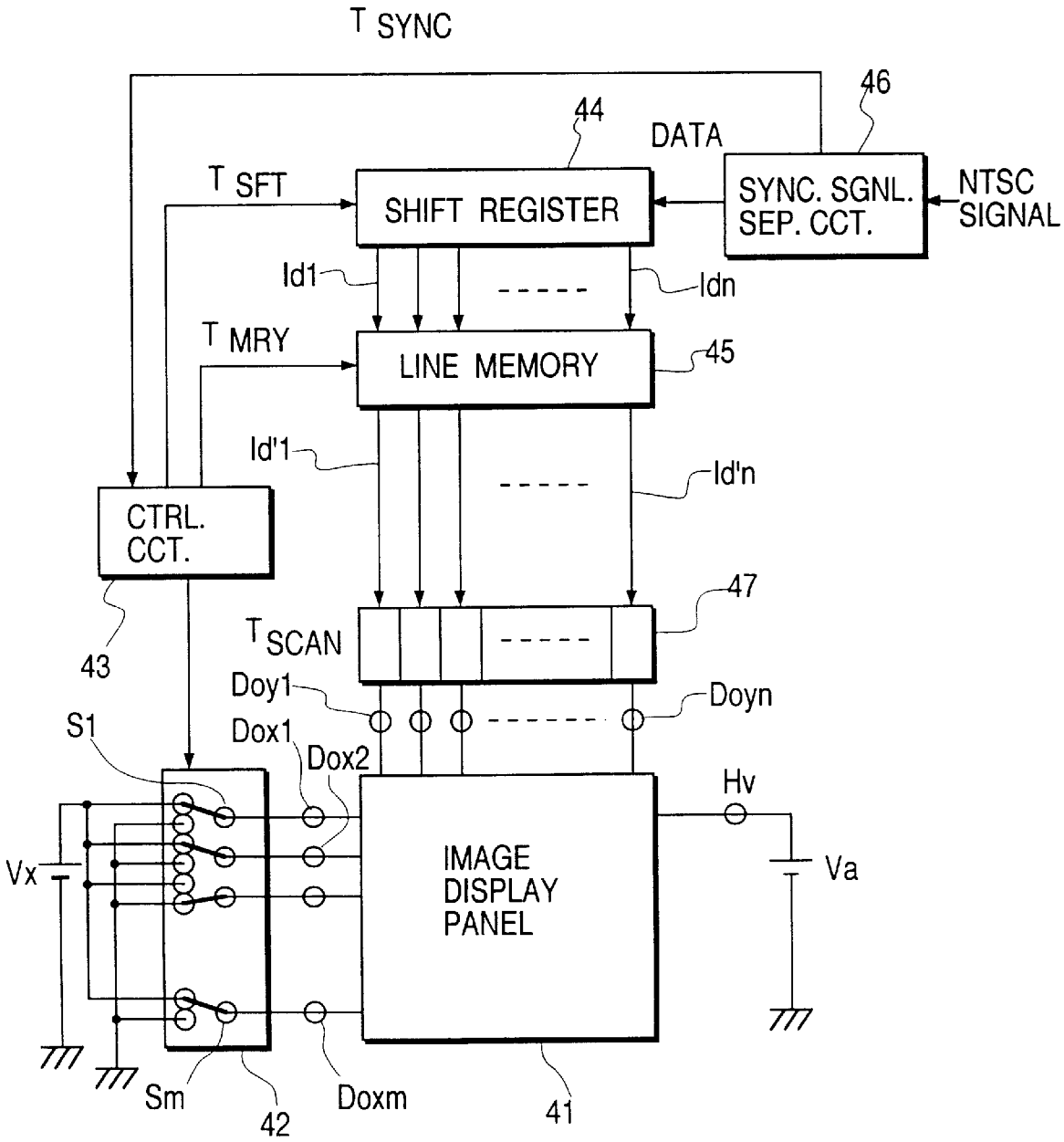
FIG. 12 is a block diagram of a drive circuit of an image forming apparatus, to which the present invention is applicable.

Now, an image-forming apparatus comprising an electron source having a simple matrix arrangement as described above will be described by referring to FIGS. 10, 11A, 11B and 12. FIG. 10 is a partially cut away schematic perspective view of the image-forming apparatus and FIGS. 11A and 11B are schematic views, illustrating two possible configurations of a fluorescent film that can be used for the image-forming apparatus of FIG. 10, whereas FIG. 12 is a block diagram of a drive circuit for the image-forming apparatus of FIG. 10 that operates for NTSC television signals.

Referring firstly to FIG. 10 illustrating the basic configuration of the display panel of the image-forming apparatus, it comprises an electron source substrate 21 of the above described type carrying thereon a plurality of electron-emitting devices, a rear plate 31 rigidly holding the electron source substrate 21, a face plate 36 prepared by laying a fluorescent film 34 and a metal back 35 on the inner surface of a glass substrate 33 and a support frame 32, to which the rear plate 31 and the face plate 36 are bonded by means of frit glass. Reference numeral 37 denote an envelope, which is baked to 400 to 500° C. for more than 10 minutes in the atmosphere or in nitrogen and hermetically and airtightly sealed.

In FIG. 10, reference numeral 24 denotes an electron-emitting device and reference numerals 22 and 23 respectively denotes the X-directional wiring and the Y-directional wiring connected to the respective device electrodes of each electron-emitting device.

While the envelope 37 is formed of the face plate 36, the support frame 32 and the rear plate 31 in the above described embodiment, the rear plate 31 may be omitted if the substrate 21 is strong enough by itself because the rear plate 31 is provided mainly for reinforcing the substrate 21. If such is the case, an independent rear plate 31 may not be required and the substrate 21 may be directly bonded to the support frame 32 so that the envelope 37 is constituted of a face plate 36, a support frame 32 and a substrate 21. The overall strength of the envelope 37 may be increased by arranging a number of support members called spacers (not shown) between the face plate 36 and the rear plate 31.

FIGS. 11A and 11B schematically illustrate two possible arrangements of fluorescent film. While the fluorescent film 34 comprises only a single fluorescent body if the display panel is used for showing black and white pictures, it needs to comprise for displaying color pictures black conductive members 38 and fluorescent bodies 39, of which the former are referred to as black stripes or members of a black matrix depending on the arrangement of the fluorescent bodies. Black stripes or members of a black matrix are arranged for a color display panel so that the fluorescent bodies 39 of three different primary colors are made less discriminable and the adverse effect of reducing the contrast of displayed images of external light is weakened by blackening the surrounding areas. While graphite is normally used as a principal ingredient of the black stripes, other conductive material having low light transmissivity and reflectivity may alternatively be used.

A precipitation or printing technique is suitably be used for applying a fluorescent material on the glass substrate regardless of black and white or color display. An ordinary metal back 35 is arranged on the inner surface of the fluorescent film 34. The metal back 35 is provided in order to enhance the luminance of the display panel by causing the rays of light emitted from the fluorescent bodies and directed to the inside of the envelope to turn back toward the face plate 36, to use it as an electrode for applying an accelerating voltage to electron beams and to protect the fluorescent bodies against damages that may be caused when negative ions generated inside the envelope collide with them. It is prepared by smoothing the inner surface of the fluorescent film (in an operation normally called "filming") and forming an Al film thereon by vacuum deposition after forming the fluorescent film.

A transparent electrode (not shown) may be formed on the face plate 36 facing the outer surface of the fluorescent film 34 in order to raise the conductivity of the fluorescent film 34.

Care should be taken to accurately align each set of color fluorescent bodies and an electron-emitting device, if a color display is involved, before the above listed components of the envelope are bonded together.

An image-forming apparatus as illustrated in FIG. 10 may be manufactured in a below described manner.

The envelope 37 is evacuated by means of an appropriate vacuum pump such as an ion pump or a sorption pump that does not involve the use of oil, while it is being heated as in the case of the stabilization process, until the atmosphere in the inside is reduced to a degree of vacuum of $10^{-5}$Pa containing organic substances to a sufficiently low level and then it is hermetically and airtightly sealed. A getter process may be conducted in order to maintain the achieved degree of vacuum in the inside of the envelope 37 after it is sealed. In a getter process, a getter arranged at a predetermined position in the envelope 37 is heated by means of a resistance heater or a high frequency heater to form a film by vapor deposition immediately before or after the envelope 37 is sealed. A getter typically contains Ba as a principal ingredient and can maintain a degree of vacuum between $1\times10^{-4}$ and $1\times10^{-5}$ by the adsorption effect of the vapor deposition film. The processes of manufacturing surface conduction electron-emitting devices of the image-forming apparatus after the forming process may appropriately be designed to meet the specific requirements of the intended application.

Figure 13:
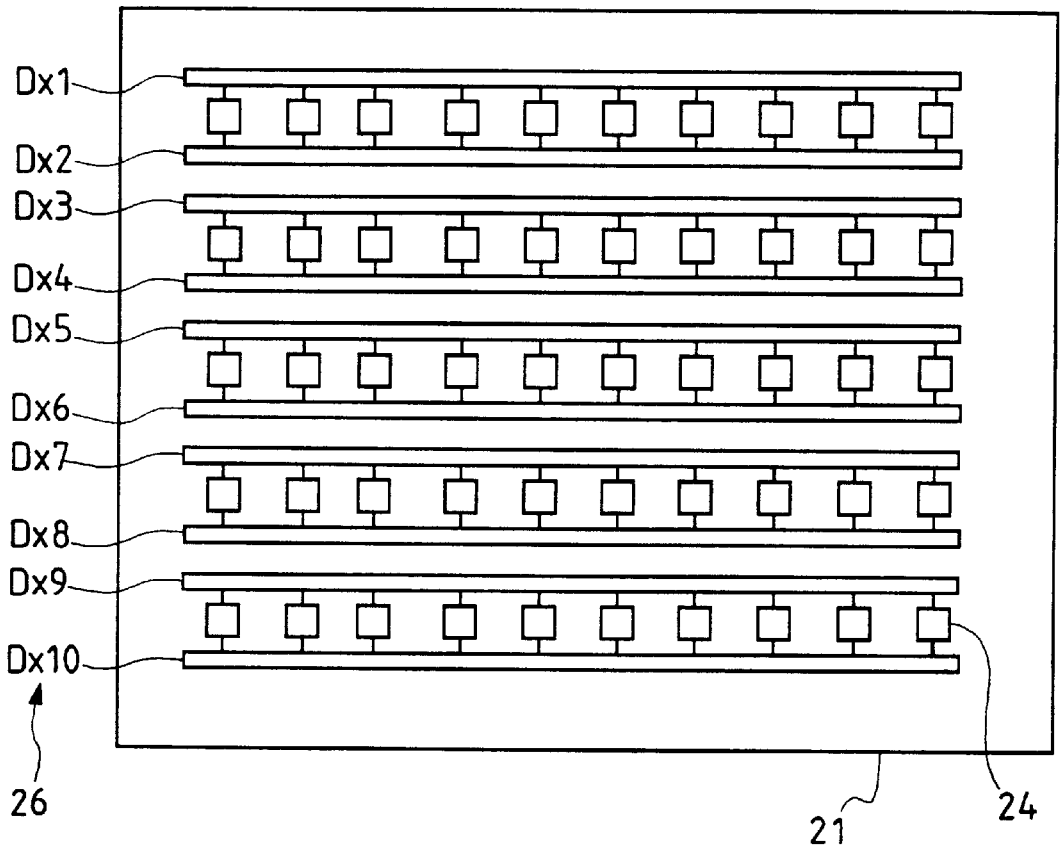
FIG. 13 is a schematic plan view of a ladder wiring type electron source.

Now, a drive circuit for driving a display panel comprising an electron source with a simple matrix arrangement for displaying television images according to NTSC television signals will be described by referring to FIG. 12. In FIG. 13, reference numeral 41 denotes a display panel. Otherwise, the circuit comprises a scan circuit 42, a control circuit 43, a shift register 44, a line memory 45, a synchronizing signal separation circuit 46 and a modulation signal generator 47. Vx and Va in FIG. 12 denote DC voltage sources.

The display panel 41 is connected to external circuits via terminals Dox1 through Doxm, Doy1 through Doym and high voltage terminal Hv, of which terminals Dox1 through Doxm are designed to receive scan signals for sequentially driving on a one-by-one basis the rows (of N devices) of an electron source in the apparatus comprising a number of surface conduction type electron-emitting devices arranged in the form of a matrix having M rows and N columns.

On the other hand, terminals Doy1 through Doyn are designed to receive a modulation signal for controlling the output electron beam of each of the surface-conduction type electron-emitting devices of a row selected by a scan signal. High voltage terminal Hv is fed by the DC voltage source Va with a DC voltage of a level typically around 10 kV, which is sufficiently high to energize the fluorescent bodies of the selected surface-conduction type electron-emitting devices.

The scan circuit 42 operates in a manner as follows. The circuit comprises M switching devices (of which only devices S1 and Sm are specifically indicated in FIG. 13), each of which takes either the output voltage of the DC voltage source Vx or 0[V] (the ground potential level) and comes to be connected with one of the terminals dox1 through Doxm of the display panel 41. Each of the switching devices S1 through Sm operates in accordance with control signal Tscan fed from the control circuit 43 and can be prepared by combining transistors such as FETs.

The DC voltage source Vx of this circuit is designed to output a constant voltage such that any drive voltage applied to devices that are not being scanned due to the performance of the surface conduction electron-emitting devices (or the threshold voltage for electron emission) is reduced to less than threshold voltage.

The control circuit 43 coordinates the operations of related components so that images may be appropriately displayed in accordance with externally fed video signals. It generates control signals Tscan, Tsft and Tmry in response to synchronizing signal Tsync fed from the synchronizing signal separation circuit 46, which will be described below.

The synchronizing signal separation circuit 46 separates the synchronizing signal component and the luminance signal component from an externally fed NTSC television signal and can be easily realized using a popularly known frequency separation (filter) circuit. Although a synchronizing signal extracted from a television signal by the synchronizing signal separation circuit 46 is constituted, as well known, of a vertical synchronizing signal and a horizontal synchronizing signal, it is simply designated as Tsync signal here for convenience sake, disregarding its component signals. On the other hand, a luminance signal drawn from a television signal, which is fed to the shift register 44, is designed as DATA signal.

The shift register 44 carries out for each line a serial/parallel conversion on DATA signals that are serially fed on a time series basis in accordance with control signal Tsft fed from the control circuit 43. (In other words, a control signal Tsft operates as a shift clock for the shift register 44.) A set of data for a line that have undergone a serial/parallel conversion (and correspond to a set of drive data for N electron-emitting devices) are sent out of the shift register 44 as N parallel signals Id1 through Idn.

The line memory 45 is a memory for storing a set of data for a line, which are signals Id1 through Idn, for a required period of time according to control signal Tmry coming from the control circuit 43. The stored data are sent out as I'd1 through I'dn and fed to modulation signal generator 47.

Said modulation signal generator 47 is in fact a signal source that appropriately drives and modulates the operation of each of the surface-conduction type electron-emitting devices and output signals of this device are fed to the surface-conduction type electron-emitting devices in the display panel 41 via terminals Doy1 through Doyn.

As described above, an electron-emitting device, to which the present invention is applicable, is characterized by the following features in terms of emission current Ie. Firstly, there exists a clear threshold voltage Vth and the device emit electrons only a voltage exceeding Vth is applied thereto. Secondly, the level of emission current Ie changes as a function of the change in the applied voltage above the threshold level Vth, although the value of Vth and the relationship between the applied voltage and the emission current may vary depending on the materials, the configuration and the manufacturing method of the electron-emitting device. More specifically, when a pulse-shaped voltage is applied to an electron-emitting device according to the invention, practically no emission current is generated so far as the applied voltage remains under the threshold level, whereas an electron beam is emitted once the applied voltage rises above the threshold level. It should be noted here that the intensity of an output electron beam can be controlled by changing the peak level Vm of the pulse-shaped voltage. Additionally, the total amount of electric charge of an electron beam can be controlled by varying the pulse width Pw.

Thus, either modulation method or pulse width modulation may be used for modulating an electron-emitting device in response to an input signal. With voltage modulation, a voltage modulation type circuit is used for the modulation signal generator 47 so that the peak level of the pulse shaped voltage is modulated according to input data, while the pulse width is held constant.

With pulse width modulation, on the other hand, a pulse width modulation type circuit is used for the modulation signal generator 47 so that the pulse width of the applied voltage may be modulated according to input data, while the peak level of the applied voltage is held constant.

Although it is not particularly mentioned above, the shift register 44 and the line memory 45 may be either of digital or of analog signal type so long as serial/parallel conversions and storage of video signals are conducted at a given rate.

If digital signal type devices are used, output signal DATA of the synchronizing signal separation circuit 46 needs to be digitized. However, such conversion can be easily carried out by arranging an A/D converter at the output of the synchronizing signal separation circuit 46. It may be needless to say that different circuits may be used for the modulation signal generator 47 depending on if output signals of the line memory 45 are digital signals or analog signals. If digital signals are used, a D/A converter circuit of a known type may be used for the modulation signal generator 47 and an amplifier circuit may additionally be used, if necessary. As for pulse width modulation, the modulation signal generator 47 can be realized by using a circuit that combines a high speed oscillator, a counter for counting the number of waves generated by said oscillator and a comparator for comparing the output of the counter and that of the memory. If necessary, an amplifier may be added to amplify the voltage of the output signal of the comparator having a modulated pulse width to the level of the drive voltage of a surface-conduction type electron-emitting device according to the invention.

If, on the other hand, analog signals are used with voltage modulation, an amplifier circuit comprising a known operational amplifier may suitably be used for the modulation signal generator 47 and a level shift circuit may be added thereto if necessary. As for pulse width modulation, a known voltage control type oscillation circuit (VCO) may be used with, if necessary, an additional amplifier to be used for voltage amplification up to the drive voltage of surface conduction type electron-emitting device.

With an image forming apparatus having a configuration as described above, to which the present invention is applicable, the electron-emitting devices emit electrons as a voltage is applied thereto by way of the external terminals Dox1 through Doxm and Doy1 through Doyn. Then, the generated electron beams are accelerated by applying a high voltage to the metal back 35 or a transparent electrode (not shown) by way of the high voltage terminal Hv. The accelerated electrons eventually collide with the fluorescent film 34, which by turn glows to produce images.

The above described configuration of image forming apparatus is only an example to which the present invention is applicable and may be subjected to various modifications. The TV signal system to be used with such an apparatus is not limited to a particular one and any system such as NTSC, PAL or SECAM may feasibly be used with it. It is particularly suited for TV signals involving a larger number of scanning lines (typically of a high definition TV system such as the MUSE system) because it can be used for a large display panel comprising a large number of pixels.

Now, an electron source comprising a plurality of surface conduction electron-emitting devices arranged in a ladder-like manner on a substrate and an image-forming apparatus comprising such an electron source will be described by referring to FIGS. 13 and 14.

Firstly referring to FIG. 13, reference numeral 21 denotes an electron source substrate and reference numeral 24 denotes a surface conduction electron-emitting device arranged on the substrate, whereas reference numeral 26 denotes common wirings Dx1 through Dx10 for connecting the surface conduction electron-emitting devices. The electron-emitting devices 22 are arranged in rows along the X-direction (to be referred to as device rows hereinafter) to form an electron source comprising a plurality of device rows, each row having a plurality of devices. The surface conduction electron-emitting devices of each device row are electrically connected in parallel with each other by a pair of common wirings so that they can be driven independently by applying an appropriate drive voltage to the pair of common wirings. More specifically, a voltage exceeding the electron emission threshold level is applied to the device rows to be driven to emit electrons, whereas a voltage below the electron emission threshold level is applied to the remaining device rows. Alternatively, any two external terminals arranged between two adjacent device rows can share a single common wiring. Thus, of the common wirings Dx2 through Dx9, Dx2 and Dx3 can share a single common wiring instead of two wirings.

Figure 14:
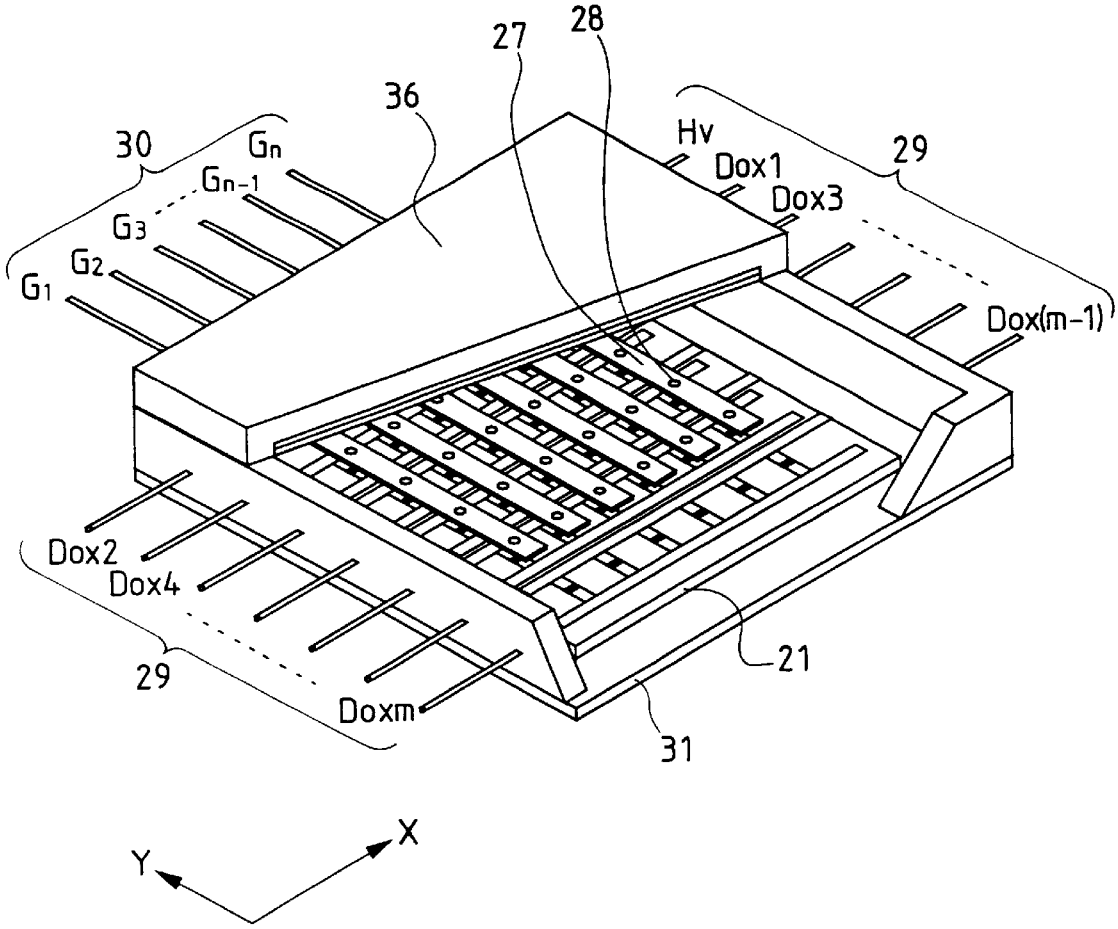
FIG. 14 is a partially cut away schematic perspective view of an image forming apparatus according to the invention and comprising a ladder wiring type electron source.

FIG. 14 is a schematic perspective view of the display panel of an image-forming apparatus incorporating an electron source having a ladder-like arrangement of electron-emitting devices. In FIG. 14, the display panel comprises grid electrodes 27, each provided with a number of bores 28 for allowing electrons to pass therethrough and a set of external terminals dox1, Dox2, . . . , Doxm, which are denoted by reference numeral 29, along with another set of external terminals G1, G2, . . . , Gn, which are denoted by reference numeral 30 and connected to the respective grid electrodes 27 and an electron source substrate 21. Note that, in FIG. 14, the components that are similar to those of FIGS. 10 and 13 are respectively denoted by the same reference symbols. The image forming apparatus differs from the image forming apparatus with a simple matrix arrangement of FIG. 10 mainly in that the apparatus of FIG. 14 has grid electrodes 27 arranged between the electron source substrate 21 and the face plate 36.

In FIG. 14, the stripe-shaped grid electrodes 27 are arranged perpendicularly relative to the ladder-like device rows for modulating electron beams emitted from the surface conduction electron-emitting devices, each provided with through bores 28 in correspondence to respective electron-emitting devices for allowing electron beams to pass therethrough. Note that, however, while stripe-shaped grid electrodes are shown in FIG. 14, the profile and the locations of the electrodes are not limited thereto. For example, they may alternatively be provided with mesh-like openings and arranged around or close to the surface conduction electron-emitting devices.

The external terminals 29 and the external terminals for the grids 30 are electrically connected to a control circuit (not shown).

An image-forming apparatus having a configuration as described above can be operated for electron beam irradiation by simultaneously applying modulation signals to the rows of grid electrodes for a single line of an image in synchronism with the operation of driving (scanning) the electron-emitting devices on a row by row basis so that the image can be displayed on a line by line basis.

Thus, a display apparatus according to the invention and having a configuration as described above can have a wide variety of industrial and commercial applications because it can operate as a display apparatus for television broadcasting, as a terminal apparatus for video teleconferencing, as an editing apparatus for still and movie pictures, as a terminal apparatus for a computer system, as an optical printer comprising a photosensitive drum and in many other ways.

Now, the present invention will be described by way of examples.

EXAMPLE 1, COMPARATIVE EXAMPLE 1

Each of the surface conduction electron-emitting devices prepared in these examples was similar to the one schematically illustrated in FIGS. 1A and 1B. As a matter of fact, a pair of surface conduction electron-emitting devices were prepared on a substrate for these examples. The devices were manufactured by a method basically same as the one described earlier by referring to FIGS. 4A through 4D.

The examples and the method of manufacturing the specimens of the examples will be described by referring to FIGS. 1A and 1B and 4A through 4D.

Step-a:

After thoroughly cleansing a soda lime glass plate, a silicon oxide film was formed thereon to a thickness of 0.5 $\mu$m by sputtering to produce a substrate 1, on which a desired pattern of photoresist (RD-2000N-41: available from Hitachi Chemical Co., Ltd.) having openings corresponding to the contours of a pair of electrodes was formed for each device. Then, a Ti film and an Ni film were sequentially formed to respective thicknesses of 5 nm and 100 nm by vacuum deposition. Thereafter, the photoresist was dissolved by an organic solvent and the unnecessary portions of the Ni/Ti film were lifted off to produce a pair of device electrodes 2 and 3 for each device. The device electrodes was separated by distance L of 3 $\mu$m and had a width of W=300 $\mu$m. (FIG. 4A)

Step-b:

A mask of Cr film was formed in order to prepare an electroconductive thin film 4 for each device. More specifically a Cr film was formed on the substrate carrying device electrodes to a thickness of 300 nm by vacuum deposition and then an opening corresponding to the pattern of an electroconductive thin film was formed for each device by photolithography.

Thereafter, a solution of Pd-amine complex (ccp4230: available from Okuno Pharmaceutical Co., Ltd.) was applied to the Cr film by means of a spinner and baked at 300° C. for 12 minutes in the atmosphere to produce a fine particle film containing PdO as a principal ingredient. The film had a film thickness of 7 nm.

Step-c:

The Cr film was removed by wet-etching and the Pd fine particle film was lifted off to obtain an electroconductive thin film 4 having a desired profile for each device. The electroconductive thin films showed an electric resistance of $Rs=2\times10^4\Omega/\square$. (FIG. 4B)

Step-d:

Then, the devices were moved into the vacuum chamber of a gauging system as illustrated in FIG. 7 and the inside of the vacuum chamber 15 was evacuated by means of a vacuum pump unit 16 to a pressure of $2.7\times10^{-3}$Pa. Then, the sample devices were subjected to a forming process by applying a voltage between the device electrodes 2, 3 of each device. The applied voltage was a triangular pulse voltage whose peak value gradually increased with time as shown in FIG. 5B. The pulse width of T1=1 msec and the pulse interval of T2=10 msec were used. During the forming process, an extra pulse voltage of 0.1V (not shown) was inserted into intervals of the forming pulse voltage in order to determine the resistance of the electron emitting region, constantly monitoring the resistance, and the electric forming process was terminated when the resistance exceeded 1 M$\Omega$. The peak values of the pulse voltage (forming voltage) were 5.0V and 5.1V respectively for the two devices when the forming process was terminated.

Step-e:

Subsequently, the pair of devices were subjected to an activation process, maintaining the inside pressure of the vacuum chamber 15 to about $2.0\times10^{-3}$Pa. A rectangular pulse voltage with a height of Vph=18V as shown in FIG. 6B was applied to each device, monitoring both If and Ie, until Ie got to a saturated state in 30 minutes, when the forming process was terminated.

Thereafter, the electron-emitting performance of the devices was determined. The vacuum pump unit was switched to an ion pump comprised in it in order to eliminate any organic substances that might be remaining in the vacuum chamber 15. The system further comprised an anode for capturing electrons emitted from the electron source, to which a voltage that was higher than the voltage applied to the electron source by +1 kV was applied from a high voltage source. The devices and the anode were separated by a distance of H=4 mm. The internal pressure of the vacuum chamber 15 during this measuring cycle was $4.2\times10^{-4}$Pa ($4.2\times10^{-5}$Pz in terms of the partial pressure of the organic substances).

When measured, If=2.0 mA and Ie=4.0 $\mu$A or an electron-emitting efficiency of $\eta$=Ie/If=0.2% was observed for both devices.

Step-f:

One of the devices is referred to device A, whereas the other is called device B. The pulse voltage of Step-e was continuously applied only to the device A in Step-f.

Hydrogen gas was introduced into the vacuum chamber to produce a pressure equal to $1.3\times10^{-2}$Pa in the inside. Then, the device current If of the device A gradually decreased until If=1 mA was observed, when the device current was substantially stabilized.

Then, the supply of hydrogen gas was stopped and the internal pressure was reduced to $1.3\times10^{-4}$Pa. Under this condition, a rectangular pulse voltage of 18V was applied to the both devices A and B to determine the respective rates of electron emission. Thereafter, the devices were continuously driven to operate for a long period to see how the performances of the devices changed. Then, the devices were driven further to operate on a one by one basis, raising the anode voltage stepwise with a step of 0.5 kV to determine the upper limit for the device to be driven without producing any phenomenon of electric discharge, or the upper limit of the withstand voltage for electric discharge. The table below shows the obtained results for these examples. As seen from the table, the device A showed an improved electron-emitting efficiency as compared with the device B and maintained its excellent performance for a prolonged period of time with an improved withstand voltage limit value for electric discharge.

| device | If (mA) | Ie ($\mu$A) | $\eta$ (%) | If(mA) in operation | Ie($\mu$A) in operation | $\eta$ (%) in operation | electron discharge withstand voltage (kV) |
|---|---|---|---|---|---|---|---|
| A | 1.0 | 4.0 | 0.40 | 0.7 | 2.5 | 0.36 | 5.5 |
| B | 2.0 | 4.0 | 0.20 | 1.4 | 2.5 | 0.18 | 2.5 |

EXAMPLE 2

Each of the surface conduction electron-emitting devices prepared in these examples was similar to the one schematically illustrated in FIGS. 1A and 1B. A total of four identical surface conduction electron-emitting devices were prepared on a substrate for these examples.

Step-a:

A desired pattern of photoresist (RD-2000N-41: available from Hitachi Chemical Co., Ltd.) having openings corresponding to the contours of a pair of electrodes was formed for each device on a thoroughly cleansed quartz glass substrate 1, on which a Ti film and an Ni film were sequentially formed to respective thicknesses of 5 nm and 100 nm by vacuum deposition. Thereafter, the photoresist was dissolved by an organic solvent and the unnecessary portions of the Ni/Ti film were lifted off to produce a pair of device electrodes 2 and 3 for each device. The device electrodes was separated by a distance equal to L=10 $\mu$m and had a width equal to W=300 $\mu$m.

Step-b:

An electroconductive thin film 3 for preparing an electron-emitting region 2 was formed to show a desired profile by patterning. More specifically, a Cr film was formed of the substrate carrying device electrodes to a thickness of 50 nm by vacuum deposition and then an opening corresponding to the pattern of a pair of device electrodes 2, 3 and a gap between the electrodes was formed for each device.

Thereafter, a solution of Pd-amine complex (ccp4230: available from Okuno Pharmaceutical Co., Ltd.) was applied to the Cr film by means of a spinner and baked at 300° C. for 10 minutes in the atmosphere to produce an electroconductive thin film 4 containing PdO as a principal ingredient. The film had a film thickness of 12 nm. Step-c:

The Cr film was removed by wet-etching and the electroconductive thin film 4 was processed to show a desired pattern. The electroconductive thin films showed an electric resistance of Rs=$1.5\times10^4\Omega/\square$.

Step-d:

Then, the devices were moved into the vacuum chamber of a gauging system as illustrated in FIG. 7 and the inside of the vacuum chamber 15 was evacuated by means of a vacuum pump unit 16 (ion pump) to a pressure of $2.6\times10^{-6}$Pa. Thereafter, the sample devices were subjected to an energization forming process by applying a pulse voltage between the device electrodes 2, 3 of each device by means of a power source 11, which was designed to apply a device voltage Vf to each device. The pulse waveform of the applied voltage for the forming process is shown in FIG. 5B.

In this example, the pulse voltage had a pulse width of T1=1 msec. and a pulse interval of T2=10 msec. and the peak voltage (for the forming process) was raised stepwise with a step of 0.1V. During the forming process, an extra pulse voltage of 0.1V (not shown) was inserted into intervals of the forming pulse voltage in order to determine the resistance of the electron-emitting region, constantly monitoring the resistance, and the electric forming process was terminated when the resistance exceeded 1MΩ. The peak value of the pulse voltage (forming voltage) was 7.0V for all the devices when the forming process was terminated.

Step-e:

The variable leak valve 17 was opened to introduce acetone from the liquid reservoir 18 of the gauging system. The partial pressure of acetone in the vacuum chamber 15 was monitored by means of a quadrapole mass analyzer and the valve was regulated to make the partial pressure equal to $1.3\times10^{-1}$Pa.

Step-f:

A monopolar rectangular pulse voltage having a waveform as shown in FIG. 6B was applied to each device. The pulse wave height, the pulse width and the pulse interval were respectively Vph=18V, T1=1 msec. and T2=10 msec. The pulse voltage was applied continuously for 30 minutes before the voltage application was terminated. The device current was equal to If=1.5 mA at the end of the voltage application.

Step-g:

The supply of acetone was terminated and the vacuum chamber 15 was further evacuated, while heating the device to 80° C.

Step-h:

Then, hydrogen was introduced into the vacuum chamber 15 by operating the mass flow controller until the partial pressure of hydrogen got to $1.3\times10^{-2}$Pa.

Step-i:

A pulse voltage same as the one use in Step-f was applied for 5 minutes and then the voltage application was terminated. Thereafter, hydrogen was removed out of the chamber. The device current was equal to If=1.2 mA at the end of the voltage application.

Step-j:

The inside of the vacuum chamber was evacuated by means of an ion pump, while heating the vacuum chamber. At the same time, the devices were heated to 250° C. by means of a heater arranged in the holder. Then, the internal pressure of the vacuum chamber was reduced to $1.3\times10^{-6}$Pa and a rectangular pulse voltage of 18V having a pulse width of 100 $\mu$sec. was applied to the devices to ensure that the devices operated stably for electron emission.

COMPARATIVE EXAMPLE 2

A specimen similar to that of Example 2 was subjected to Steps-a through g of Example 2. Then, omitting Steps-h and i, the sample was subjected to a stabilization process of Step-j.

EXAMPLE 3

A specimen similar to that of Example 2 was subjected to Steps-a through e of Example 2. Then, a bipolar pulse voltage having a waveform as shown in FIG. 6A was applied to the sample in Steps-f and i. The pulse voltages in these steps were identical and had a wave height, a pulse width and a pulse interval equal to Vph=V'ph=18V, T1=T'1=1 msec. and T2=T'2=10 msec. respectively. The device current at the end of Step-f was equal to If=1.8 mA and at the end of Step-i was equal to If=1.4 mA.

Thereafter, the specimen was subjected to a stabilization process similar to Step-i of Example 2.

EXAMPLE 4

A specimen similar to that of Example 2 was subjected to Steps-a through d of Example 2. Then, the specimen was taken out of the vacuum chamber and subsequently subjected to the following step.

Step-d':

The Pd amine complex solution used in Step-b of Example 2 was diluted with butylacetate to one-third of the original concentration. The diluted solution was applied to the specimen by means of a spinner and the specimen was baked at 300° C. in the atmosphere for 10 minutes. Thereafter, it was left in a gas flow of a mixture of $N_2$(98%)–$H_2$(2%) for 60 minutes.

When the devices were observed through a scanning electron microscope (SEM), it was found that Pd fine particles with a diameter between 3 and 7 nm were dispersed within the gap of the electron-emitting region of each device.

Thereafter, the specimen was subjected to processes similar to those of Step-e and on of Example 2. Since the device current If showed an early increase in Step-f, the voltage application was suspended 15 minutes after the start. The device current was equal to If=1.8 mA and 1.3 mA after the end of Step-f and that of Step-i respectively.

Then, the specimen was subjected to a stabilization process as in Step-j of Example 2.

EXAMPLE 5

A specimen similar to that of Example 2 was subjected to Steps-a through d of Example 2. Then, the following steps were carried out.

Step-e":

Methane was introduced into the vacuum chamber 15. The main valve (not shown) of the vacuum pump unit 16 was tightened to reduce the conductance and regulate the methane flow rate until the internal pressure of the vacuum chamber got to 130 Pa.

Step-f":

A monopolar rectangular pulse voltage (FIG. 6B) was applied continuously to the specimen for 60 minutes. The pulse voltage had a wave height of 18V, a pulse width of 1 msec. and a pulse interval of 10 msec. The device current was equal to If=1.3 mA at the end of the pulse application.

Step-g":

The supply of methane was stopped and the inside of the vacuum chamber 15 was evacuated. Thereafter, hydrogen was introduced into the chamber until the internal pressure got to $1.3\times10^{-2}$Pa.

Step-h":

A pulse voltage same as that of Step-f" was applied to the specimen for five minutes. The device current was equal to If=1.1 mA at the end of the pulse application. Thereafter, the specimen was subjected to a stabilization process as in Step-j in Example 2.

A device was picked up from each of Examples 2 through 5 and Comparative Example 2 and tested for the performance of electron emission by means of the arrangement of FIG. 7. During the test, the internal pressure of the vacuum chamber was maintained to lower than $2.7\times10^{-6}$Pa and the performance of each device was tested after turning off the heater for heating the device and the device was cooled to room temperature.

The voltage applied to the devices was a monopolar rectangular pulse voltage as shown in FIG. 6B and had a wave height, a pulse width and a pulse interval equal to Vph=18V, T1=100 μsec. and T2=10 msec. respectively. In the gauging system, the devices were separated from the anode by H=4 mm and the potential difference was held to 1 kV.

Each devices was tested to evaluate the performance of electron emission immediately after the start of the test and after 100 hours of continuous operation. The results are shown in the table below.

| | end of pulse voltage | imm. after start of application | | 100 after start of test | |
|---|---|---|---|---|---|
| | If(mA) | If(mA) | Ie(μA) | If(mA) | Ie(μA) |
| Example 2 | 1.2 | 1.1 | 1.2 | 0.9 | 0.8 |
| Example 3 | 1.4 | 1.3 | 1.2 | 1.1 | 1.0 |
| Example 4 | 1.3 | 1.2 | 1.1 | 1.0 | 0.8 |
| Example 5 | 1.1 | 1.0 | 1.5 | 0.8 | 1.2 |
| Comparative Example 2 | 1.5 | 1.2 | 0.6 | 0.6 | 0.2 |

Another device that had not been subjected to the above test of evaluating the performance of electron emission was picked up from each of Examples 2 through 5 and Comparative Example 2 and tested for the withstand voltage for electric discharge. A monopolar rectangular pulse voltage as shown in FIG. 6B was applied to each device, while increasing stepwise the potential difference between the anode and the device (anode voltage Va) from 1 kV with a step of 0.5 kV, and the device was driven to operate at each anode voltage for 10 minutes. When the device was not damaged by electric discharge with a given anode voltage Va, it was so judged that the device withstood the anode voltage. The maximum withstand voltages of the devices of Examples 2 through 5 and Comparative Example 2 are shown below.

| | Example 2 | Example 3 | Example 4 | Example 5 | Comparative Example 2 |
|---|---|---|---|---|---|
| maximum Va (kV) | 6.5 | 7.0 | 6.0 | 7.0 | 2.5 |

Still another device that had not been subjected to the above tests of evaluating the performance of electron emission and the withstand voltage was picked up from each of Examples 2 through 5 and Comparative Example 2, each device being separated by cutting the substrate and observed through a scanning electron microscope (SEM). A carbon film was observed only on the anode side end of the gap and no carbon film was found outside the gap in the electron-emitting region of the devices of Examples 2 and 4. A carbon film was found both on the anode side end and the cathode side end of the gap of the electron-emitting region of the device of Example 3, while practically no carbon film was observed outside the gap.

Contrary to them, a carbon film was found mainly in the inside and behind the gap on the anode side end and also on the cathode side to a small extent in the device of Comparative Example 2.

A groove was observed on the substrate of each of the devices of the above Examples and Comparative Example between the carbon film and the cathode side electroconductive thin film or between the carbon films on the anode and cathode side ends.

Presumably, radicals generated in the activation process might have reacted with the substrate to produce the groove.

The devices of the above Examples and Comparative Examples including those of Example 1 and Comparative Example 1 were examined for the crystallinity of the carbon film by means of a Raman spectrometer. An Ar laser having a wavelength of 514.5 nm was used for the light source, which produced a light spot with a diameter of about 1 $\mu$m on the surface of the specimen.

Figure 2:
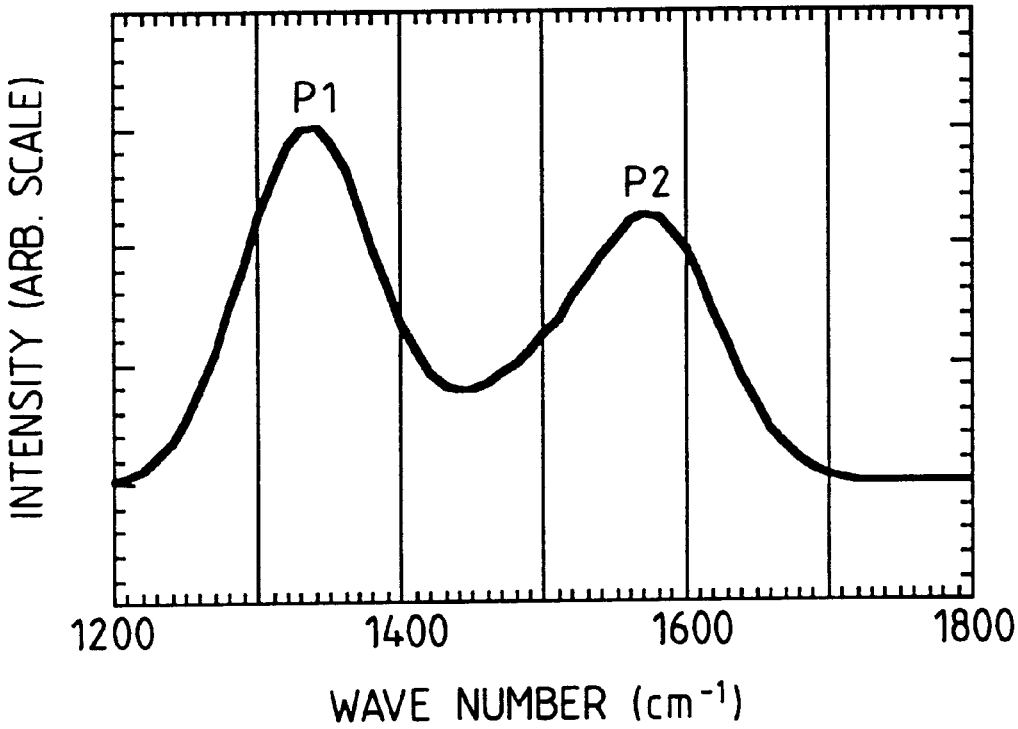
FIG. 2 is a graph showing the result of a Raman spectrometric analysis.

When the spot was placed on or around the electron-emitting region, a spectrum having peaks in the vicinity of 1,335 $cm^{-1}$ (P1) and 1,580 $cm^{-1}$ (P2) was obtained to prove the existence of a carbon film. FIG. 2 schematically illustrates the spectrum. The peaks could be separated by assuming the existence of a third peak in the vicinity of 1,490 $cm^{-1}$ for the devices of the above Examples and Comparative Examples.

Of the peaks, P2 is attributable to electronic transition in the atomic bond of graphite that characterizes the substance, whereas P1 is attributable to a disturbed periodicity in the graphite crystal. Thus, while only P2 would appear on a pure graphite single crystal, P1 becomes remarkable if graphite contains a large number of small crystals or it has defective lattice structures. As the crystallinity of graphite is reduced, P1 grows further in terms of both the height and the width. P1 may shifts its location, reflecting the crystal conditions in the inside.

It may be correct to assume that the existence of peaks other than P2 was attributable to the small crystal size of graphite in any of the devices of the above Examples and Comparative Examples. In the discussions below, the half width of P1 is used to indicate the crystallinity of graphite for Examples and Comparative Examples because the intensity of light was sufficiently strong at P1.

P1 showed different profiles inside the gap and behind the gap of the device of Comparative Example 2. When the laser spot was focused on the gap of the electron-emitting region, P1 showed a half width of approximately 150 $cm^{-1}$ but the half width decreased remarkably at a spot separated from the gap by more than 1 $\mu$m to as small as 300 $cm^{-1}$, indicating that the crystallinity of graphite is high in the gap and low behind the gap. No significant peak was observed outside the gap in any of the devices of Examples 2 through 5 and the half width of P1 indicated that a crystallinity higher than those of Comparative Examples had been achieved in it.

The diameter of graphite crystals estimated from the intensities of the three peaks was between 2 and 3 nm for the devices of Examples.

| | | | | | | Comparative Example 1 | | Comparative Example 2 | |
|---|---|---|---|---|---|---|---|---|---|
| | Example 1 | Example 2 | Example 3 | Example 4 | Example 5 | near gap | behind gap | near gap | behind gap |
| half width ($cm^{-1}$) | 120 | 100 | 90 | 105 | 90 | 160 | 300 | 160 | 300 |

Figure 15:
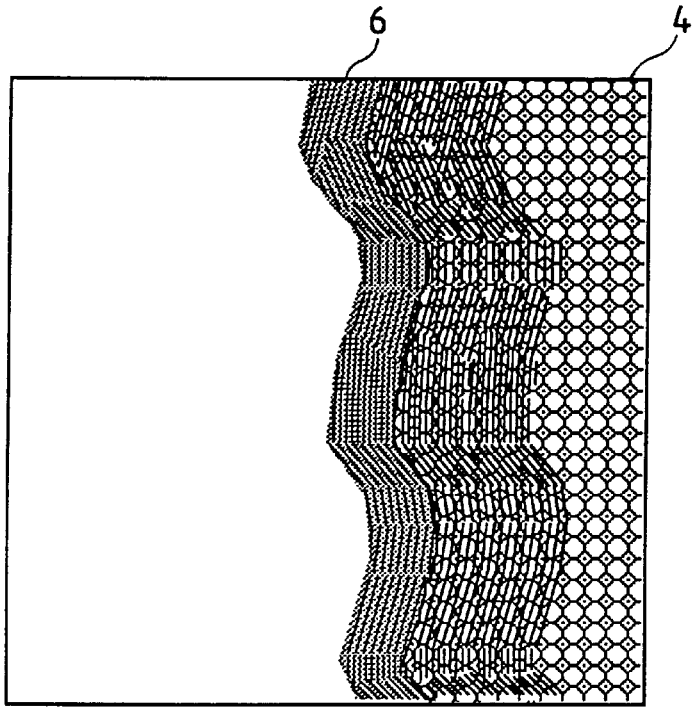
FIG. 15 is a schematic illustration of a lattice image observed through a TEM.
Figure 16:
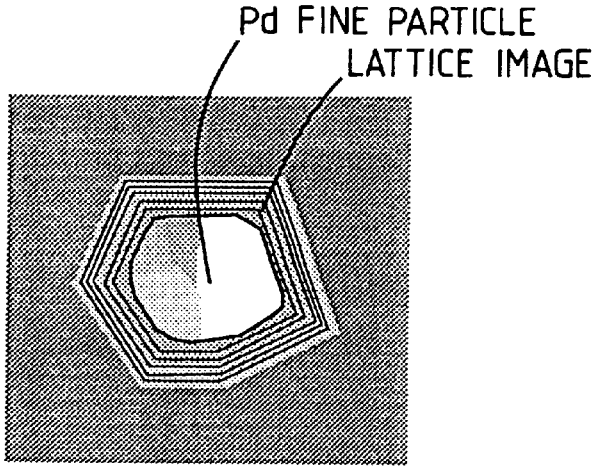
FIG. 16 is a schematic illustration of capsule like graphite observed through a TEM.
Figure 17:
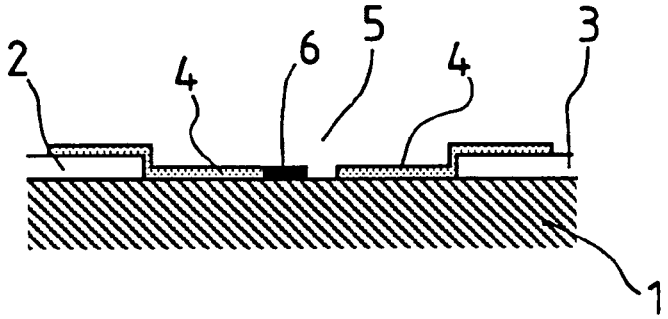
FIG. 17 is a schematic side view of a surface conduction electron-emitting device obtained in Example 1.
Figure 18:
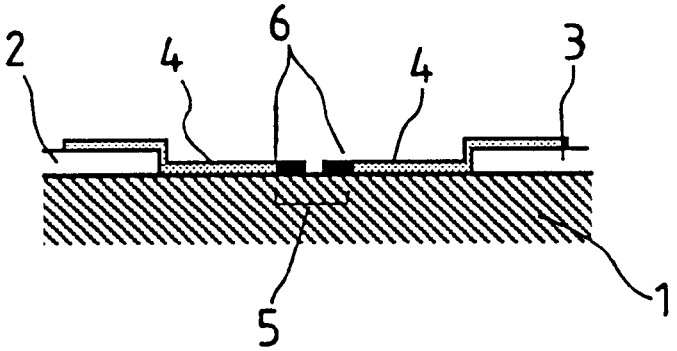
FIG. 18 is a schematic side view of a surface conduction electron-emitting device obtained in Example 2.
Figure 19:
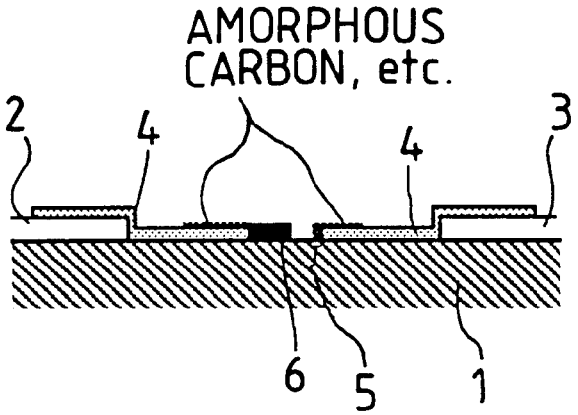
FIG. 19 is a schematic side view of a surface conduction electron-emitting device obtained in Comparative Example 1.

The carbon film of each of the above devices was examined by means of a transmission electron microscope (TEM). In any of Examples 1 through 5, a lattice image was observed in the carbon film inside the gap of the electron-emitting region to prove that the carbon film was mainly constituted of graphite crystals having a particle size of 2–3 nm or above. This observation agreed with the outcome of the Raman spectrometric analysis. FIG. 15 schematically illustrates the lattice image observed at one of the edges of the gap of the electron-emitting region of a device. Here, it shows a half of the gap. A capsule-like crystal lattice that surrounded a Pd fine particle was observed inside the gap of the electron-emitting region of the device of Example 4. FIG. 16 schematically illustrates the observed lattice image. Some real capsules that contained no Pd fine particle were also found. While a lattice image was also observed to prove the existence of graphite in the carbon film inside the gap of the device of Comparative Example 2, such lattice was existent only in part of the carbon film located behind the gap and the carbon film was mainly constituted of amorphous carbon.

As described above, the phenomenon of electric discharge may appear when ions and electrons collide with the carbon film at locations behind the gap to give rise to gas of hydrogen atoms and carbon atoms, which may trigger electric discharge. In any of Examples, the carbon film was removed from such locations and only a highly crystalline carbon film was left inside the gap of the electron-emitting region so that practically no gas was produced to make the device capable of withstand a relatively high anode voltage.

EXAMPLE 6

In this example a plurality of surface conduction electron-emitting devices having a configuration same as that of FIGS. 1A and 1B were formed on a single substrate and put in a sealed glass panel to produce a single line type electron source. The specimen was prepared in a manner as described below.

(1) After thoroughly cleansing and drying a soda lime substrate 1, a mask pattern of photoresist (RD-2000N-41: available from Hitachi Chemical Co., Ltd.) having openings corresponding to the contours of a pair of electrodes was formed for each device. Then, a Ti film and an Pt film were sequentially formed to respective thicknesses of 5 nm and 30 nm by vacuum deposition.

(2) The photoresist was dissolved by an organic solvent and the unnecessary portions of the Pt/Ti film were lifted off to produce a pair of device electrodes 2 and 3 for each device. The device electrodes was separated by a distance of L=10 $\mu$m. (FIG. 4A)

(3) A Cr film was formed on the substrate carrying device electrodes to a thickness of 30 nm by sputtering and then made to a Cr mask having an opening corresponding to the pattern of an electroconductive thin film by photolithography.

(4) A solution of Pd-amine complex (ccp4230: available from Okuno Pharmaceutical Co., Ltd.) was applied to coat the Cr film by means of a spinner and baked at 300° C. in the atmosphere to produce a fine particle film containing PdO as a principal ingredient.

The Cr film was wet-etched and the PdO fine particle film was removed from any unnecessary areas to produce an electroconductive thin film 4. (FIG. 4B)

(5) The prepared electron source was combined with a back plate, a face plate provided with fluorescent bodies and a metal back, a support frame and an exhaust pipe, which were then bonded together with frit glass to produce an electron source panel.

Figure 20:
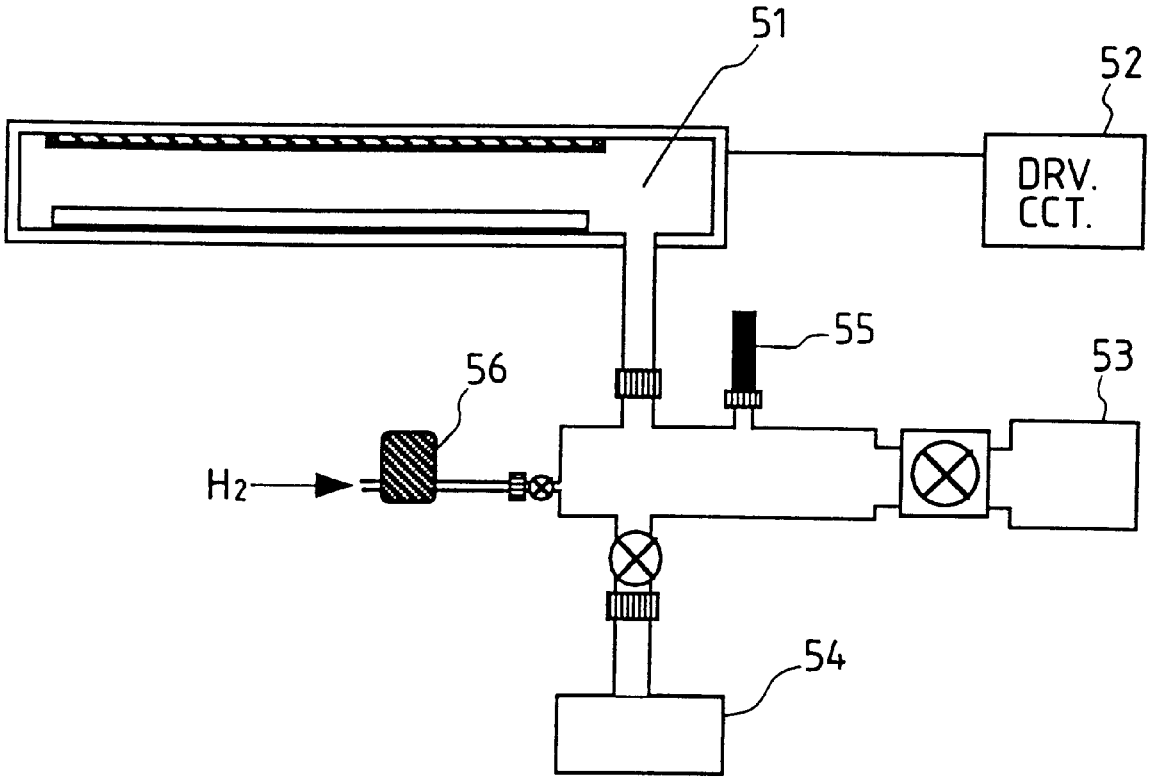
FIG. 20 is a schematic block diagram of an apparatus for manufacturing an image-forming apparatus according to the invention.

(6) As shown in FIG. 20, the electron source panel 51 was connected to a drive circuit 52, a first vacuum pump unit 53 for ultra high vacuum comprising an ion pump as a principal component, a second vacuum pump unit 54 for high vacuum comprising a turbo pump and a rotary pump, a quadrapole mass analyzer 55 for monitoring the atmosphere inside a vacuum chamber and a mass flow controller 56 for regulating the flow rate of hydrogen gas as shown in FIG. 20.

(7) The inside of the electron source panel 51 is evacuated by means of the second vacuum pump unit 54 to a degree of vacuum of about $10^{-4}$Pa.

(8) An energization forming process is conducted on each of the devices in the electron source panel to produce an electron-emitting region 5 having a gap therein by means of the drive circuit 52. (FIG. 4C) The pulse voltage used for the forming process was a triangular pulse voltage with T1=1 msec. and T2=10 msec. having a wave height that gradually increased as shown in FIG. 5B.

(9) Hydrogen is introduced into the electron source panel by appropriately operating the mass flow controller 56 until the hydrogen partial pressure got to $1\times10^{-4}$Pa.

(10) A rectangular pulse voltage of 14V with a pulse width of 1 msec. and a pulse interval of 10 msec. was applied to each of the devices by means of the drive circuit 52. The potential difference between the device and the metal back that operated as an anode was 1 kV. Both Ie and If were monitored during the voltage application, which was terminated when Ie got to 5 $\mu$A for each device.

(11) The supply of hydrogen was terminated and the electron source panel 51 was evacuated by means of the first vacuum pump unit 53, while the electron source being heated by a heater (not shown).

(12) The atmosphere in the electron source panel was monitored by the quadrapole mass analyzer 55 and the exhaust pipe was heated and airtightly sealed when the inside became sufficiently free from any residual organic substances.

COMPARATIVE EXAMPLE 3

Step-(1) through (10) of Example 6 were followed for the specimen of this example but no hydrogen was introduced into the panel. Thereafter, Step-(12) was carried out.

EXAMPLE 7

Step-(1) through (5) of Example 6 were followed for the specimen of this example. Thereafter, (6) The specimen was connected to a drive circuit and a first vacuum pump unit in a manner as shown in FIG. 20 but no second vacuum pump unit was used. The system was so arranged that a vaporized organic solvent (acetone) could be introduced into the panel.

The inside of the electron source panel was evacuated by the vacuum pump unit 53 comprising a sorption pump and an ion pump until the internal pressure got to approximately $10^{-4}$Pa.

Acetone and hydrogen gas were introduced into the panel until they equally showed a partial pressure of $1\times10^{-3}$Pa. The partial pressures were controlled by appropriately operating a mass flow controller 56 and a valve, while monitoring the partial pressures by means of a quadrapole mass analyzer 55.

(7) A pulse voltage was applied to each of the devices as in the case of Example 6 and the voltage application was terminated when Ie got to 5 $\mu$A for each device.

(8) The supply of acetone and hydrogen was terminated and the inside of the electron source panel was evacuated, while heating the panel. Thereafter, the exhaust pipe was heated and airtightly sealed when the partial pressures of the hydrogen and acetone became sufficiently low as observed by the quadrapole mass analyzer.

COMPARATIVE EXAMPLE 4

A specimen was prepared as in the case of Example 7, although only acetone was used and hydrogen was not used.

The electron source panels of Examples 6 and 7 and Comparative Examples 3 and 4 were tested for the performance of electron emission. Ie and If of each device was observed by applying a rectangular pulse voltage of 14V. The potential difference between the device and the metal back was 1 kV. After 100 hours of continuous operation of electron emission, both Ie and If of each device were observed again.

Thereafter, the withstand voltage of each device was tested for electric discharge in a manner as described above by referring to Examples 1 through 5.

The results are as follows.

| electron | | | 100 after start of test | | withstand voltage for elect. emis. |
|---|---|---|---|---|---|
| source | If(mA) | Ie($\mu$A) | If(mA) | Ie($\mu$A) | (kV) |
| Example 6 | 2.4 | 2.4 | 2.0 | 1.5 | 5.0 |
| Comparative Example 3 | 2.4 | 2.1 | 1.8 | 0.8 | 2.0 |
| Example 7 | 2.3 | 2.3 | 1.9 | 1.4 | 5.5 |
| Comparative Example 4 | 2.3 | 2.0 | 1.7 | 0.8 | 2.5 |

Another sets of devices were prepared in a similar manner for Examples 6 and 7 and Comparative Examples 3 and 4 and tested by Raman spectrometric analysis.

| electron source | half width of $P_1$ ($cm^{-1}$) near | behind |
|---|---|---|
| Example 6 | 120 | 150 |
| Comparative Example 3 | 170 | 300 |
| Example 7 | 100 | 130 |
| Comparative Example 4 | 160 | 300 |

EXAMPLE 8

In this example, four electron-emitting devices, each having a configuration as shown in FIG. 1A and 1B, were prepared in parallel on a substrate.

Step-a:

A desired pattern of photoresist (RD-2000N-41: available from Hitachi Chemical Co., Ltd.) having openings corresponding to the contours of a pair of electrodes was formed for each device on a thoroughly cleansed quartz glass substrate 1, on which a Ti film and an Ni film were sequentially formed to respective thicknesses of 5 nm and 100 nm by vacuum deposition. Thereafter, the photoresist was dissolved by an organic solvent and the unnecessary portions of the Ni/Ti film were lifted off to produce a pair of device electrodes 2 and 3 for each device. The device electrodes was separated by a distance of L=3 $\mu$m and had a width of W=300 $\mu$m.

Step-b:

For each device, a Cr film was formed to a thickness of 50 nm on the substrate 1 carrying thereon a pair of electrodes 2, 3 by vacuum deposition and then a Cr mask having an opening corresponding to the contour of an electroconductive thin film was prepared out of the Cr film by photolithography. The opening had a width W' of 100 $\mu$m. Thereafter, a solution of Pd-amine complex (cccp4230: available from Okuno Pharmaceutical Co., Ltd.) was applied to the Cr film by means of a spinner and baked at 300° C. for 12 minutes in the atmosphere to produce an electroconductive thin film 4 containing PdO as a principal ingredient. The film had a film thickness of 12 nm.

Step-c:

The Cr film was removed by wet-etching and the electroconductive thin film 4 was processed to show a desired pattern. The electroconductive thin films showed an electric resistance of Rs=$1.4\times10^4\Omega/\square$.

Step-d:

Then, the devices were moved into the vacuum chamber of a gauging system as illustrated in FIG. 7 and the inside of the vacuum chamber 15 was evacuated by means of a vacuum pump unit 16 (ion pump) to a pressure of $2.6\times10^{-6}$Pa. Thereafter, the sample devices were subjected to an energization forming process by applying a pulse voltage between the device electrodes 2, 3 of each device by means of a power source 11, which was designed to apply a device voltage Vf to each device. The pulse waveform of the applied voltage for the forming process is shown in FIG. 5B.

The pulse voltage had a pulse width of T1=1 msec. and a pulse interval of T2=10 msec. and the peak voltage (for the forming process) was raised stepwise with a step of 0.1V.

During the forming process, an extra pulse voltage of 0.1V (not shown) was inserted into intervals of the forming pulse voltage in order to determine the resistance of the electron emitting region, constantly monitoring the resistance, and the electric forming process was terminated when the resistance exceeded 1 MΩ. The peak value of the pulse voltage (forming voltage) was 7.0V for all the devices when the forming process was terminated.

Step-e:

Partial pressures of $1.3\times10^{-1}$Pa and $1.3\times10^{-2}$Pa were achieved respectively for acetone and hydrogen by appropriately operating a variable leak valve 17 and a mass flow controller (not shown). The partial pressure of acetone was determined by a differential exhaust type quadrapole mass analyzer (not shown) and that of hydrogen was achieved by regarding it substantially equal to the total internal pressure of the vacuum chamber 15.

Step-f:

A monopolar rectangular pulse voltage as shown in FIG. 6B was applied to each device. The pulse wave height, the pulse width and the pulse interval were respectively Vph=18V, T1=1 msec. and T2=10 msec. This step was terminated after continuously applying the pulse voltage for 120 minutes. The device current was equal to If=1.7 mA at the end of the step.

EXAMPLE 9

Steps-a through d of Example 8 were also followed for this example and then, in Step-e, the partial pressure of acetone was made equal to 13 Pa and, in Step-f, the applied monopolar rectangular pulse voltage had a wave height of 20V. Otherwise the application of a pulse voltage was carried out in a manner similar to that of Example 8. Since the device current showed a rapid rise if compared with Example 1, the application of a pulse voltage was terminated after 90 minutes after the start of operation. The wave height of the pulse voltage was altered to 18V at the end of the pulse voltage application and the device current was equal to If=1.9 mA at the end of this step.

EXAMPLE 10

Steps-a through c of Example 8 were also followed for this example and then, in Step-f, a bipolar rectangular pulse voltage with a wave height, a pulse width and a pulse interval respectively equal to 18V, 1 msec. and 10 msec. was applied to each device. Otherwise the specimen was process in a manner exactly like that of Example 1. The device current was equal to If=2.1 mA at the end of the pulse voltage application.

Thereafter, a stabilization process of similar to that of Step-j of Example 2 was carried out.

EXAMPLE 11

Steps-a through d of Example 8 were also followed for this example and then the devices were taken out of the vacuum chamber and subjected to the following operations.

Step-d':

The Pd amine complex solution used in Step-b of Example 8 was diluted with butylacetate to one-third of the original concentration. The diluted solution was applied to the specimen by means of a spinner and the specimen was baked at 300° C. in the atmosphere for 10 minutes. Thereafter, it was left in a gas flow of a mixture of $N_2$(98%)–$H_2$(2%) for 60 minutes.

When the devices were observed through a scanning electron microscope (SEM), it was found that Pd fine particles with a diameter between 3 and 7 nm were dispersed within the gap of the electron-emitting region of each device.

Thereafter, the specimen was subjected to a processes similar to those of Step-e and on of Example 6. Since the device current If showed an early increase in Step-f, the voltage application was suspended 60 minutes after the start. The device current was equal to If=1.9 mA at the end of the pulse voltage application.

COMPARATIVE EXAMPLE 5

Steps-a through d of Example 8 were also followed for this example but Step-e for introducing hydrogen was omitted. The partial pressure of acetone and hydrogen and the applied pulse voltage and other conditions were similar to those of Example 8 . Since the device current If showed an early increase if compared that of Example 6, the voltage application was suspended 30 minutes after the start and the inside of the vacuum chamber was evacuated. The device current was equal to If=1.5 mA at the end of the pulse voltage application. Thereafter, the specimen was subjected to a stabilization process.

The specimens of Examples 8 through 10 and Comparative Example 5 were tested for the performance of electron emission. For the test, each electron source panel was evacuated by means of an ion pump after the end of the activation process, while heating the devices at 80° C. until a low pressure of $2.7\times10^{-6}$ was achieved, when the heating of the devices was stopped. The test was started when the devices were cooled to room temperature.

A monopolar rectangular pulse voltage with a wave height, a pulse width and a pulse interval equal to Vph=18V, T1=100 μsec. and T2=10 msec. respectively was applied to the devices in order to drive the latter. The devices were separated from the anode by H=4 mm and the potential different was held to 1 kV. Each specimen was also tested for the withstand voltage for electric discharge.

The device current Ie and the emission current If immediately after and 100 hours after the start of the test are shown for each specimen in the table below along with its withstand voltage for electric discharge.

| | immed. after start of test | | 100 after start of test | | withstand voltage for elect. emis. |
|---|---|---|---|---|---|
| | If(mA) | Ie(μA) | If(mA) | Ie(μA) | (kv) |
| Example 8 | 1.5 | 1.1 | 0.9 | 0.6 | 5.5 |
| Example 9 | 1.5 | 1.2 | 1.1 | 0.9 | 5.5 |
| Example 10 | 1.8 | 1.4 | 1.4 | 1.1 | 5.5 |
| Example 11 | 1.5 | 1.0 | 1.0 | 0.6 | 6.0 |
| Comparative Example 5 | 1.2 | 0.6 | 0.6 | 0.2 | 2.5 |

A device that had not been used for the above performance test was picked up from those of each of Examples 8 through 11 and Comparative Example 5 and examined for the crystallinity of the carbon film by means of a Raman spectrometer. An Ar laser having a wavelength of 514.5 nm was used for the light source, which produced a light spot with a diameter of about 1 μm on the surface of the specimen.

When the spot was placed on or around the electron-emitting region, a spectrum having peaks in the vicinity of 1,335 $cm^{-1}$ (P1) and 1,580 $cm^{-1}$ (P2) was obtained to prove the existence of a carbon film.

In the discussions below, the half width of P1 is used to indicate the crystallinity of graphite for Examples and Comparative Examples because the intensity of light was sufficiently strong at P1.

Figure 21:
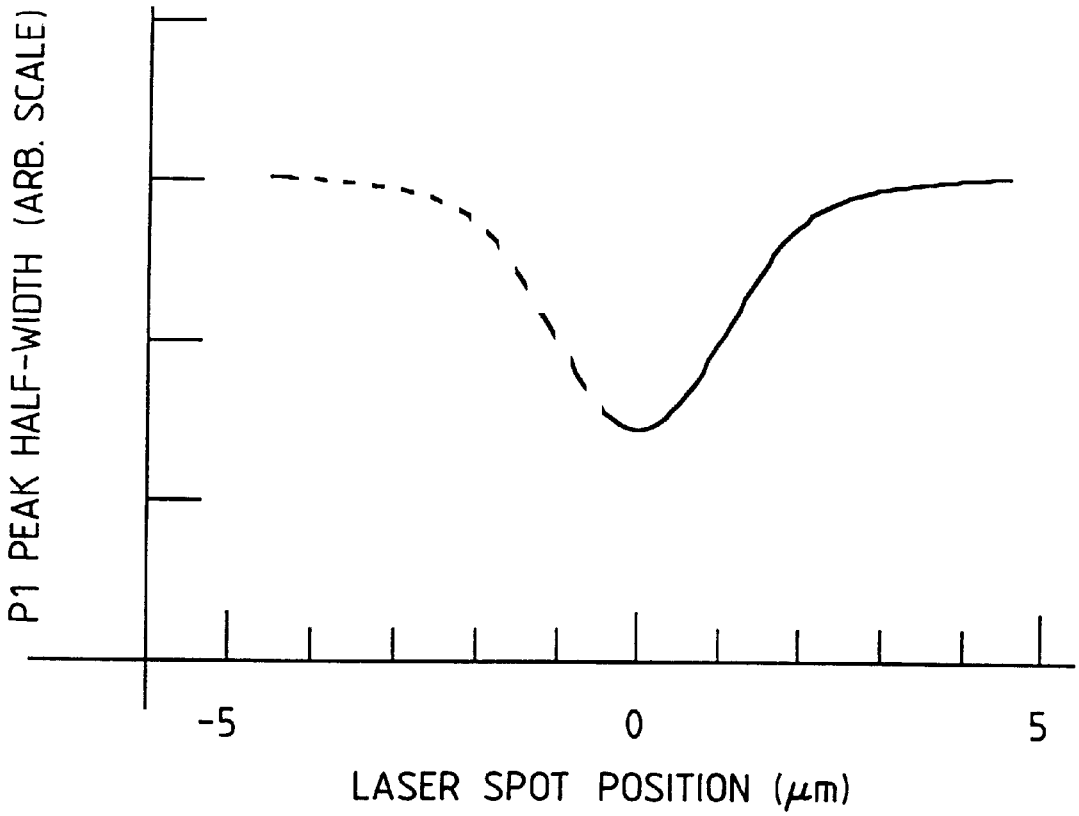
FIG. 21 is a graph showing the crystallinity distribution of a graphite film obtained by a laser Raman spectrometric analyzer.

The Ar laser spot of the above Raman spectrometer was made to scan from an end to the other of the gap of each device and the obtained values for the half width of P1 were plotted as a function of the position of the spot. FIG. 21 is a graph schematically showing the results of the measurement. While the device was assumed to have a gap at the center (position 0 on the scale) of the two device electrodes for the graph of FIG. 21, it might not necessarily be so at all times. The positive side of the scale represents the anode of the device.

For each device, except that of Example 10 where a bipolar pulse voltage was used for the activation process, the carbon film formed on the cathode side was very small and showed a low signal level, whereas a sufficient signal level was detected on the anode side.

In Comparative Example 5, the half width was as small as 150 $cm^{-1}$ near the gap but gradually increased as the spot approached the anode until it got to 250 $cm^{-1}$ at the end.

The half width did not change significantly in any of Examples 8 through 11. It was found between 100 and 130 $cm^{-1}$, 85 and 120 $cm^{-1}$, 90 and 130 $cm^{-1}$ and 100 and 130 $cm^{-1}$ in Examples 8, 9, 10 and 11 respectively.

As the crystallinity of the carbon film was found high at and near the center thereof in each of the above examples, the carbon film was further examined by means of a transmission electron microscope (TEM).

In Comparative Example 5, a carbon film was found mainly on the anode side of the gap of the electron-emitting region and only poorly on the cathode side. A lattice structure was observed in the carbon film inside the gap to prove that the carbon film was mainly constituted of graphite crystals having a particle size of 2–3 nm or above. On the other hand, no clear lattice structure was observable at locations away from the gap, meaning that the carbon film there was mainly constituted of amorphous carbon.

Figure 22:
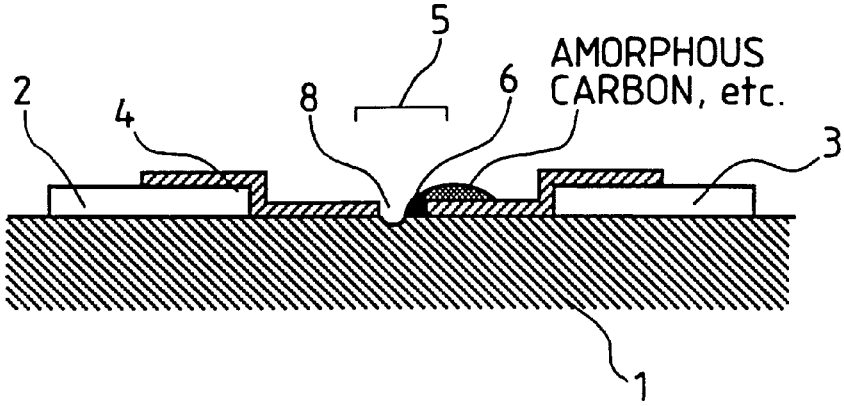
FIG. 22 is a schematic side view of a surface conduction electron-emitting device obtained in Comparative Example 5.

FIG. 22 schematically illustrates the lattice image of the graphite observed in the carbon film of the device of Comparative Example 5. The carbon film was constituted of graphite inside the gap and by amorphous carbon outside the gap.

Figure 23:
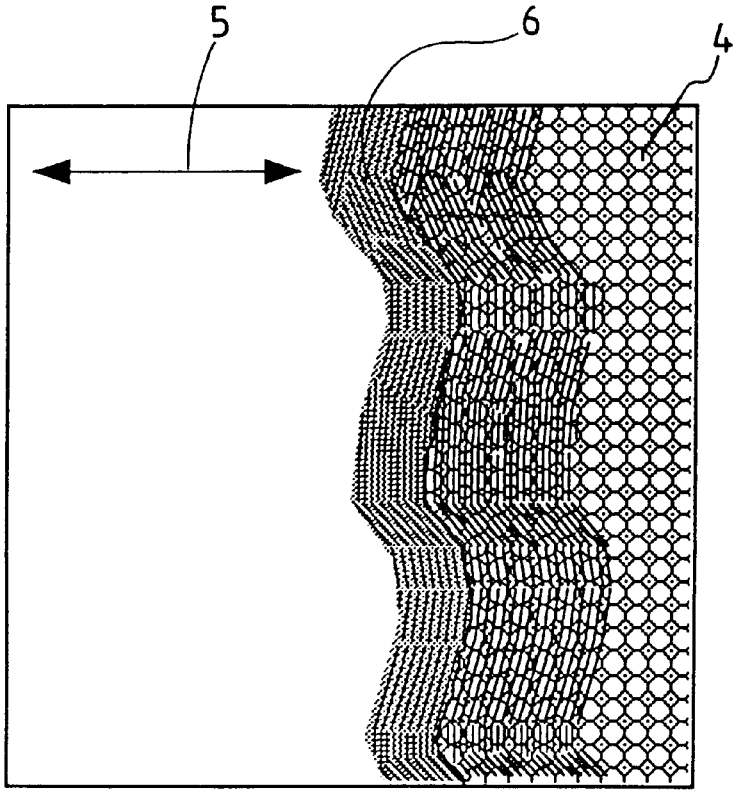
FIG. 23 is a schematic illustration of the graphite films of Examples 8 through 11 observed through a TEM.
Figure 24A:
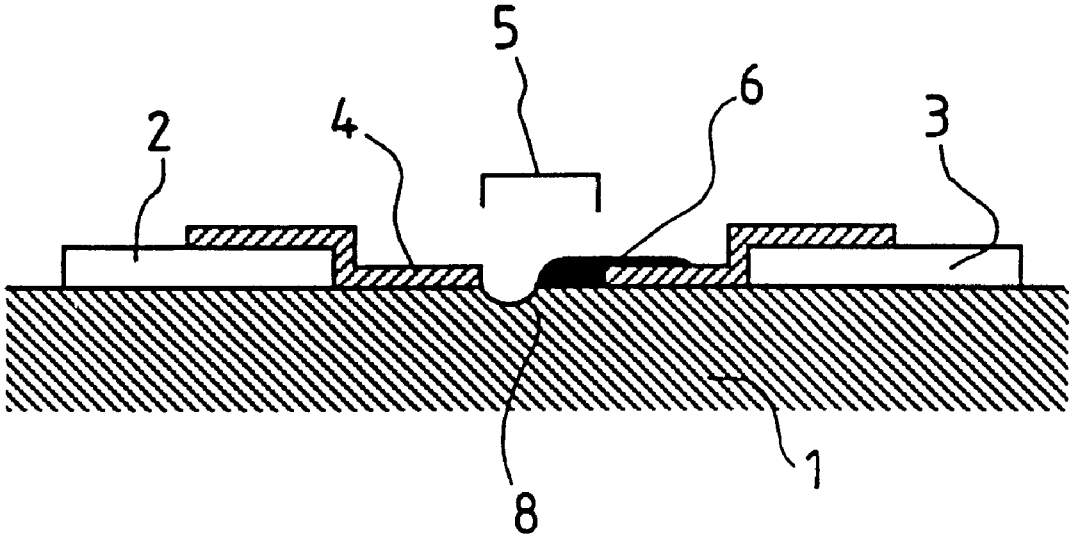
FIG. 24A is a schematic side view of surface conduction electron-emitting devices obtained in Examples 8 and 9 and FIG. 24B is a schematic side view of a surface conduction electron-emitting device obtained in Example 10.
Figure 24B:
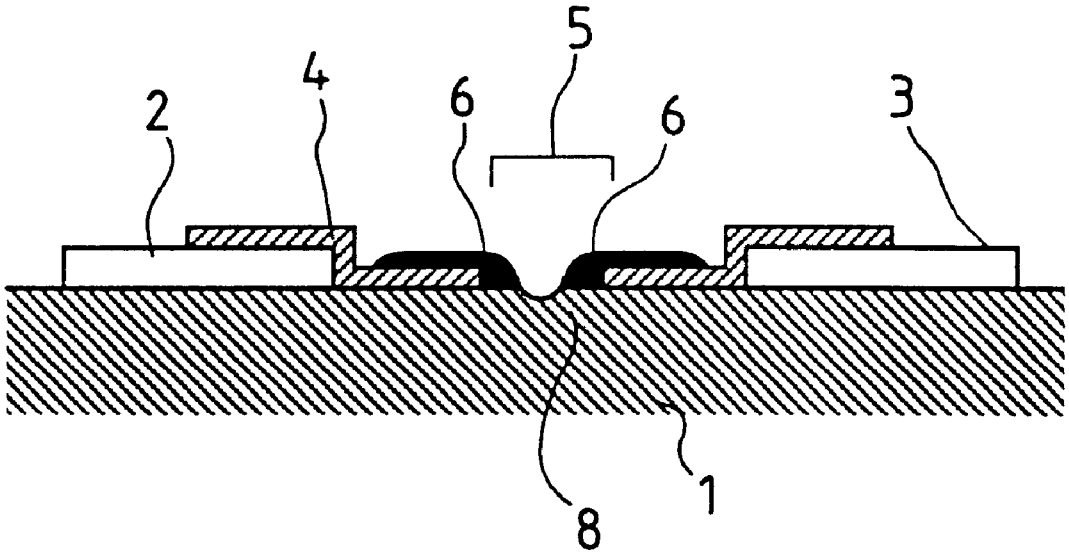

In any of Examples 8 through 11, a lattice image was observed everywhere in the carbon film of the device as schematically illustrated in FIG. 23 to prove that the entire carbon film was constituted of graphite. The size of many of the crystal particles was not smaller than 10 nm. FIG. 24A schematically shows each of the devices of Examples 8 and 9, whereas FIG. 24B schematically illustrate the device of Example 10.

Figure 25:
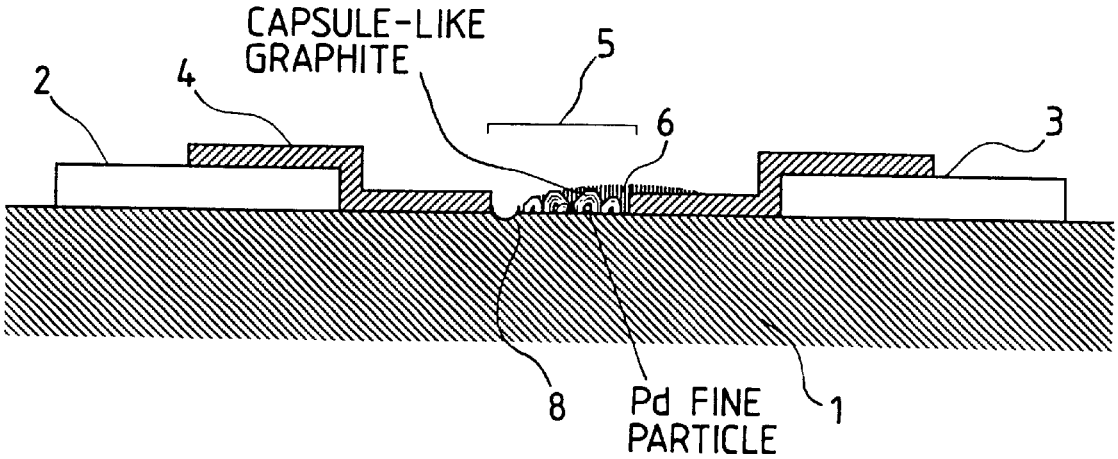
FIG. 25 is a schematic side view of a surface conduction electron-emitting device obtained in Example 11.

When the inside of the gap of the device of Example 11 was observed, paying particular attention to a Pd fine particle and its surroundings, it was found that the fine particles was surrounded by a lattice image as in the case of Example 4. In other words, a capsule-like crystal lattice that surrounded a Pd fine particle was observed inside the gap of the electron-emitting region of the device of Example 11. FIG. 25 schematically illustrates the observed lattice image.

The above described fact that If rapidly increased during the activation process may be attributable to the growth of carbon crystals around Pd fine particles within the gap, each Pd particle playing the role of a core of crystal growth.

A groove was observed on the substrate of each of the devices of the above Examples and Comparative Example between the carbon film and the cathode side electroconductive thin film or between the carbon films on the anode and cathode side ends.

EXAMPLE 12

Each of the surface conduction electron-emitting devices prepared in this example was similar to the one schematically illustrated in FIGS. 1A and 1B.

Step-a:

A desired pattern of photoresist (RD-2000N-41: available from Hitachi Chemical Co., Ltd.) having openings corresponding to the contours of a pair of electrodes was formed for each device on a thoroughly cleansed quartz glass substrate 1, on which an Ni film was formed to a thicknesses of 100 nm by vacuum deposition. Thereafter, the photoresist was dissolved by an organic solvent and the unnecessary portions of the Ni film was lifted off to produce a pair of device electrodes 2 and 3 for each device. The device electrodes was separated by a distance equal to L=2 $\mu$m and had a width equal to W=500 $\mu$m.

Step-b:

A Cr film was formed to a thickness of 50 nm on the substrate 1 carrying thereon a pair of electrodes 2, 3 by vacuum deposition and then a Cr mask having an opening corresponding to the contour of an electroconductive thin film was prepared out of the Cr film by photolithography. The opening had a width W' of 300 $\mu$m. Thereafter, a solution of Pd-amine complex (cccp4230: available from Okuno Pharmaceutical Co., Ltd.) was applied to the Cr film by means of a spinner and baked at 300° C. for 10 minutes in the atmosphere to produce an electroconductive thin film containing PdO as a principal ingredient. The average diameter of the fine particles of the film and the film thickness were about 7 nm.

Step-c:

The Cr film was removed by wet-etching and the electroconductive thin film 4 was processed to show a desired pattern. The electroconductive thin films showed an electric resistance of Rs=$5.0\times10^{4}\Omega/\square$.

Step-d:

Then, the substrate was moved into the vacuum chamber of a gauging system as illustrated in FIG. 7 and the inside of the vacuum chamber 15 was evacuated by means of a vacuum pump unit 16 (ion pump) to a pressure of $2.7\times10^{-6}$Pa. Thereafter, the sample devices were subjected to an energization forming process by applying a pulse voltage between the device electrodes 2, 3 of each device by means of a power source 11, which was designed to apply a device voltage Vf to each device. The pulse waveform of the applied voltage for the energization forming process is shown in FIG. 5B.

The triangular pulse voltage had a pulse width of T1=1 msec. and a pulse interval of T2=10 msec. and the peak voltage (for the forming process) was raised stepwise with a step of 0.1V. During the forming process, an extra pulse voltage of 0.1V (not shown) was inserted into intervals of the forming pulse voltage in order to determine the resistance of the electron emitting region, constantly monitoring the resistance, and the electric forming process was terminated when the resistance exceeded 1MΩ. The peak value of the pulse voltage (forming voltage) was 5.0V for the devices when the forming process was terminated.

Step-e:

Acetone was introduced into the vacuum chamber 15 until the partial pressures of $1.3\times10^{-3}$Pa was achieved for acetone. A rectangular pulse voltage as shown in FIG. 6B was applied to the devices to carry out a first activation process for 10 minutes. The pulse wave height was 8V with T1=100 $\mu$sec. and T2=10 msec.

Step-f:

The acetone partial pressure was made to be $1.3\times10^{-1}$Pa and hydrogen was also introduced until it showed a partial pressure of 13 Pa. The pulse wave height was raised stepwise from 8V to 14V with a rate of 3.3 mV/sec. to carry out a second activation process. The total processing time was 120 minutes. Thereafter, the supply of acetone and hydrogen as stopped and the inside of the vacuum chamber was evacuated until the internal pressure fell under $1.3\times10^{-6}$Pa.

COMPARATIVE EXAMPLE 6

A specimen similar to that of Example 12 was prepared as that of Example 12 except that hydrogen was not introduced in Step-f.

EXAMPLE 13

A specimen similar to that of Example 12 was subjected to Steps-a through d of Example 12. Thereafter, Step-f:

Methane and hydrogen were introduced into the vacuum chamber to achieve a partial pressure of 6.7 Pa for methane and that of 130 Pa for hydrogen. Then, a second activation process was carried out for 120 minutes by applying a pulse voltage as in the case of Example 12. Thereafter, the methane and acetone were removed out of the vacuum chamber until the internal pressure of the vacuum chamber fell under $1.3\times10^{-6}$Pa.

EXAMPLE 14

A specimen was prepared as in the case of Example 13 except that the devices were heated to 200° C. for the second activation process in Step-f.

Two devices were prepared for each of Examples 12 through 14 and Comparative Example 6. Of the devices of each example, one was used to evaluate the performance for electron emission by applying a pulse voltage same as the one used for the activation process. The device and the anode were separated from each other by 4 mm and the potential difference between them was 1 kV. The device current and the emission current of each device were measured immediately after the start, one hour after the start and 100 hours after the start. The withstand voltage for electric discharge was also measured.

| time | 0 | | 1 | | 100 | | withstand voltage for elect. emis. |
|---|---|---|---|---|---|---|---|
| device | If(mA) | Ie($\mu$A) | If(mA) | Ie($\mu$A) | If(mA) | Ie($\mu$A) | (kV) |
| Example 12 | 1.0 | 0.5 | 0.7 | 0.3 | 0.5 | 0.2 | 4.5 |
| Comparative Example 6 | 3.0 | 1.4 | 1.0 | 0.5 | 0.7 | 0.2 | 2.5 |

-continued

| time | 0 | | 1 | | 100 | | withstand voltage for elect. emis. |
|---|---|---|---|---|---|---|---|
| device | If(mA) | Ie(μA) | If(mA) | Ie(μA) | If(mA) | Ie(μA) | (kV) |
| Example 13 | 2.0 | 1.6 | 1.0 | 1.3 | 0.6 | 0.3 | 5.0 |
| Example 14 | 1.6 | 1.8 | 1.5 | 1.6 | 1.1 | 1.2 | 6.0 |

The device of each of the above examples that was not used for the evaluation of the performance for electron emission was observed by means of a TEM for lattice image. While a crystal structure similar to that of FIG. 23 was observed for each of Examples 12 through 14, a lattice image was found only part of the carbon film outside the gap of the device of Comparative Example 6. Presumably, the carbon film was mostly made of amorphous carbon outside the gap.

The devices were subjected to Raman spectrometric analysis. The half widths of P1s of the devices are shown-below.

| | half width ($cm^{-1}$) | |
|---|---|---|
| device | near the gap | behind the gap |
| Example 12 | 120 | 150 |
| Comparative Example 6 | 160 | 300 |
| Example 13 | 110 | 140 |
| Example 14 | 90 | 130 |

EXAMPLE 15

In this example, four electron-emitting devices, each having a configuration as shown in FIGS. 1A and 1B, were prepared on a substrate.

Step-a:

A desired pattern of photoresist (RD-2000N-41: available from Hitachi Chemical Co., Ltd.) having openings corresponding to the contours of a pair of electrodes was formed for each device on a thoroughly cleansed quartz glass substrate 1, on which a Ti film and an Ni film were sequentially formed to respective thicknesses of 5 nm and 100 nm by vacuum deposition. Thereafter, the photoresist was dissolved by an organic solvent and the unnecessary portions of the Ni/Ti film were lifted off to produce a pair of device electrodes 2 and 3 for each device. The device electrodes was separated by a distance of L=10 μm and had a width of W=300 μm.

Step-b:

For each device, an electroconductive thin film 4 was processed to show a given pattern in order to form an electron-emitting region 5. More specifically, a Cr film was formed to a thickness of 50 nm on the substrate 1 carrying thereon a pair of electrodes 2, 3 by vacuum deposition and then a Cr mask having an opening corresponding to the contour of the device electrodes 2 and 3 and the space separating them was prepared out of the Cr film. The opening had a width W' of 100 μm. Thereafter, a solution of Pd-amine complex (cccp4230: available from Okuno Pharmaceutical Co., Ltd.) was applied to the Cr film by means of a spinner and baked at 300° C. for 10 minutes in the atmosphere to produce an electroconductive thin film 4 containing PdO as a principal ingredient. The film had a film thickness of 12 nm.

Step-c:

The Cr film was removed by wet-etching and the electroconductive thin film 4 was processed to show a desired pattern. The electroconductive thin films showed an electric resistance of Rs=$1.4\times10^4\Omega/\square$.

Step-d:

Then, the devices were moved into the vacuum chamber of a gauging system as illustrated in FIG. 7 and the inside of the vacuum chamber 15 was evacuated by means of a vacuum pump unit 16 (a sorption pump and an ion pump) to a pressure of $2.7\times10^{-6}$Pa. Thereafter, the sample devices were subjected to an energization forming process by applying a pulse voltage between the device electrodes 2, 3 of each device by means of a power source 11, which was designed to apply a device voltage Vf to each device. The pulse waveform of the applied voltage for the forming process is shown in FIG. 5B.

The triangular pulse voltage had a pulse width of T1=1 msec. and a pulse interval of T2=10 msec. and the peak voltage (for the forming process) was raised stepwise with a step of 0.1V. During the forming process, an extra pulse voltage of 0.1V (not shown) was inserted into intervals of the forming pulse voltage in order to determine the resistance of the electron emitting region, constantly monitoring the resistance, and the electric forming process was terminated when the resistance exceeded 1MΩ. The peak value of the pulse voltage (forming voltage) was 7.0V for all the devices when the forming process was terminated.

Step-e:

Acetone was introduced into the vacuum chamber and a partial pressure of $1.3\times10^{-1}$Pa was achieved for acetone by appropriately operating a variable leak valve 17.

Step-f:

A monopolar rectangular pulse voltage as shown in FIG. 6B was applied to each device. The pulse wave height, the pulse width and the pulse interval were respectively Vph=18V, T1=100 μsec. and T2=10 msec. This step was terminated after continuously applying the pulse voltage for 10 minutes. The supply of acetone was suspended and the inside of the vacuum chamber was evacuated.

Step-g:

Then, partial pressures of 13 Pa and 1.3 Pa were achieved respectively for methane and hydrogen in the vacuum chamber 15 by operating the mass flow controller (not shown). The same pulse voltage was applied again to the devices for 120 minutes and then the voltage application was terminated. The device current was equal to If=2.5 mA at the end of the step. Thereafter, the inside of the vacuum chamber was evacuated to a pressure under $2.7\times10^{-6}$Pa.

Thereafter, the devices were subjected to an activation process as in the case of Step-j of Example 2.

EXAMPLE 16

Steps-a through f of Example 15 were also followed for this example and then, in Step-g, a pulse voltage same as that of Step-g of the above example was applied, while heating the devices to 200° C. The device current was equal to If=2.2 mA at the end of the step.

Thereafter, the devices were subjected to an activation process.

A pulse voltage same as the one used for the activation process was applied to selected devices of Examples 15 and 16 to determine Ie and If. The device and the anode were separated from each other by 4 mm and the potential difference between them was 1 kV. The device current and the emission current of each device were measured immediately after the start and 100 hours after the start. The withstand voltage for electric discharge was also measured.

| | time | | | | withstand voltage |
|---|---|---|---|---|---|
| | 0 | | 100 | | for elect. emis. |
| device | If(mA) | Ie(μA) | If(mA) | Ie(μA) | (kV) |
| Example 15 | 1.4 | 1.4 | 1.2 | 1.0 | 6.0 |
| Example 16 | 1.2 | 2.0 | 0.9 | 1.5 | 6.5 |

The devices of each of the above examples that were not used for the evaluation of the performance for electron emission were examined by means of a TEM for lattice image. A crystal structure similar to that of FIG. 23 was observed for each of Examples 15 and 16.

The devices were examined by means of a Laser Raman spectrometer to find out a couple of peaks for each device as in the case of the preceding examples. The half widths of P1s of the devices are shown below. A higher level of crystallinity was observed in areas close to the gap of each device.

| device | near the gap($cm^{-1}$) | outside the gap($cm^{-1}$) |
|---|---|---|
| Example 15 | 80 | 120 |
| Example 16 | 70 | 100 |

EXAMPLE 17

In this example, four electron-emitting devices, each having a configuration as shown in FIGS. 1A and 1B, were prepared on a substrate.

Step-a:

A desired pattern of photoresist (RD-2000N-41: available from Hitachi Chemical Co., Ltd.) having openings corresponding to the contours of a pair of electrodes was formed for each device on a thoroughly cleansed soda lime glass substrate 1 with a thickness of 0.5 μm, on which a Ti film and an Ni film were sequentially formed to respective thicknesses of 5 nm and 100 nm by vacuum deposition. Thereafter, the photoresist was dissolved by an organic solvent and the unnecessary portions of the Ni/Ti film were lifted off to produce a pair of device electrodes 2 and 3 for each device. The device electrodes was separated by a distance L=3 μm and had a width of W=300 μm.

Step-b:

For each device, an electroconductive thin film 4 was processed to show a given pattern in order to form an electron-emitting region 5. More specifically, a Cr film was formed to a thickness of 50 nm on the substrate 1 carrying thereon a pair of electrodes 2, 3 by vacuum deposition and then a Cr mask having an opening corresponding to the contour of the device electrodes 2 and 3 and the space separating them was prepared out of the Cr film. The opening had a width W' of 100 μm. Thereafter, a solution of Pd-amine complex (cccp4230: available from Okuno Pharmaceutical Co., Ltd.) was applied to the Cr film by means of a spinner and baked at 300° C. for 10 minutes in the atmosphere to produce an electroconductive thin film 4 containing PdO as a principal ingredient. The film had a film thickness of 10 nm.

Step-c:

The Cr film was removed by wet-etching and the electroconductive thin film 4 was processed to show a desired pattern. The electroconductive thin films showed an electric resistance of $Rs=2.0\times10^4\Omega/\square$.

Step-d:

Then, the devices were moved into the vacuum chamber of a gauging system as illustrated in FIG. 7 and the inside of the vacuum chamber 15 was evacuated by means of a vacuum pump unit 16 (a sorption pump and an ion pump) to a pressure of $2.7\times10^{-6}$Pa. Thereafter, the sample devices were subjected to an energization forming process by applying a pulse voltage between the device electrodes 2, 3 of each device by means of a power source 11, which was designed to apply a device voltage Vf to each device. The pulse waveform of the applied voltage for the forming process is shown in FIG. 58.

The triangular pulse voltage had a pulse width of T1=1 msec. and a pulse interval of T2=10 msec. and the peak voltage (for the forming process) was raised stepwise with a step of 0.1V. During the forming process, an extra pulse voltage of 0.1V (not shown) was inserted into intervals of the forming pulse voltage in order to determine the resistance of the electron emitting region, constantly monitoring the resistance, and the electric forming process was terminated when the resistance exceeded 1MΩ. The peak value of the pulse voltage (forming voltage) was 5.0–5.1V for all the devices when the forming process was terminated.

Step-e:

The devices were heated to 400° C. by means of a heater (not shown) and the inside of the vacuum chamber was evacuated to $1.3\times10^{-4}$Pa. Thereafter, methane and hydrogen were alternately introduced into the vacuum chamber, constantly applying a pulse voltage to the devices for an activation process. The partial pressures of methane and hydrogen were same and equal to 1.3 Pa. Methane and hydrogen were introduced with a cycle time of 20 seconds. A graphite film was formed to a thickness of 50 nm after 30 minutes of the activation process.

EXAMPLE 18

In this example, four electron-emitting devices, each having a configuration as shown in FIGS. 1A and 1B, were prepared on a substrate.

Step-a:

A desired pattern of photoresist (RD-2000N-41: available from Hitachi Chemical Co., Ltd.) having openings corresponding to the contours of a pair of electrodes was formed for each device on a thoroughly cleansed soda lime glass substrate 1 with a thickness of 0.5 μm, on which a Ti film and an Ni film were sequentially formed to respective thicknesses of 5 nm and 100 nm by vacuum deposition. Thereafter, the photoresist was dissolved by an organic solvent and the unnecessary portions of the Ni/Ti film were lifted off to produce a pair of device electrodes 2 and 3 for each device. The device electrodes was separated by a distance of L=3 μm and had a width of W=300 μm.

Step-b:

For each device, an electroconductive thin film 4 was processed to show a given pattern in order to form an electron-emitting region 5. More specifically, a Cr film was formed to a thickness of 50 nm on the substrate 1 carrying thereon a pair of electrodes 2, 3 by vacuum deposition and then a Cr mask having an opening corresponding to the contour of the device electrodes 2 and 3 and the space separating them was prepared out of the Cr film. The opening had a width W' of 100 μm. Thereafter, a solution of Pd-amine complex (cccp4230: available from Okuno Pharmaceutical Co., Ltd.) was applied to the Cr film by means of a spinner and baked at 300° C. for 10 minutes in the atmosphere to produce an electroconductive thin film 4 containing PdO as a principal ingredient. The film had a film thickness of 10 nm.

Step-c:

The Cr film was removed by wet-etching and the electroconductive thin film 4 was processed to show a desired pattern. The electroconductive thin films showed an electric resistance of $Rs=2.0\times10^{4}\Omega/\square$.

Step-d:

Then, the devices were moved into the vacuum chamber of a gauging system as illustrated in FIG. 7 and the inside of the vacuum chamber 15 was evacuated by means of a vacuum pump unit 16 (a sorption pump and an ion pump) to a pressure of $2.7\times10^{-6}$Pa. Thereafter, the sample devices were subjected to an energization forming process by applying a pulse voltage between the device electrodes 2, 3 of each device by means of a power source 11, which was designed to apply a device voltage Vf to each device. The pulse waveform of the applied voltage for the forming process is shown in FIG. 5B.

The triangular pulse voltage had a pulse width of T1=1 msec. and a pulse interval of T2=10 msec. and the peak voltage (for the forming process) was raised stepwise with a step of 0.1V. During the forming process, an extra pulse voltage of 0.1V (not shown) was inserted into intervals of the forming pulse voltage in order to determine the resistance of the electron emitting region, constantly monitoring the resistance, and the electric forming process was terminated when the resistance exceeded 1MΩ. The peak value of the pulse voltage (forming voltage) was 5.0–5.3V for all the devices when the forming process was terminated.

Step-e:

The inside of the vacuum chamber was evacuated to $1.3\times10^{-4}$Pa. Thereafter, methane and hydrogen were alternately introduced into the vacuum chamber, constantly applying a pulse voltage to the devices for an activation process. The partial pressures of methane and hydrogen were respectively 0.13 Pa and 13 Pa. Methane and hydrogen were introduced with a cycle time of 20 seconds. A graphite film was formed to a thickness of 30 nm after 13 minutes of the activation process.

EXAMPLE 19

Steps-a through d of Example 18 were also followed for this Example. Thereafter, Step-e:

The inside of the vacuum chamber was evacuated to $1.3\times10^{-4}$Pa. Thereafter, hydrogen was introduced into the vacuum chamber, constantly applying a pulse voltage to the devices for an activation process. Hydrogen was existing in the atmosphere of the inside of the vacuum chamber throughout this step. The partial pressures of hydrogen was held to 13 Pa. At the same time, ethylene was intermittently introduced into the vacuum chamber until its partial pressure got to 0.13 Pa. Ethylene was introduced with a cycle time of 20 seconds. A graphite film was formed to a thickness of 50 nm after 30 minutes of the activation process.

The internal pressure of the vacuum chamber was reduced to $1.3\times10^{-4}$Pa and If and If of each device of Examples 17 through 19 was measured, constantly applying a rectangular pulse voltage of 14V. The device and the anode were separated from each other by 4 mm and the potential difference between them was 1 kV. The device current and the emission current of each device were measured immediately after the start and 100 hours after the start. The withstand voltage for electric discharge was also measured.

| | time | | | | withstand voltage |
|---|---|---|---|---|---|
| | 0 | | 100 | | for elect. emis. |
| device | If(mA) | Ie(μA) | If(mA) | Ie(μA) | (kV) |
| Example 17 | 1.5 | 1.6 | 1.2 | 1.2 | 6.5 |
| Example 18 | 1.0 | 2.0 | 0.8 | 1.5 | 6.0 |
| Example 19 | 1.0 | 2.2 | 0.8 | 1.7 | 6.5 |

The devices of each of Examples 17 through 19 that were not used for the evaluation of the performance for electron emission were observed by means of a Laser Raman spectrometer as in the case of Examples 15 and 16. The results are shown below.

| device | near the gap($cm^{-1}$) | outside the gap($cm^{-1}$) |
|---|---|---|
| Example 17 | 50 | 80 |
| Example 18 | 60 | 95 |
| Example 19 | 50 | 85 |

EXAMPLE 20, COMPARATIVE EXAMPLE 7

In this example, a pair of electron-emitting devices, each having a configuration as shown in FIGS. 1A and 1B, were prepared on a substrate.

Step-a:

A desired pattern of photoresist (RD-2000N-41: available from Hitachi Chemical Co., Ltd.) having openings corresponding to the contours of a pair of electrodes was formed for each device on a thoroughly cleansed soda lime glass substrate 1 with a thickness of 0.5 μm, on which a Ti film and an Ni film were sequentially formed to respective thicknesses of 5 nm and 100 nm by vacuum deposition. Thereafter, the photoresist was dissolved by an organic solvent and the unnecessary portions of the Ni/Ti film were lifted off to produce a pair of device electrodes 2 and 3 for each device. The device electrodes was separated by a distance of L=10 μm and had a width equal to W=300 μm.

Step-b:

For each device, an electroconductive thin film 4 was processed to show a given pattern in order to form an electron-emitting region 5. More specifically, a Cr film was formed to a thickness of 50 nm on the substrate 1 carrying thereon a pair of electrodes 2, 3 by vacuum deposition and then a Cr mask having an opening corresponding to the contour of the device electrodes 2 and 3 and the space separating them was prepared out of the Cr film. The opening had a width WI of 100 μm. Thereafter, a solution of Pd-amine complex (cccp4230: available from Okuno Pharmaceutical Co., Ltd.) was applied to the Cr film by means of a spinner and baked at 300° C. for 10 minutes in the atmosphere to produce an electroconductive thin film 4 containing PdO as a principal ingredient. The film had a film thickness of 12 nm.

Step-c:

The Cr film was removed by wet-etching and the electroconductive thin film 4 was processed to show a desired pattern. The electroconductive thin films showed an electric resistance of $Rs=1.5\times10^4\Omega/\square$.

Step-d:

Then, the devices were moved into the vacuum chamber of a gauging system as illustrated in FIG. 7 and the inside of the vacuum chamber 15 was evacuated by means of a vacuum pump unit 16 (ion pump) to a pressure of $2.7\times10^{-3}$Pa. Thereafter, the sample devices were subjected to an energization forming process by applying a pulse voltage between the device electrodes 2, 3 of each device by means of a power source 11, which was designed to apply a device voltage Vf to each device. The pulse waveform of the applied voltage for the forming process is shown in FIG. 5B.

The triangular pulse voltage had a pulse width of T1=1 msec. and a pulse interval of T2=10 msec. and the peak voltage (for the forming process) was raised stepwise with a step of 0.1V. During the forming process, an extra pulse voltage of 0.1V (not shown) was inserted into intervals of the forming pulse voltage in order to determine the resistance of the electron emitting region, constantly monitoring the resistance, and the electric forming process was terminated when the resistance exceeded 1MΩ. The peak value of the pulse voltage (forming voltage) was 7V for the devices when the forming process was terminated.

Step-e:

One of the devices is referred to device A, whereas the other is called device B.

A bipolar rectangular pulse voltage as shown in FIG. 6A was applied to the device A (Example 20) to carry out an activation process. The pulse wave height was ±18 and the pulse width and the pulse interval were respectively T1=T1'=100 μsec. and T2=10 msec.

A monopolar rectangular pulse voltage as shown in FIG. 6A was applied to the device B (Comparative Example 7) to carry out an activation process. The pulse wave height, the pulse width and the pulse interval were respectively Vph=18V, T1=100 μsec. and T2=10 msec. The activation process was conducted with a distance of 4mm separating each of the devices and the anode and a potential difference of 1 kV, while monitoring both If and Ie. Under this condition, the internal pressure of the vacuum chamber was $2.0\times10^{-3}$Pa. The activation process was terminated in about 30 minutes, when Ie got to a saturated level.

The vacuum pump unit was switched to the ion pump and the vacuum chamber and the device in it were heated, while evacuating the chamber to a pressure level of $1.3\times10^{-4}$Pa. Both If and If of each of the devices Examples 20 and Comparative Example 7 were measured immediately after and 100 hours after the start of the application of a rectangular pulse voltage of 18V.

| | time | | | |
|---|---|---|---|---|
| | 0 | | 100 | |
| device | If(mA) | Ie(μA) | If(mA) | Ie(μA) |
| Example 20 | 1.0 | 0.9 | 0.7 | 0.5 |
| Comparative Example 7 | 1.2 | 0.6 | 0.6 | 0.2 |

The devices of Example 20 and Comparative Example 7 were examined by means of a Laser Raman spectrometer to see the half width of P1 near and outside the gap for each device. The results are shown below.

| device | near the gap($cm^{-1}$) | outside the gap($cm^{-1}$) |
|---|---|---|
| Example 20 | 120 | 300 |
| Comparative Example 7 | 160 | 300 |

It will be seen from above that the device A of Example 20 has a crystallinity near the gap higher than that of the device B of Comparative Example 7. This might be because a stronger electric field is generated in locations where the growth of graphite is remarkable and, in fact, graphite grows particularly at the both ends of the gap of an electron-emitting device.

Each of the devices of the following Examples and Comparative Examples had a configuration as shown in FIGS. 1A and 1B. A total of four devices were prepared in parallel on a single substrate for each example.

EXAMPLE 21

Step-a:

A desired pattern of photoresist (RD-2000N-41: available from Hitachi Chemical Co., Ltd.) having openings corresponding to the contours of a pair of electrodes was formed for each device on a thoroughly cleansed quartz glass substrate 1, on which a Ti film and an Ni film were sequentially formed to respective thicknesses of 5 nm and 100 nm by vacuum deposition. Thereafter, the photoresist was dissolved by an organic solvent and the unnecessary portions of the Ni/Ti film were lifted off to produce a pair of device electrodes 2 and 3 for each device. The device electrodes was separated by a distance of L=10 μm and had a width equal to W=300 μm.

Step-b:

For each device, a Cr film was formed to a thickness of 50 nm on the substrate 1 carrying thereon a pair of electrodes 2, 3 by vacuum deposition and then a Cr mask having an opening corresponding to the contour of the device electrodes 2 and 3 and the space separating them was prepared out of the Cr film. The opening had a width W' of 100 μm. Thereafter, a solution of Pd-amine complex (cccp4230: available from Okuno Pharmaceutical Co., Ltd.) was applied to the Cr film by means of a spinner and baked at 300° C. for 10 minutes in the atmosphere to produce an electroconductive thin film 4 containing PdO as a principal ingredient. The film had a film thickness of 12 nm.

Step-c:

The Cr film was removed by wet-etching and the electroconductive thin film 4 was processed to show a desired pattern. The electroconductive thin films showed an electric resistance of $Rs=1.5\times10^4\Omega/\square$.

Step-d:

Then, the processed substrate was moved into the vacuum chamber of a gauging system as illustrated in FIG. 7 and the inside of the vacuum chamber 15 was evacuated by means of a vacuum pump unit 16 (ion pump) to a pressure of $2.7\times10^{-6}$Pa. Thereafter, the sample devices were subjected to an energization forming process by applying a pulse voltage between the device electrodes 2, 3 of each device by means of a power source 61, which was designed to apply a device voltage Vf to each device. The pulse waveform of the applied voltage for the forming process is shown in FIG. 5B.

The triangular pulse voltage had a pulse width of T1=1 msec. and a pulse interval of T2=10 msec. and the peak voltage (for the forming process) was raised stepwise with a step of 0.1V. During the forming process, an extra pulse voltage of 0.1V (not shown) was inserted into intervals of the forming pulse voltage in order to determine the resistance of the electron emitting region, constantly monitoring the resistance, and the electric forming process was terminated when the resistance exceeded 1MΩ. The peak value of the pulse voltage (forming voltage) was 7.0V for the devices when the forming process was terminated.

Step-e:

Acetone was introduced into the vacuum chamber from the reservoir 18 by opening the variable leak valve 17. The valve was regulated to make the partial pressure of acetone equal to $1.3\times10^{-1}$Pa within the vacuum chamber 15 when observed by means of a quadrapole mass analyzer (not shown).

Step-f:

A bipolar rectangular pulse voltage as shown in FIG. 6A was applied to the devices to carry out an activation process. The pulse wave height, the pulse width and the pulse interval were respectively Vph=V'ph=18V, T1=T1=100 μsec. and T2=100 msec. The pulse voltage was applied for 30 minutes and then stopped. When the application of the pulse voltage, the device current was equal to If=1.8 mA.

Step-g:

The supply of acetone was suspended and the acetone in the vacuum chamber was removed, heating the devices to 250° C. The vacuum chamber itself was also heated by means of a heater.

EXAMPLE 22

The steps of Example 21 were followed for this example except that the partial pressure of acetone was raised to 13 Pa and the pulse wave height of the bipolar pulse voltage was held as high as 20V. Since If increased more rapidly than that of Example 1, the pulse voltage application was terminated in 15 minutes and the acetone inside the vacuum chamber was removed, heating the devices to 250° C. The vacuum chamber itself was also heated. At the end of the pulse voltage application, the device current was equal to If=2.1 mA.

COMPARATIVE EXAMPLE 8

In this example, the partial pressure of acetone was made equal to that of Example 1 or $1.3\times10^{-1}$Pa and a monopolar rectangular pulse voltage having a wave height of Vph=18V as shown in FIG. 6B was used for the activation process. Otherwise, the steps of Example 21 were followed. At the end of the pulse voltage application, the device current was equal to If=1.5 mA.

COMPARATIVE EXAMPLE 9

In this example, the partial pressure of acetone was made equal to that of Example 1 or $1.3\times10^{-1}$Pa and a bipolar pulse voltage having a wave height of Vph=6V was used for the activation process. Otherwise, the steps of Example 21 were followed. At the end of the pulse voltage application, the device current was equal to If=3.0 mA.

Thereafter, a stabilization process was carried out.

A device was picked up from each of Examples 21 and 22 and Comparative Examples 8 and 9 and tested for the performance of electron emission by means of the arrangement of FIG. 7. During the test, the internal pressure of the vacuum chamber was maintained to lower than $2.7\times10^{-6}$Pa and the performance of each device was tested after turning off the heater for heating the device and the one for heating the vacuum chamber and the device was cooled to room temperature.

The voltage applied to the devices was a monopolar rectangular pulse voltage as shown in FIG. 6B and had a wave height, a pulse width and a pulse interval equal to Vph=18V, T1=100 μsec. and T2=10 msec. respectively. In the gauging system, the devices were separated from the anode by H=4 mm and the potential different was held to 1 kV.

Each devices was tested to evaluate the performance of electron emission immediately after the start of the test and after 100 hours of continuous operation. Note that If of the devices of Comparative Example fell remarkably and Ie was extremely low relative to that of the other devices when the application of the activation pulse voltage was terminated and the test was started so that no test was conducted on them thereafter. The results are shown in the table below.

| | end of pulse voltage application | imm. after start of test | | 100 after start of test | |
|---|---|---|---|---|---|
| | If(mA) | If(μ) | Ie(μA) | If(mA) | Ie(μA) |
| Example 21 | 1.8 | 1.0 | 1.2 | 0.7 | 0.7 |
| Example 22 | 2.1 | 1.2 | 1.5 | 1.0 | 1.1 |
| Comparative Example 8 | 1.5 | 1.2 | 0.6 | 0.6 | 0.2 |
| Comparative Example 9 | 3.0 | 0.3 | 0.1 | — | — |

A device that had not been used for the above performance test was picked up from those of each of Examples 21 and 22 and Comparative Examples 8 and 9 and examined for the crystallinity of the carbon film by means of a Raman spectrometer. An Ar laser having a wavelength of 514.5 nm was used for the light source, which produced a light spot with a diameter of about 1 μm on the surface of the specimen.

The Ar laser spot of the above Raman spectrometer was made to scan from an end to the other of the gap of each device and the obtained values for the half width of P1 were plotted as a function of the position of the spot. The devices of Examples 21 and 22 showed a reduction in the half width at the center of P1 as shown in FIG. 21. While a similar observation was obtained for the device of Comparative Example 8 on the anode side end of the gap between the electrodes and the device showed a reduction in the half width at the center of P1, although the signal-level was low because a carbon film was found only poorly on the anode side end. The results are listed below.

The width of P1 was reduced only within a range of 1 μm from the gap for Comparative Example 8 and that of 2 μm for Example 21.

| device | near the gap($cm^{-1}$) | outside the gap($cm^{-1}$) |
|---|---|---|
| Example 21 | 110 | 300 |
| Example 22 | 90 | 300 |
| Comparative Example 8 | 160 | 300 |
| Comparative Example 9 | 280 | 300 |

As the crystallinity of the carbon film was found high at and near the center thereof in each of the above examples, the carbon film was further examined by means of a transmission electron microscope (TEM).

As for each of the devices of Examples 21 and 22, while a carbon film was formed on the both sides of the gap of the electron-emitting region, a lattice images was observed along the edges of the electroconductive thin film in the carbon film located inside the gap to prove the existence of graphite. The particles size of the graphite crystal was several nanometers. On the other hand, no lattice image was observed in areas off the gap to indicate that the carbon film there was constituted mainly of amorphous carbon.

Figure 26:
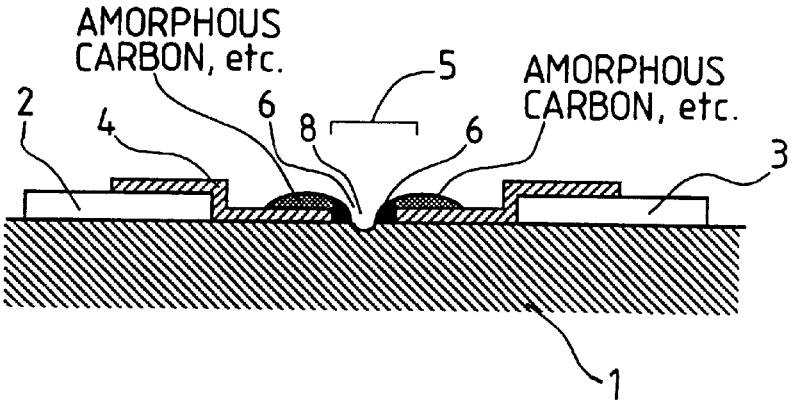
FIG. 26 is a schematic side view of a surface conduction electron-emitting device obtained in Example 21.

FIG. 26 schematically illustrates the lattice image of the graphite observed in the carbon film of the device of Example 21. The carbon film was constituted of graphite 6 inside the gap 5 and of amorphous carbon outside the gap of the electroconductive thin film. While gap separating the graphite films coincides with the gap of the electron-emitting region in FIG. 26, their positions may not necessarily agree with each other and the former may be located near the end of the latter.

In Examples 22, a lattice image was observed even in areas off the gap partially to prove that the carbon film there was constituted of graphite more widely.

As for Comparative Example 8, the carbon film was small in quantity on the cathode side as compared with the anode side, although a lattice image like that of Example 21 was observed in the carbon film on the anode side inside the gap. In Comparative Example 9, no lattice image was found throughout the carbon film to indicate that the entire carbon film was constituted of amorphous carbon.

A groove 8 was observed on the substrate of each of the devices of the above Examples and Comparative Example between the carbon films on the opposite electrodes carbon film (corresponding to the groove between the carbon film and the cathode of Comparative Example 1). The groove was particularly deep in the device of Example 22. This may indicates that radicals and the substrate had reacted positively there as the electric field of the device was stronger than that of the other devices in that area and a relatively large device electrode was generated in the device. By comparing Example 21 with Example 22, it was found that n=Ie/If was greater on the part of Example 22 than on the part of Example 21 and one of the reasons for this may be the deep groove of the device of Example 22 that cut the path of a leak current that might arise between the opposite electrodes. In other words, a deep groove can improve the electron emission efficiency of an electron-emitting device.

EXAMPLE 23

In this example, an electron source was prepared by arranging plurality of surface conduction electron-emitting devices on a substrate and wiring them to form a matrix.

Figure 27:
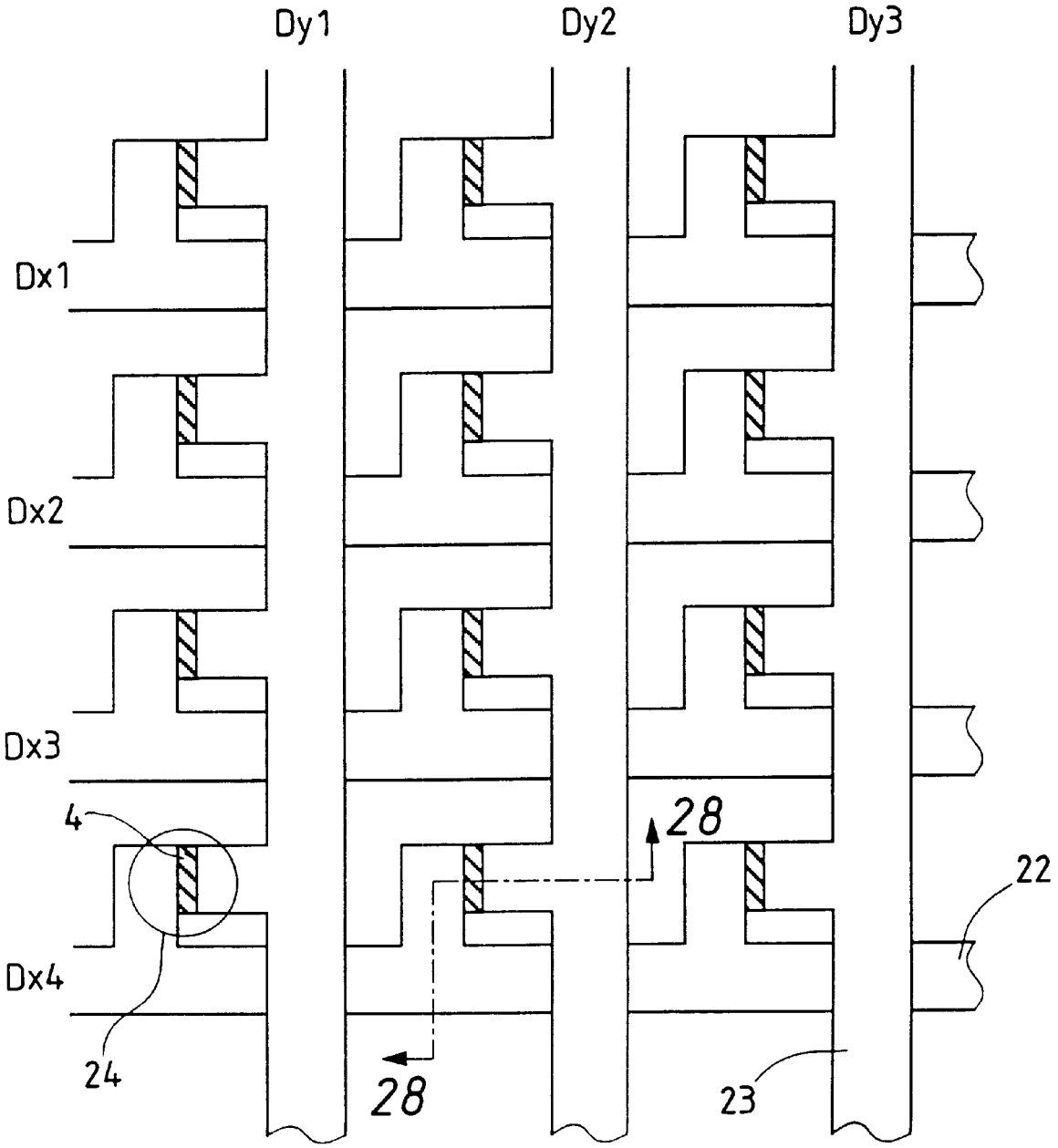
FIG. 27 is a schematic partial plan view of a matrix wiring type electron source.
Figure 28:
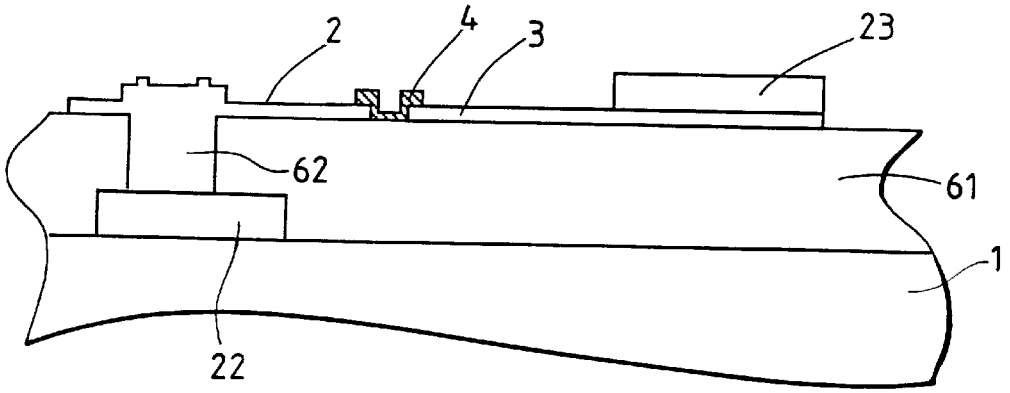
FIG. 28 is a schematic partial sectional side view of the electron source of FIG. 27 taken along line 28—28.

FIG. 27 shows a schematic partial plan view of the electron source. FIG. 28 is a schematic sectional view taken along line 28—28 of FIG. 27. FIGS. 29A through 29H schematically illustrate steps of manufacturing the electron source.

The electron source had a substrate 1, X-directional wirings 22 and Y-directional wirings 23 (also referred to as upper wirings). Each of the devices of the electron source comprised a pair of device electrodes 2 and 3 and an electroconductive thin film 4 including an electron-emitting region. Otherwise, the electron source was provided with an interlayer insulation layer 61 and contact holes 62, each of which electrically connected a corresponding device electrode 2 and a corresponding lower wiring 22.

The steps of manufacturing the electron source will be described by referring to FIGS. 29A through 29H, which respectively correspond to the manufacturing steps.

Step-A:

After thoroughly cleansing a soda lime glass plate a silicon oxide film was formed thereon to a thickness of 0.5 μm by sputtering to produce a substrate 1, on which Cr and Au were sequentially laid to thicknesses of 5 nm and 600 nm respectively and then a photoresist (AZ1370: available from Hoechst Corporation) was formed thereon by means of a spinner, while rotating the film, and baked. Thereafter, a photo-mask image was exposed to light and developed to produce a resist pattern for a lower wiring 22 and then the deposited Au/Cr film was wet-etched to produce a lower wiring 22.

Step-B:

A silicon oxide film was formed as an interlayer insulation layer 61 to a thickness of 1.0 μm by RF sputtering.

Step-C:

A photoresist pattern was prepared for producing a contact hole 62 in the silicon oxide film deposited in Step-B, which contact hole 62 was then actually formed by etching the interlayer insulation layer 61, using the photoresist pattern for a mask. A technique of RIE (Reactive Ion Etching) using $CF_4$ and $H_2$ gas was employed for the etching operation.

Step-D:

Thereafter, a pattern of photoresist (RD-2000N-41: available from Hitachi Chemical Co., Ltd.) was formed for a pair of device electrodes 2 and 3 and a gap G separating the electrodes and then Ti and Ni were sequentially deposited thereon respectively to thicknesses of 5 nm and 100 nm by vacuum deposition. The photoresist pattern was dissolved by an organic solvent and the Ni/Ti deposit film was treated by using a lift-off technique to produce a pair of device electrodes 2 and 3 having a width of 300 μm and separated from each other by a distance G of 3 μm.

Step-E:

After forming a photoresist pattern on the device electrodes 2, 3 for an upper wiring 23, Ti and Au were sequentially deposited by vacuum deposition to respective thicknesses of 5 nm and 500 nm and then unnecessary areas were removed by means of a lift-off technique to produce an upper wirings 23 having a desired profile.

Step-F:

Then a Cr film 63 was formed to a film thickness of 30 nm by vacuum deposition, which was then subjected to a patterning operation to show a pattern of an electroconductive thin film 4 having an opening. Thereafter, a solution of Pd amine complex (ccp4230) was applied to the Cr film by means of a spinner, while rotating the film, and baked at 300° C. for 12 minutes. The formed electroconductive thin film 64 was made of fine particles containing PdO as a principal ingredient and had a film thickness of 70 nm.

Step-G:

The Cr film 63 was wet-etched by using an etchant and removed with any unnecessary areas of the electroconductive thin film 4 to produce a desired pattern. The electric resistance of $Rs=4\times10^4\Omega/\square$.

Step-H:

Then, a pattern for applying photoresist to the entire surface area except the contact hole 62 was prepared and Ti and Au were sequentially deposited by vacuum deposition to respective thicknesses of 5 nm and 500 nm. Any unnecessary areas were removed by means of a lift-off technique to consequently bury the contact hole.

By using an electron source prepared in a manner as described above, an image forming apparatus was prepared. This will be described by referring to FIGS. 10, 11A and 11B.

After securing an electron source substrate 21 onto a rear plate 31, a face plate 36 (carrying a fluorescent film 34 and a metal back 35 on the inner surface of a glass substrate 33) was arranged 5 mm above the substrate 21 with a support frame 32 disposed therebetween and, subsequently, frit glass was applied to the contact areas of the face plate 36, the support frame 32 and rear plate 31 and baked at 400 to 500° C. in the ambient air or in a nitrogen atmosphere for more than 10 minutes to hermetically seal the container. The substrate 21 was also secured to the rear plate 31 by means of frit glass. In FIG. 10, reference numeral 24 denotes a electron-emitting device and numerals 22 and 23 respectively denote X- and Y-directional wirings for the devices.

While the fluorescent film 34 is consisted only of a fluorescent body if the apparatus is for black and white images, the fluorescent film 34 of this example was prepared by forming black stripes and filling the gaps with stripe-shaped fluorescent members of red, green and blue. The black stripes were made of a popular material containing graphite as a principal ingredient. A slurry technique was used for applying fluorescent materials onto the glass substrate 33.

A metal back 35 is arranged on the inner surface of the fluorescent film 34. After preparing the fluorescent film, the metal back was prepared by carrying out a smoothing operation (normally referred to as "filming") on the inner surface of the fluorescent film and thereafter forming thereon an aluminum layer by vacuum deposition.

While a transparent electrode (not shown) might be arranged on the outer surface of the fluorescent film 34 in order to enhance its electroconductivity, it was not used in this example because the fluorescent film showed a sufficient degree of electroconductivity by using only a metal back.

For the above bonding operation, the components were carefully aligned in order to ensure an accurate positional correspondence between the color fluorescent members and the electron-emitting devices.

Figure 30:
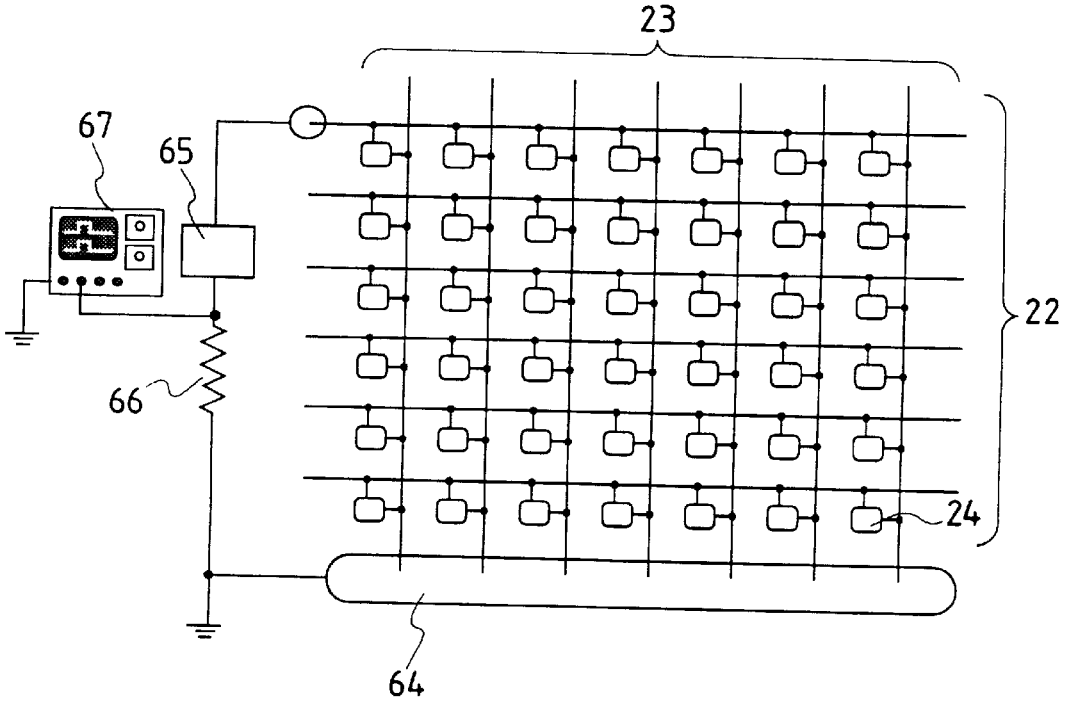
FIG. 30 is a schematic plan view of a matrix wiring type electron source according to the invention, illustrating its "commonly connected" Y-directional wirings for "energization forming".
Figure 29A:
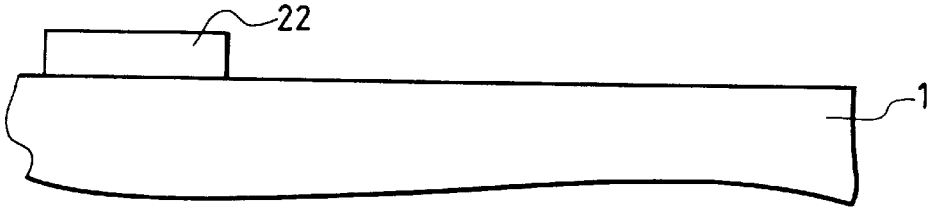
FIGS. 29A through 29H are schematic partial sectional side views of a matrix wiring type electron source according to the invention in different manufacturing steps.
Figure 29B:
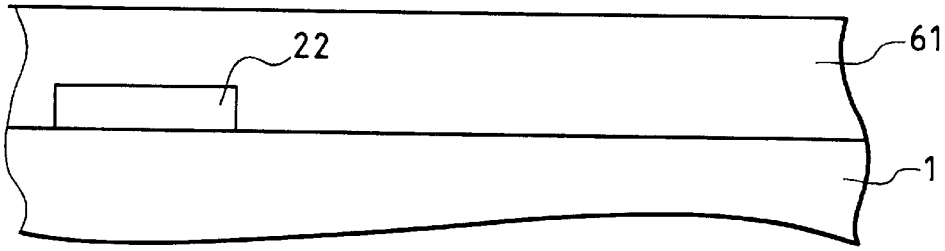
Figure 29C:
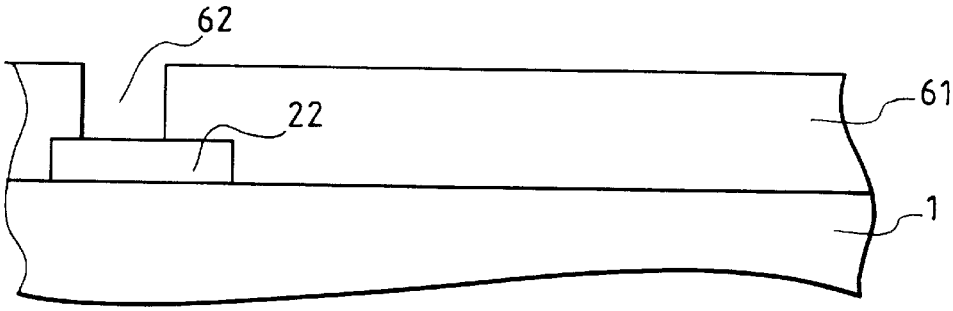
Figure 29D:
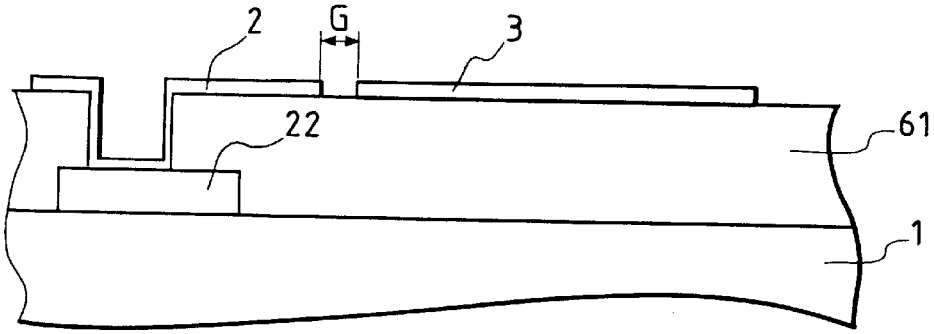
Figure 29E:
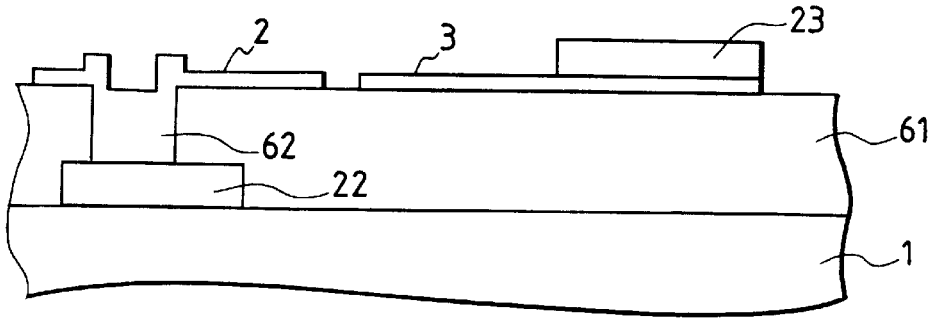
Figure 29F:
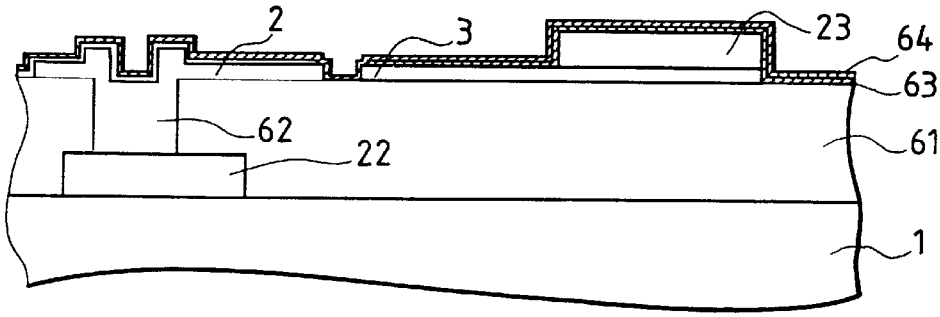
Figure 29G:
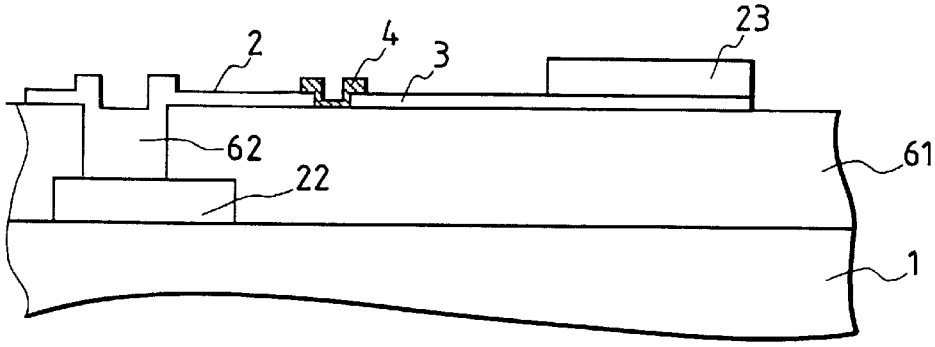
Figure 29H:
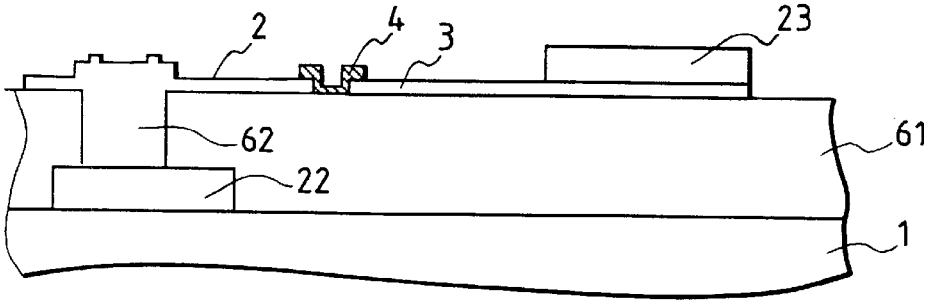

The inside of the prepared glass envelope (airtightly sealed container) was then evacuated by way of an exhaust pipe (not shown) and a vacuum pump to a sufficient degree of vacuum and, thereafter, a forming process was carried out on the devices on a line-by-line basis by commonly connecting the Y-directional wirings. In FIG. 30, reference numeral 64 denotes a common electrode that commonly connected the Y-directional wirings 23 and reference numeral 65 denotes a power source, while reference numerals 66 and 67 respectively denote a resistance for metering the electric current and an oscilloscope for monitoring the electric current.

Thereafter, when the inside of the panel was evacuated again to an internal pressure of $1.3\times10^{-4}$Pa and hydrogen gas was introduced into the panel before a similar pulse voltage was applied to the devices once again.

Then, the vacuum pump unit was switched to an ion pump and the inside of the panel was further evacuated to a degree of $4.2\times10^{-5}$Pa, while heating the entire panel by means of a heater.

Subsequently, the matrix wirings were driven to ensure that the panel operated normally and stably for image display and then the exhaust pipe (not shown) was sealed by heating and melting it with a gas burner to hermetically seal the envelope.

Finally, the display panel was subjected to a getter operation in order to maintain the inside to a high degree of vacuum.

In order to drive the prepared image-forming apparatus comprising a display panel, scan signals and modulation signals were applied to the electron-emitting devices to emit electrons from respective signal generation means by way of the external terminals Dx1 through Dxm and Dy1 through Dyn, while a high voltage of 5.0 kV was applied to the metal back 19 or a transparent electrode (not shown) by way of the high voltage terminal Hv so that electrons emitted from the cold cathode devices were accelerated by the high voltage and collided with the fluorescent film 54 to cause the fluorescent members to excite to emit light and produce images.

While the electron source of Example 22 comprised a plurality of surface conduction electron-emitting devices like the one prepared in Example 1, an electron source and an image-forming apparatus according to the invention are not limited to the use of such electron-emitting devices. Alternatively, an electron source may be prepared by arranging electron-emitting devices like the one prepared in any of Examples 2 through 21 and an image-forming apparatus corresponding to Example 22 may be prepared by using such an electron source.

Figure 31:
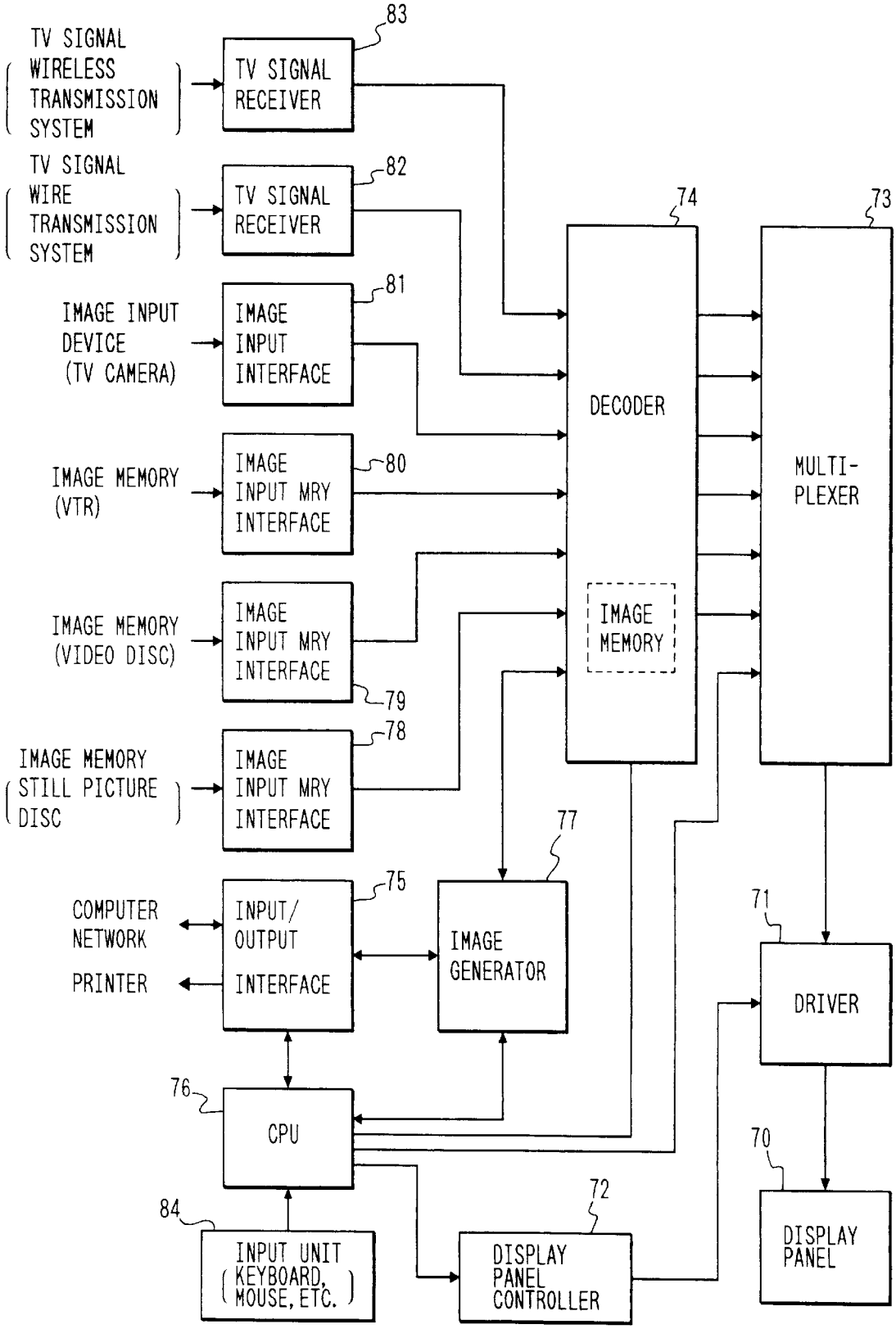
FIG. 31 is a block diagram of an image forming apparatus according to the invention.

FIG. 31 is a block diagram of a display apparatus realized by using an image forming apparatus (display panel) of Example 22 and arranged to provide visual information coming from a variety of sources of information including television transmission and other image sources. In FIG. 31, there are shown a display panel 70, a display panel driver 71, a display panel controller 72, a multiplexer 73, a decoder 74, an input/output interface 75, a CPU 76, an image generator 77, image input memory interfaces 78, 79 and 80, an image input interface 81, TV signal receivers 82 and 83 and an input unit 84. (If the display apparatus is used for receiving television signals that are constituted by video and audio signals, circuits, speakers and other devices are required for receiving, separating, reproducing, processing and storing audio signals along with the circuits shown in the drawing. However, such circuits and devices are omitted here in view of the scope of the present invention.)

Now, the components of the apparatus will be described, following the flow of image signals therethrough.

Firstly, the TV signal receiver 83 is a circuit for receiving TV image signals transmitted via a wireless transmission system using electromagnetic waves and/or spatial optical telecommunication networks. The TV signal system to be used is not limited to a particular one and any system such as NTSC, PAL or SECAM may feasibly be used with it. It is particularly suited for TV signals involving a larger number of scanning lines (typically of a high definition TV system such as the MUSE system) because it can be used for a large display panel 70 comprising a large number of pixels. The TV signals received by the TV signal receiver 73 are forwarded to the decoder 74.

Secondly, the TV signal receiver 82 is a circuit for receiving TV image signals transmitted via a wired transmission system using coaxial cables and/or optical fibers. Like the TV signal receiver 83, the TV signal system to be used is not limited to a particular one and the TV signals received by the circuit are forwarded to the decoder 74.

The image input interface 81 is a circuit for receiving image signals forwarded from an image input device such as a TV camera or an image pick-up scanner. It also forwards the received image signals to the decoder 74.

The image input memory interface 80 is a circuit for retrieving image signals stored in a video tape recorder (hereinafter referred to as VTR) and the retrieved image signals are also forwarded to the decoder 74.

The image input memory interface 79 is a circuit for retrieving image signals stored in a video disc and the retrieved image signals are also forwarded to the decoder 74.

The image input memory interface 78 is a circuit for retrieving image signals stored in a device for storing still image data such as so-called still disc and the retrieved image signals are also forwarded to the decoder 74.

The input/output interface 75 is a circuit for connecting the display apparatus and an external output signal source such as a computer, a computer network or a printer. It carries out input/output operations for image data and data on characters and graphics and, if appropriate, for control signals and numerical data between the CPU 76 of the display apparatus and an external output signal source.

The image generation circuit 77 is a circuit for generating image data to be displayed on the display screen on the basis of the image data and the data on characters and graphics input from an external output signal source via the input/output interface 75 or those coming from the CPU 76. The circuit comprises reloadable memories for storing image data and data on characters and graphics, read-only memories for storing image patterns corresponding given character codes, a processor for processing image data and other circuit components necessary for the generation of screen images.

Image data generated by the image generation circuit 77 for display are sent to the decoder 74 and, if appropriate, they may also be sent to an external circuit such as a computer network or a printer via the input/output interface 75.

The CPU 76 controls the display apparatus and carries out the operation of generating, selecting and editing images to be displayed on the display screen.

For example, the CPU 76 sends control signals to the multiplexer 73 and appropriately selects or combines signals for images to be displayed on the display screen. At the same time it generates control signals for the display panel controller 72 and controls the operation of the display apparatus in terms of image display frequency, scanning method (e.g., interlaced scanning or non-interlaced scanning), the number of scanning lines per frame and so on.

The CPU 76 also sends out image data and data on characters and graphic directly to the image generation circuit 77 and accesses external computers and memories via the input/output interface 75 to obtain external image data and data on characters and graphics.

The CPU 76 may additionally be so designed as to participate other operations of the display apparatus including the operation of generating and processing data like the CPU of a personal computer or a word processor.

The CPU 76 may also be connected to an external computer network via the input/output interface 75 to carry out computations and other operations, cooperating therewith.

The input unit 84 is used for forwarding the instructions, programs and data given to it by the operator to the CPU 76. As a matter of fact, it may be selected from a variety of input devices such as keyboards, mice, joysticks, bar code readers and voice recognition devices as well as any combinations thereof.

The decoder 74 is a circuit for converting various image signals input via said circuits 77 through 73 back into signals for three primary colors, luminance signals and I and Q signals. Preferably, the decoder 74 comprises image memories as indicated by a dotted line in FIG. 35 for dealing with television signals such as those of the MUSE system that require image memories for signal conversion. The provision of image memories additionally facilitates the display of still images as well as such operations as thinning out, interpolating, enlarging, reducing, synthesizing and editing frames to be optionally carried out by the decoder 74 in cooperation with the image generation circuit 77 and the CPU 76.

The multiplexer 73 is used to appropriately select images to be displayed on the display screen according to control signals given by the CPU 76. In other words, the multiplexer 73 selects certain converted image signals coming from the decoder 74 and sends them to the drive circuit 71. It can also divide the display screen in a plurality of frames to display different images simultaneously by switching from a set of image signals to a different set of image signals within the time period for displaying a single frame.

The display panel controller 72 is a circuit for controlling the operation of the drive circuit 71 according to control signals transmitted from the CPU 76.

Among others, it operates to transmit signals to the drive circuit 71 for controlling the sequence of operations of the power source (not shown) for driving the display panel in order to define the basic operation of the display panel 70. It also transmits signals to the drive circuit 71 for controlling the image display frequency and the scanning method (e.g., interlaced scanning or non-interlaced scanning) in order to define the mode of driving the display panel 70.

If appropriate, it also transmits signals to the drive circuit 71 for controlling the quality of the images to be displayed on the display screen in terms of luminance, contrast, color tone and sharpness.

The drive circuit 71 is a circuit for generating drive signals to be applied to the display panel 70. It operates according to image signals coming from said multiplexer 73 and control signals coming from the display panel controller 72.

A display apparatus according to the invention and having a configuration as described above and illustrated in FIG. 35 can display on the display panel 70 various images given from a variety of image data sources. More specifically, image signals such as television image signals are converted back by the decoder 74 and then selected by the multi-plexer 73 before sent to the drive circuit 71. On the other hand, the display controller 72 generates control signals for controlling the operation of the drive circuit 71 according to the image signals for the images to be displayed on the display panel 70. The drive circuit 71 then applies drive signals to the display panel 70 according to the image signals and the control signals. Thus, images are displayed on the display panel 70. All the above described operations are controlled by the CPU 76 in a coordinated manner.

The above described display apparatus can not only select and display particular images out of a number of images given to it but also carry out various image processing operations including tho s e for enlarging, reducing, rotating, emphasizing edges of, thinning out, interpolating, changing colors of and modifying the aspect ratio of images and editing operations including those for synthesizing, erasing, connecting, replacing and inserting images as the image memories incorporated in the decoder 74, the image generation circuit 77 and the CPU 76 participate such operations.

Although not described with respect to the above embodiment, it is possible to provide it with additional circuits exclusively dedicated to audio signal processing and editing operations.

Thus, a display apparatus according to the invention and having a configuration as described above can have a wide variety of industrial and commercial applications because it can operate as a display apparatus for television broadcasting, as a terminal apparatus for video teleconferencing, as an editing apparatus for still and movie pictures, as a terminal apparatus for a computer system, as an OA apparatus such as a word processor, as a game machine and in many other ways.

It may be needless to say that FIG. 31 shows only an example of possible configuration of a display apparatus comprising a display panel provided with an electron source prepared by arranging a number of surface conduction electron-emitting devices and the present invention is not limited thereto. For example, some of the circuit components of FIG. 35 may be omitted or additional components may be arranged there depending on the application. For instance, if a display apparatus according to the invention is used for visual telephone, it may be appropriately made to comprise additional components such as a television camera, a microphone, lighting equipment and transmission/reception circuits including a modem.

While the activation process used for the above example was adapted for surface conduction electron-emitting devices of the type of Example 1, an activation process that corresponds to one of Examples 2 through 22 may alternatively be used whenever appropriate.

EXAMPLE 24

Figure 32A:
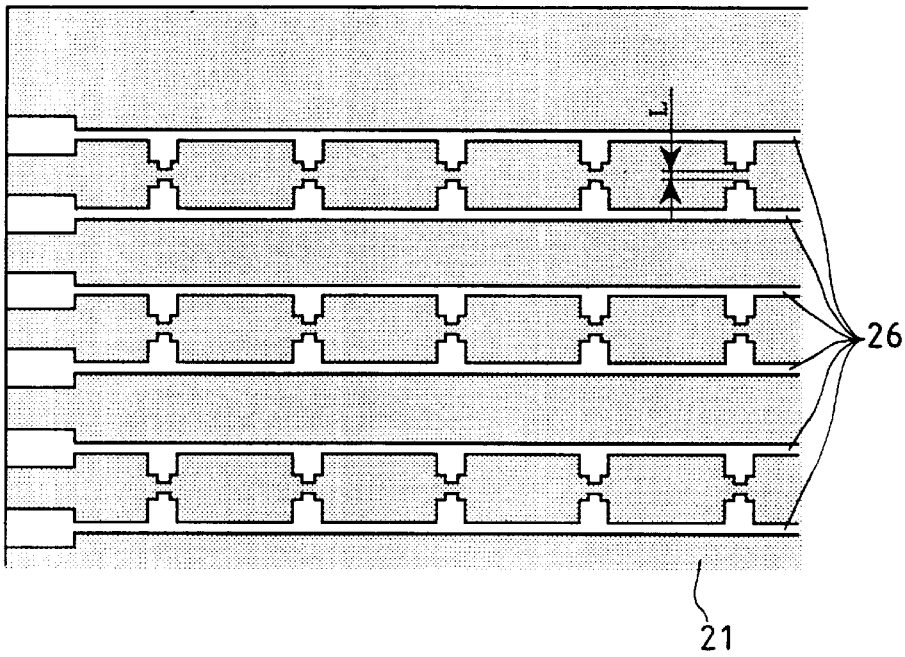
FIGS. 32A through 32C are schematic partial plan views of a ladder wiring type electron source according to the invention in different manufacturing steps.
Figure 32B:
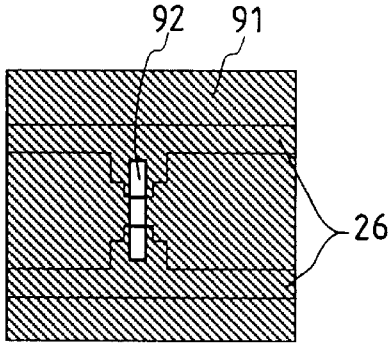
Figure 32C:
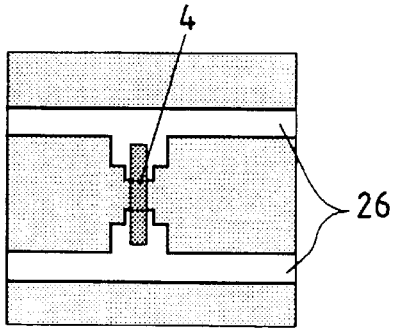
Figure 33:
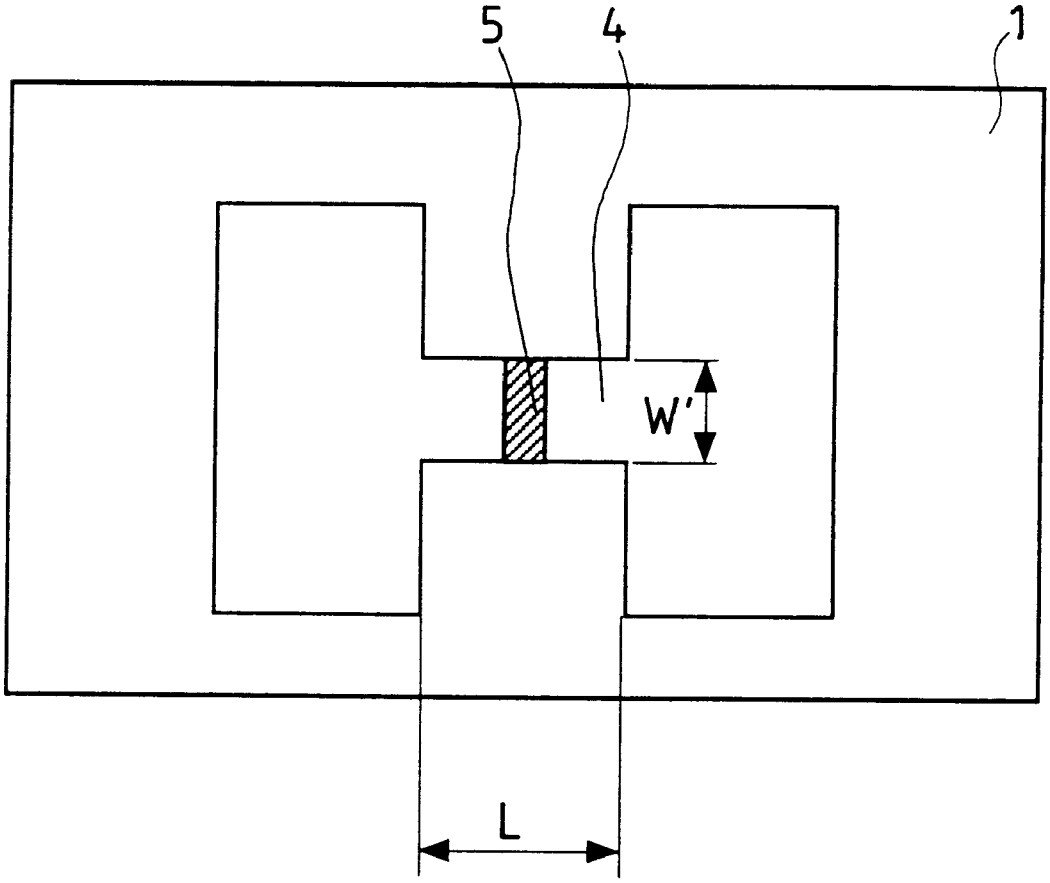
FIG. 33 PRIOR ART
FIG. 33 is a schematic plan view of a conventional surface conduction electron-emitting device.

In this example, an electron source having a ladder-like wiring pattern and an image forming apparatus comprising such an electron source were prepared in a manner as described below by referring to FIGS. 32A through 32C illustrating part of the manufacturing steps.

Step-A:

After thoroughly cleansing a soda lime glass plate, a silicon oxide film was formed thereon to a thickness of 0.5 $\mu$m by sputtering to produce a substrate 21, on which a pattern of photoresist (RD-2000N-41: available from Hitachi Chemical Co., Ltd.) corresponding to the pattern of a pair of electrodes having openings was formed. Then, a Ti film and an Ni film were sequentially formed to respective thicknesses of 5 nm and 100 nm by vacuum deposition. Thereafter, the photoresist was dissolved by an organic solvent and the Ni/Ti film was lifted off to produce common wirings 26 that operated also as device electrodes. The device electrodes was separated by a distance of L=10 $\mu$m. (FIG. 32A)

Step-B:

A Cr film was formed on the device to a thickness of 300 nm by vacuum deposition and then an opening 92 corresponding the pattern of an electroconductive thin film was formed by photolithography. Thereafter, a Cr mask 91 was formed out of the film for forming an electroconductive thin film. (FIG. 32B)

Thereafter, a solution of a Pd amine complex (ccp4230: available from Okuno Pharmaceutical Co., Ltd.) was applied to the Cr film by means of a spinner and baked at 300° C. for 12 minutes to produce a fine particle film containing PdO as a principal ingredient. The film had a film thickness of 7 nm.

Step-C:

The Cr mask was removed by wet-etching and the PdO fine particle film was lifted off to obtain an electroconductive thin film 4 having a desired profile. The electroconductive thin film showed an electric resistance of about $Rs=2\times10^4\Omega/\square$. (FIG. 32C)

Step-D:

A display panel was prepared as in the case of Example 23, although the panel of this examples slightly differed from that of Example 23 in that the former were provided with grid electrodes. As shown in FIG. 14, the electron source substrate 21, the rear plate 31, the face plate 36 and the grid electrodes 27 were put together and external terminals 29 and external grid electrode terminals 30 were connected thereto.

Processes of forming, activation and stabilization were carried out on the image forming apparatus as in the case of Example 23 and subsequently the exhaust pipe (not shown) was fused and hermetically sealed. Finally, a getter operation was carried out by means of high frequency heating.

The image forming apparatus of this example could be driven to operate like the one of Example 23.

While the activation process used for the above example was adapted for surface conduction electron-emitting devices of the type of Example 1, an activation process that corresponds to one of Examples 2 through 22 may alternatively be used whenever appropriate as in the case of Example 23.

As described above in detail, by arranging a highly crystalline graphite film inside the gap of the electron-emitting region of an electron-emitting device according to the invention, possible degradation with time of the electron-emitting device can be effectively prevented for the operation of electron emission so that the stability of the device can be greatly improved. When such a graphite film is formed on both the anode and cathode side ends the gap of the electron-emitting region, the electron-emitting device can emit electrons at an enhanced rate to further improve the electron emission efficiency $\eta=Ie/If$.

Additionally, if the device does not have any carbon film other than the graphite film inside the gap or if the carbon film outside the gap, if any, is made of highly crystalline graphite, the device can effectively be made free from the phenomenon of electric discharge that may appear in operation.

Finally, by forming a groove on the electron-emitting region, the leak current of the device can be remarkably reduced to further improve the electron emission efficiency of the device.

What is claimed is:

1. A method of manufacturing an electron-emitting device comprising a pair of electrodes and an electroconductive film arranged between the electrodes and including an electron-emitting region, comprising a step of applying a voltage to the electroconductive film containing a gap therein in an atmosphere containing one or more than one organic substances and a gas having a composition expressed by a general formula XY (where both X and Y represent hydrogen or a halogen atom).

2. A method of manufacturing an electron-emitting device comprising a pair of electrodes and an electroconductive film arranged between the electrodes and including an electron-emitting region, comprising a step of applying a voltage to the electroconductive film containing a gap therein, the voltage being a bipolar pulse voltage.

3. A method of manufacturing an electron-emitting device according to claim 1 or 2, wherein said step of applying a voltage to the electroconductive film further comprises the steps of applying a voltage in a first atmosphere containing one or more than one organic substances and applying a voltage in a second atmosphere containing a gas having a composition expressed by a general formula XY (where both X and Y represent hydrogen or a halogen atom).

4. A method of manufacturing an electron-emitting device according to claim 3, wherein said step of applying a voltage in a first atmosphere and said step of applying a voltage in a second atmosphere are carried out alternately.

5. A method of manufacturing an electron-emitting device according to claim 1 or 2, wherein said step of applying a voltage to the electroconductive film is carried out in an atmosphere containing one or more than one organic substances and a gas having a composition expressed by a general formula XY (where both X and Y represent hydrogen or a halogen atom).

6. A method of manufacturing an electron-emitting device comprising a pair of electrodes and an electroconductive film arranged between the electrodes and including an electron-emitting region, comprising the steps of forming a graphite film on the electroconductive film including an electron-emitting region and removing any deposits other than the graphite film.

7. A method of manufacturing an electron-emitting device according to claim 6, wherein said step of forming a graphite film includes a step of applying a voltage to the electroconductive film in an atmosphere containing one or more than one organic substances.

8. A method of manufacturing an electron-emitting device according to claim 6 or 7, wherein said step of removing any deposits includes a step of applying a voltage to the electroconductive film in an atmosphere containing a gas having a composition expressed by a general formula XY (where both X and Y represent hydrogen or a halogen atom).

9. A method of manufacturing an electron-emitting device according to claim 6 or 7, wherein said step of removing any deposits includes a step of applying a voltage to the electroconductive film in an atmosphere containing a gas having a composition expressed by a general formula XY (where both X and Y represent hydrogen or a halogen atom) and one or more than one organic substances.

10. A method of manufacturing an electron-emitting device according to claim 6, wherein said steps of forming a graphite film and removing the deposits are carried out together as a single step.

11. A method of manufacturing an electron-emitting device according to claim 10, wherein said step of forming a graphite film and removing the deposits includes a step of applying a voltage to the electro-conductive film in an atmosphere containing a gas having a composition expressed by a general formula XY (where both X and Y represent hydrogen or a halogen atom) and one or more than one organic substances.

12. A method of manufacturing an electron-emitting device according to claim 1, 2 or 6, wherein the electron-emitting device is a surface conduction electron-emitting device.

13. A method of manufacturing an electron source comprising a plurality of electron-emitting devices arranged in rows commonly connected by respective wirings, wherein the electron-emitting devices are manufactured by a method according to claim 1, 2 or 6.

14. A method of manufacturing an electron source comprising a plurality of electron-emitting devices connected by a matrix of wirings, wherein the electron-emitting devices are manufactured by a method according to claim 1, 2 or 6.

15. A method of manufacturing an image forming apparatus comprising electron-emitting devices and an image forming member, wherein the electron-emitting devices are manufactured by a method according to claim 1, 2 or 6.

* * * * *

UNITED STATES PATENT AND TRADEMARK OFFICE

CERTIFICATE OF CORRECTION

PATENT NO. : 6,179,678 B1
DATED : January 30, 2001
INVENTOR(S) : Fumio Kishi et al.

It is certified that error appears in the above-identified patent and that said Letters Patent is hereby corrected as shown below:

Title page,
Item [56], FOREIGN PATENT DOCUMENTS, "13092242" should read -- 1-309242 --.

OTHER PUBLICATIONS,
"H. Araki, et a..," should read -- H. Araki et al., --; and after "H. Araki, et a.", "Emission f" should read -- Emission of --;
After ""Influence of Organic Molecules", "N. sotnik" should read -- N. Sotnik --;
After ""Influence of Gas Composition", "(1987." should read -- (1987). --;
""Prospectus for Metal/non-Metal Microsystems:" should read -- Prospects for Metal/non-Metal Microsystems: --.

Column 1,
Line 47, "[M." should read -- M. --;
Line 48, "(1975)] and [H." should read -- (1975) and H. --.

Column 3,
Line 28, "a steps" should read -- steps --.

Column 6,
Line 19, "gradually" should read -- gradual --.

Column 10,
Line 33, "ner" should read -- ning --;
Line 51, "Ti" should read -- T1 --;
Line 67, "rate" should read -- rate of, for instance, 0.1 V per step. --.

Column 11,
Line 18, "remarkably" should read -- considerable --.

Column 12,
Line 54, "1 x $10^{-}$" should read -- 1 x $10^{-6}$Pa --;
Line 55, "$_{6}$Pa" should be deleted.

Column 14,
Line 47, "to" should read -- to as --;
Line 55, "an" should read -- a --.

Column 16,
Line 39, "denotes" should read -- denote --.

UNITED STATES PATENT AND TRADEMARK OFFICE

CERTIFICATE OF CORRECTION

PATENT NO. : 6,179,678 B1
DATED : January 30, 2001
INVENTOR(S) : Fumio Kishi et al.

It is certified that error appears in the above-identified patent and that said Letters Patent is hereby corrected as shown below:

Column 17,
Line 5, "is" should read -- may --;
Line 46, "1 x $10^{-5}$" should read -- 1 x $10^{-5}$Pa --.

Column 18,
Line 15, "dox 1" should read -- Dox 1 --.

Column 19,
Line 2, "and the device emit" should read -- such that the device emits --;
Line 3, "only" should read -- only when --.

Column 20,
Line 53, "dox 1," should read -- Dox 1, --.

Column 21,
Line 58, "was" should read -- were --.

Column 22,
Line 51, "(4.2x$10^{-5}$Pz" should read -- 4.2x$10^{-5}$Pa --;
Line 57, "to" should read -- to as --.

Column 23,
Line 43, "was" should read -- were --;
Line 59, "Step-c:" should read -- ¶ Step c: --.

Column 24,
Line 1, "2.6x$10^{-}$" should read -- 2.6x$10^{-6}$Pa. --;
Line 2, "$_6$Pa." should be deleted.

Column 26,
Line 30, "100 after start" should read -- 100 hours after start --.

Column 28,
Line 52, "withstand" should read -- withstanding --.

Column 29,
Line 15, close up right margin;
Line 16, close up left margin;
Line 55, "being" should read -- was --;
Line 65, "Step-(1)" should read -- Steps (1) --.

UNITED STATES PATENT AND TRADEMARK OFFICE

CERTIFICATE OF CORRECTION

PATENT NO. : 6,179,678 B1
DATED : January 30, 2001
INVENTOR(S) : Fumio Kishi et al.

It is certified that error appears in the above-identified patent and that said Letters Patent is hereby corrected as shown below:

Column 30,
Line 2, "Step-(1)" should read -- Steps (1) --;
Line 65, "sets" should read -- set --.

Column 31,
Line 28, "was" should read -- were --;
Line 52, "2.6x10⁻" should read -- $2.6x10^{-6}$Pa. --.
Line 53, "6Pa." should be deleted.

Column 34,
Line 12, close up right margin;
Line 13, "close up left margin;
Line 44, "illustrate" should read -- illustrates --;
Line 49, "was" should read -- were --.

Column 35,
Lines 9 and 11, "was" should read -- were --;
Line 36, "2.7x10⁻" should read -- $2.7x10^{-6}$Pa. --;
Line 37, "6Pa." should be deleted.

Column 36,
Line 16, "1.3x10⁻" should read -- $1.3x10^{-6}$Pa. --;
Line 17, "6Pa." should be deleted.

Column 37,
Line 16, "found" should read -- found on --;
Line 50, "was" should read -- were --.

Column 41,
Line 62, "pressures" should read -- pressure --.

Column 42,
Line 2, "and If" should read -- and Ie --;
Line 50, "was" should read -- were --.

Column 43,
Line 10, "2.7x10⁻" should read -- $2.7x10^{-3}$Pa. --;
Line 11, "3Pa." should be deleted;
Line 29, "to" should read -- to as --;
Line 50, "and If" should read -- and Ie --; and "devices" should read -- devices of --.

UNITED STATES PATENT AND TRADEMARK OFFICE

CERTIFICATE OF CORRECTION

PATENT NO. : 6,179,678 B1
DATED : January 30, 2001
INVENTOR(S) : Fumio Kishi et al.

It is certified that error appears in the above-identified patent and that said Letters Patent is hereby corrected as shown below:

Column 44,
Line 33, "was" should read -- were --.

Column 46,
Line 10, "Example" should read -- Examples --;
Line 18, "100 after" should read -- 100 hours after --;
Line 20, "If(μ)" should read -- If (mA) --.

Column 47,
Line 1, "images" should read -- image --;
Line 4, "particles" should read -- particle --;
Line 17, "Examples" should read -- Example --;
Line 28, "Example" should read -- Examples --;
Line 29, "electrodes" should read -- electrode's --;
Line 33, "indicates" should read -- indicate --.

Column 51,
Line 19, "given" should read -- to given --;
Line 40, "graphic" should read -- graphics --;
Line 45, "other" should read -- in other --.

Column 52,
Line 51, "tho s e" should read -- those --;
Line 57, "such" should read -- in such --.

Column 53,
Line 65, "examples" should read -- example --;
Line 66, "were" should read -- was --.

UNITED STATES PATENT AND TRADEMARK OFFICE

CERTIFICATE OF CORRECTION

PATENT NO. : 6,179,678 B1
DATED : January 30, 2001
INVENTOR(S) : Fumio Kishi et al.

It is certified that error appears in the above-identified patent and that said Letters Patent is hereby corrected as shown below:

Column 54,
Line 24, "ends" should read -- ends of --.

Signed and Sealed this

Twenty-third Day of April, 2002

*Attest:*

*Attesting Officer*

JAMES E. ROGAN
*Director of the United States Patent and Trademark Office*